US007248969B2

(12) United States Patent
Patzek et al.

(10) Patent No.: US 7,248,969 B2
(45) Date of Patent: Jul. 24, 2007

(54) WATERFLOOD CONTROL SYSTEM FOR MAXIMIZING TOTAL OIL RECOVERY

(75) Inventors: Tadeusz Wiktor Patzek, Oakland, CA (US); Dimitriy Borisovich Silin, Pleasant Hill, CA (US); Asoke Kumar De, San Jose, CA (US)

(73) Assignee: The Regents of the University of California, Oakland, CA (US)

( * ) Notice: Subject to any disclaimer, the term of this patent is extended or adjusted under 35 U.S.C. 154(b) by 290 days.

(21) Appl. No.: 10/993,598

(22) Filed: Nov. 19, 2004

(65) Prior Publication Data

US 2006/0122777 A1 Jun. 8, 2006

Related U.S. Application Data

(63) Continuation of application No. 10/115,766, filed on Apr. 2, 2002, now Pat. No. 6,904,366.

(60) Provisional application No. 60/281,563, filed on Apr. 3, 2001.

(51) Int. Cl.
*G01V 9/00* (2006.01)

(52) U.S. Cl. ..... 702/13; 702/2

(58) Field of Classification Search ..... 702/138, 702/1–16; 166/403, 272.3, 252.4; 703/10
See application file for complete search history.

(56) References Cited

U.S. PATENT DOCUMENTS 5,363,915 A * 11/1994 Marquis et al. ..... 166/403
5,826,656 A * 10/1998 McGuire et al. ..... 166/305.1
5,984,010 A * 11/1999 Elias et al. ..... 166/272.3
6,173,775 B1 * 1/2001 Elias et al. ..... 166/272.3
6,467,543 B1 * 10/2002 Talwani et al. ..... 166/252.4
6,615,917 B2 * 9/2003 Bussear et al. ..... 166/250.15

OTHER PUBLICATIONS

Silin et al., Control of water injection, Apr. 3, 2000, SPE 59300, All Pages.*

* cited by examiner

*Primary Examiner*—John Barlow
*Assistant Examiner*—Victor J. Taylor
(74) *Attorney, Agent, or Firm*—Joseph R. Milner

(57) ABSTRACT

A control system and method for determining optimal fluid injection pressure is based upon a model of a growing hydrofracture due to waterflood injection pressure. This model is used to develop a control system optimizing the injection pressure by using a prescribed injection goal coupled with the historical times, pressures, and volume of injected fluid at a single well. In this control method, the historical data is used to derive two major flow components: the transitional component, where cumulative injection volume is scaled as the square root of time, and a steady-state breakthrough component, which scales linearly with respect to time. These components provide diagnostic information and allow for the prevention of rapid fracture growth and associated massive water break through that is an important part of a successful waterflood, thereby extending the life of both injection and associated production wells in waterflood secondary oil recovery operations.

25 Claims, 30 Drawing Sheets

WATERFLOOD CONTROL SYSTEM FOR MAXIMIZING TOTAL OIL RECOVERY

CROSS REFERENCE TO RELATED APPLICATIONS

This is a continuation patent application claiming benefit of priority to U.S. patent application Ser. No. 10/115,766, filed Apr. 2, 2002 now U.S. Pat. No. 6,904,366, which claims priority to provisional application No. 60/281,563, filed Apr. 3, 2001, entitled "A Process For Waterflood Surveillance and Control".

STATEMENT REGARDING FEDERAL FUNDING

This invention was made with U.S. Government support under Contract Number DE-AC03-76SF00098 between the U.S. Department of Energy and The Regents of the University of California for the management and operation of the Lawrence Berkeley National Laboratory. The U.S. Government has certain rights in this invention.

BACKGROUND OF THE INVENTION

1. Field of the Invention

The present invention relates to secondary oil recovery by waterflooding. Particularly, the present invention relates to a method and/or a hardware implementation of a method for controlling well injection pressures for at least one well injector used for secondary oil recovery by waterflooding. The control method additionally detects and appropriately reacts to step-wise hydrofracture events.

2. Description of the Relevant Art

Waterflooding is a collection of operations in an oil field used to support reservoir pressure at extraction wells ("producers") and enhance oil recovery through a system of wells injecting water or other fluids ("injectors"). The waterflooding process uses fluid injection to transport residual oil remaining from initial primary oil production to appropriate producers for extraction. In this manner, wells that have finished primary production can continue to produce oil, thereby extending the economic life of a well field, and increasing the total recovered oil from the reservoir.

Waterflooding is by far the most important secondary oil recovery process. Proper management of waterfloods is essential for optimal recovery of oil and profitability of the waterflooding operation. Improper management of waterfloods can create permanent, irreparable damage to well fields that can trap oil so that subsequent waterflooding becomes futile. When excess injector pressure is used, the geological strata (or layer) containing the oil can be crushed (or hydrofractured). The growth of such hydrofractures can cause a direct conduit from an injector to a producer, whereby no further oil is produced, and water is simply pumped in the injector, conducted through the hydrofractured conduit, and recovered at the producer through a process known as "channeling." At this juncture, the injector is no longer useful in its function, and is now known as a failed, dead, or lost well.

Lost wells are undesirable for many reasons. There is lost time in drilling a new well, resulting in lost production time. There is additional cost for the drilling labor and materials. Finally, a portion of the reservoir is rendered unrecoverable using traditional economically viable recovery means.

In some well fields, wells are spaced as close as every 25 meters. When a significant fraction of these closely packed wells fail, the drilling resources available may be exceeded, in such case, a lost well is truly lost, because it may not be replaced due to failure of yet more other wells.

The method disclosed here provides important information regarding the maximum pressures that may be used on a given well to minimize growth of new hydrofractures. This information may be important for groundwater remediation to environmentally contaminated regions by operation in a predominantly steady state flow mode where little additional hydrofracturing will occur. Such additional hydrofracturing will be shown below to be a transient component of injector to producer flow and commensurate hydrofracture growth.

U.S. Pat. No. 6,152,226 discloses a system and process for secondary hydrocarbon recovery whereby a hydrocarbon reservoir undergoing secondary recovery is subject to a first and then at least a second gravity gradient survey in which a gravity gradiometer takes gradient measurements on the surface above the reservoir to define successive data sets. The differences between the first and subsequent gravity gradient survey yields information as to sub-surface density changes consequent to displacement of the hydrocarbon and the replacement thereof by the drive-out fluid including the position, morphology, and velocity of the interface between the hydrocarbon to be recovered and the drive-out fluid.

U.S. Pat. No. 5,826,656 discloses a method for recovering waterflood residual oil from a waterflooded oil-bearing subterranean formation penetrated from an earth surface by at least one well by injecting an oil miscible solvent into a waterflood residual oil-bearing lower portion of the oil-bearing subterranean formation through a well completed for injection of the oil miscible solvent into the lower portion of the oil-bearing formation; continuing the injection of the oil miscible solvent into the lower portion of the oil-bearing formation for a period of time equal to at least one week; recompleting the well for production of quantities of the oil miscible solvent and quantities of waterflood residual oil from an upper portion of the oil-bearing formation; and producing quantities of the oil miscible solvent and waterflood residual oil from the upper portion of the oil-bearing formation. The formation may have previously been both waterflooded and oil miscible solvent flooded. The solvent may be injected through a horizontal well and solvent and oil may be recovered through a plurality of wells completed to produce oil and solvent from the upper portion of the oil-bearing formation.

U.S. Pat. No. 5,711,373 discloses a method for recovering a hydrocarbon liquid from a subterranean formation after predetermining its residual oil saturation. Such a method would displace a hydrocarbon fluid in a subterranean formation using a substantially non-aqueous displacement fluid after a waterflood.

SUMMARY OF THE INVENTION

This invention provides a well injection pressure controller comprising:

- an injection goal flow rate of fluid to be injected into an injector well, the injector well having an injection pressure;
- a time measurement device, a pressure measurement device and a cumulative flow device, said pressure measurement device and said cumulative flow device monitoring the injector well;
- an historical data set $\{t_i\ p_i\ q_i\}$ where for $i \epsilon (1 \ldots n)$, $n \geqq 1$ of related prior samples over an $i^{th}$ interval for the injector well containing at least a sample time $t_i$, an average injection pressure $p_i$ on the interval, and a cumulative measure of the volume of fluid injected into the injector well $q_i$ as of the sample time $t_i$ on the interval, said historical data set accumulated through sampling of said time measurement device, said pressure measurement device and said cumulative flow device;

a method of calculation, using the historical data set and the injection goal, to calculate an optimal injection pressure $p_{inj}$ for a subsequent interval of fluid injection; and an output device for controlling the injector well injection pressure, whereby the injector well injection pressure is substantially controlled to the optimal injection pressure $p_{inj}$.

DETAILED DESCRIPTION OF THE PREFERRED EMBODIMENT

Figure 1:
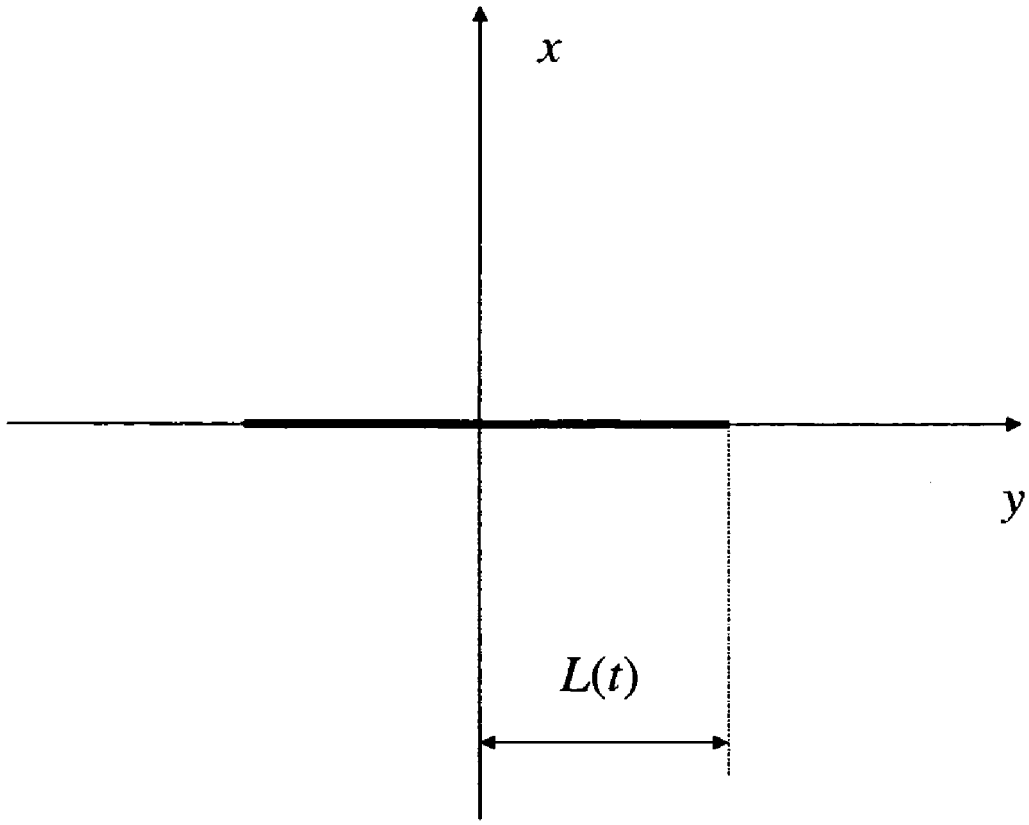
FIG. 1 The coordinate system and the fracture.

The following references are hereby specifically incorporated in their entirety by attachment to this specification and each describe part of the means for performing the process described herein:

"Control Model of Water Injection into a Layered Formation", Paper SPE 59300, Accepted by SPEJ, December 2000, Authors: Silin and Patzek;

"Waterflood Surveillance and Supervisory Control", Paper SPE 59295, Presented at the 2000 SPE/DOE Improved Oil Recovery Symposium held in Tulsa, Okla., 3–5 Apr., 2000;

"Transport in Porous Media, TIPM 1493", Water Injection Into a Low-Permeability Rock—1. Hydrofracture Growth, Authors: Silin and Patzek;

"Transport in Porous Media, TIPM 1493", Water Injection Into a Low-Permeability Rock—2. Control Model, Authors: Silin and Patzek; and "Use of InSAR in Surveillance and Control of a Large field Project" Authors: Silin and Patzek.

Defined Terms:

Computer: any device capable of performing the steps developed in this invention to result in an optimal waterflood injection, including but not limited to: a microprocessor, a digital state machine, a field programmable gate array (FGPA), a digital signal processor, a collocated integrated memory system with microprocessor and analog or digital output device, a distributed memory system with microprocessor and analog or digital output device connected with digital or analog signal protocols.

Computer readable media: any source of organized information that may be processed by a computer to perform the steps developed in this invention to result in an optimal waterflood injection, including but not limited to: a magnetically readable storage system; optically readable storage media such as punch cards or printed matter readable by direct methods or methods of optical character recognition; other optical storage media such as a compact disc (CD), a digital versatile disc (DVD), a rewritable CD and/or DVD; electrically readable media such as programmable read only memories (PROMs), electrically erasable programmable read only memories (EEPROMs), field programmable gate arrays (FGPAs), flash random access memory (flash RAM); and remotely transmitted information transmitted by electromagnetic or optical methods.

InSAR: Integrated surveillance and control system: satellite Synthetic Aperture Radar interferometry.

Hydrofracture: induced or naturally occurring fracture of geological formations due to the action of a pressurized fluid.

Water injection: (1) injection of water to fill the pore space after withdrawal of oil and to enhance oil recovery, or alternatively (2) injection of water to force oil through the pore space to move the oil to a producer, thereby enhancing oil recovery.

Well fractures: a hydrofracture in the formation near a well bore created by fluid injection to increase the inflow of recovered oil at producing well or outflow of injected liquid at an injecting well.

Areal sweep: in a map view, the area of reservoir filled (swept) with water during a specific time interval.

Surface displacement: measurable vertical surface motion caused by subsurface fluid flow including oil and water withdrawal, and water or steam injection, during a specific time interval Vertical sweep: the vertical interval of reservoir swept by the injected water during a specific time interval.

Volumetric sweep: the product of areal and vertical sweep, the reservoir volume swept by water during a specific time interval.

Logs: electric, magnetic, nuclear, etc, measurements of subsurface properties with a tool that moves in a well bore.

Cross-well images: images of seismic or electrical properties of the reservoir obtained with a signal propagated inside the reservoir between two or more wells. The signal source can either be at the surface, or one of the wells is the source, and the remaining wells are receivers.

Secondary recovery process: an oil recovery process through injection of fluids that were not initially present in the reservoir formation; usually applied when the primary production slows below an admissible level due to reservoir pressure depletion.

MEMS sensors: micro-electronic mechanical sensors to measure and system parameters related to oil and gas recovery; e.g., MEMS can be used to measure tilt and acceleration with high accuracy.

SQL: Structured Query Language is a standard interactive and programming language for retrieving information from and storing data into a database.

SQL database: a database supporting SQL.

GPS: satellite-based general positioning system allowing for measuring space coordinates with high accuracy.

Fluid: as defined herein may include gas, liquid, emulsions, mixtures, plasmas or any matter capable of movement and injection. Fluid as recited herein does not always have to be the same. There maybe many different types of fluid used and monitored as per the process described herein.

Data set: a set of data as contemplated in the instant invention may comprise one or more single data points from the same source. Any set of data, be it a first set, a second set or a hundredth set of data, may additionally comprise many groups of data acquired from many different sources. A set of data, as contemplated herein, includes both input and output data sets, referring to data acquired solely through measurement, or through mathematical manipulation of other measured data by a predetermined method described herein.

Means for analyzing and manipulating the input and output data as contemplated herein refers to a method of continuously feeding the current and historical input and output data sets through the algorithmic loops as described herein, to evaluate each data parameter against a predetermined desired value, to obtain a new data set, for either resetting the pressure of a fluid or a rate of a fluid. This shall also include means for estimating effective injection hydrofracture area from injection rate and injection pressure data, from well tests and other monitored situations.

Means for controlling injection pressure at each well, comprises a control method for setting the injection pressure of a fluid resulting from the analysis of instantaneous and historical injection pressures, injection rates, and other suitable parameters, along with estimates of effective fracture area.

Means for monitoring injection pressure and rate of a fluid includes any known valve, pressure gage, rate gauge, etc.

Means for integrating, analyzing all the input and output data set(s) to evaluate and continually update the target injection area and the valve activator volume and pressure values according to predetermined set of parameters is accomplished by an algorithm.

Means for setting and monitoring the injection pressure of water include far field sensors, near field sensors, production, injection data, a network of model-based injector controllers, includes software described herein.

A purpose contemplated by the instant invention is preventing and controlling otherwise uncontrollable growth of injection hydrofractures and unrecoverable damage of reservoir rock formations by the excessive or otherwise inappropriate fluid injection.

Nomenclature

| | |
|---|---|
| $A$ = | fracture area, $m^2$ |
| $k$ = | absolute rock permeability, md, 1 md ≈ $9.87 \times 10^{-16}$ $m^2$ |
| $k_{rw}$ = | relative permeability of water |
| $p_i$ = | initial pressure in the formation outside the fracture, Pa |
| $p_{inj}$ = | injection pressure, Pa |
| $p_{inj,1}$ = | injection pressure on the first interval (1), Pa |
| $Y_1$ = | steady state flow coefficient on the first interval (1) |
| $Z_1$ = | transient flow coefficient on the first interval (1) |
| $Y_N$ = | steady state flow coefficient on the $N^{th}$ interval (1) |
| $Z_N$ = | transient flow coefficient on the $N^{th}$ interval (1) |

-continued

| Nomenclature | |
|---|---|
| $q$ = | injection rate, liters/day |
| $Q$ = | cumulative injection, liters |
| $Q_{obs}$ = | observed or measured cumulative injection, liters |
| $v$ = | superficial leak-off velocity, m/day |
| $w$ = | fracture width, m |
| $\alpha_w$ = | hydraulic diffusivity, $m^2$/day |
| $\mu$ = | viscosity, cp |
| $\phi$ = | porosity |
| $\varphi$, $\theta$ = | dimensionless elliptic coordinates |
| $h_t$ = | total thickness of injection interval, m |
| $h_i$ = | thickness of layer i, m |
| $k$ = | absolute rock permeability, md |
| $k_{rw}$ = | relative permeability of water, dimensionless |
| $\bar{k}$ = | average permeability, md |
| $L_i$ = | distance between injector and linked producer in layer i, m |
| $w$ = | fracture width, meters |
| $\alpha$ = | hydraulic diffusivity, $m^2$/day |
| $\varphi$ = | porosity, dimensionless |
| $a_i$, $w_p$, $w_q$ – | dimensionless weight coefficients |
| $\text{subscript}_w$ = | water |
| $\text{subscripts}_{i,j}$ = | layer i and layer j, respectively |

| Metric Conversion Factors | |
|---|---|
| bbl × 1.589 873 | E − 01 = $m^3$ |
| cp × 1.0* | E − 03 = Pa s |
| D × 8.64* | E + 04 = s |
| ft × 3.048* | E − 01 = m |
| $ft^2$ × 9.290 304* | E − 02 = $m^2$ |
| in. × 2.54* | E + 00 = cm |
| md × 9.869 | E − 16 = $m^2$ |
| psi × 6.894 757 | E + 00 = kPa |

*Conversion factor is exact

Analysis of Hydrofracture Growth by Water Injection into a Low-Permeability Rock In this invention, water injection is modeled through a horizontally growing vertical hydrofracture totally penetrating a horizontal, homogeneous, isotropic and low-permeability reservoir initially at constant pressure. More specifically, soft diatomaceous rock with roughly a tenth of milliDarcy permeability is considered. Diatomaceous reservoirs are finely layered, and each major layer is typically homogeneous, see (Patzek and Silin 1998), (Zwahlen and Patzek, 1997a) over a distance of tens of meters.

The design of the injection controller is accomplished by developing a controller model, which is subsequently used to design several optimal controllers.

A process of hydrofracture growth over a large time interval is considered; therefore, it is assumed that at each time the injection pressure is uniform inside the fracture. Modeling is used to relate the present and historical cumulative fluid injection and injection pressure. To obtain the hydrofracture area, however, either independent measurements or on an analysis of present and historical cumulative fluid injection and injection pressure data via inversion of the controller model is used. At this point, the various prior art fracture growth models are not used because they insufficient model arbitrary multilayered reservoir morphologies with complex and unknown physical properties. Instead, the cumulative volume of injected fluid is analyzed to determine the fracture status by juxtaposing the injected liquid volume with the leak-off rate at a given fracture surface area. The inversion of the resulting model provides an effective fracture area, rather than its geometric dimensions. However, it is precisely the parameter needed as an input to the controller. After calibration, the inversion process produces the desired input at no additional cost, save a few moments on a computer.

Organization of the Remainder of the Detailed Description

The remainder of this detailed description is organized into four parts and an Appendix. These parts begin with a model of hydrofracture growth in a single reservoir layer, an initial control model for hydrofracture of a single reservoir layer, an extension of the single layer control model into a reservoir comprised of one or more hydrofracture layers, a control model for water injection into a layered formation, and then injection control in a layered reservoir. Following is a short description of the implementation of the system. Finally, following the rigorous and detailed advanced mathematics used to create this invention is a short appendix detailing the numerical integration of a particular convolution integral used in the invention.

I Hydrofracture Growth

I.1 Hydrofracture Growth—Introduction

In this invention, a self-similar two-dimensional (2D) solution of pressure diffusion from a growing fracture with variable injection pressure is used. The flow of fluid injected into a low-permeability rock is almost perpendicular to the fracture for a time sufficiently long to be of practical interest. We model fluid injection through a horizontally growing vertical hydrofracture totally penetrating a horizontal, homogeneous, isotropic and low-permeability reservoir initially at constant pressure. More specifically, we consider the soft diatomaceous rock with roughly a tenth of milliDarcy permeability. Diatomaceous reservoirs are finely layered and each major layer is usually homogeneous over a distance of tens of meters. We express the cumulative injection through the injection pressure and effective fracture area. Maintaining fluid injection above a reasonable minimal value leads inevitably to fracture growth regardless of the injector design and the injection policy. The average rate of fracture growth can be predicted from early injection.

The long-term goal is to design a field-wide integrated system of waterflood surveillance and control. Such a system consists of software integrated with a network of individual injector controllers. The injection controller model is initially formulated, and subsequently used to design several optimal controllers.

We consider the process of hydrofracture growth on a large time interval; therefore, we assume that at each time the injection pressure is uniform inside the fracture. We use modeling to relate the cumulative fluid injection and the injection pressure. To obtain the hydrofracture area, however, we rely either on independent measurements or on an analysis of injection rate—injection pressure data via inversion of the controller model. We do not yet rely on the various fracture growth models because they are too inadequate to be useful. Instead, we analyze the cumulative volume of injected fluid and determine the fracture status juxtaposing the injected liquid volume with the leak-off rate at a given fracture surface area. The inversion of the model provides an effective fracture area, rather than its geometric dimensions. However, it is exactly the parameter needed as an input to the controller. After calibration, the inversion produces the desired input at no additional cost.

Patzek and Silin (1998) have analyzed 17 waterflood injectors in the Middle Belridge diatomite (CA, USA), 3 steam injectors in the South Belridge diatomite, as well as 44 injectors in a Lost Hills diatomite waterflood. The field data show that the injection hydrofractures grow with time. An injection rate or pressure that is too high may dramatically increase the fracture growth rate and eventually leads to a catastrophic fracture extension and unrecoverable water channeling between an injector and a producer. In order to avoid fatal reservoir damage, smart injection controllers should be deployed, as developed in this invention.

Field demonstrations of hydrofracture propagation and geometry are scarce, Kuo, et al. (1984) proposed a fracture extension mechanism to explain daily wellhead injection pressure behavior observed in the Stomatito Field A fault block in the Talara Area of the Northwest Peru. They have quantified the periodic increases in injection pressure, followed by abrupt decreases, in terms of Carter's theory (Howard and Fast, 1957) of hydrofracture extension. Patzek (1992) described several examples of injector-producer hydrofracture linkage in the South Belridge diatomite, CA, and quantified the discrete extensions of injection hydrofractures using the linear transient flow theory and linear superposition method.

(Wright and A. 1995) and (Wright, Davis et al. 1997) used three remote "listening" wells with multiple cemented geophones to triangulate the microseismic events during the hydrofracturing of a well in a steam drive pilot in Section 29 of the South Belridge diatomite. (Ilderton, Patzek et al. 1996) used the same geophone array to triangulate microseismicity during hydrofracturing of two steam injectors nearby. In addition, they corrected the triangulation for azimuthal heterogeneity of the rock by using conical waves. Multiple fractured intervals, each with very different lengths of hydrofracture wings, as well as an unsymmetrical hydrofracture, have been reported. An up-to-date overview of hydrofracture diagnostics methods has been presented in (Warpinski 1996).

To date, perhaps the most complete images of hydrofracture shape and growth rate in situ have been presented by (Kovscek, Johnston et al. 1996b) and (Kovscek, Johnston et al. 1996a). They have obtained detailed time-lapse images of two injection hydrofractures in the South Belridge diatomite, Section 29, Phase II steam drive pilot. Using a simplified finite element flow simulator, (Kovscek, Johnston et al. 1996b) and (Kovscek, Johnston et al. 1996a) calculated the hydrofracture shapes from the time-lapse temperature logs in 7 observation wells. For calibration, they used the pilot geology, overall steam injection rates and pressures, and the analysis of (Ilderton, Patzek et al. 1996) detailing the azimuth and initial extent of the two hydrofractures.

(Wright and A. 1995) and (Wright, Davis et al. 1997) have used surface and down hole tiltmeters to map the orientation and sizes of vertical and horizontal hydrofractures. They observed fracture reorientation on dozens of staged fracture treatments in several fields, and related it to reservoir compaction caused by insufficient and nonuniform water injection. By improving the tiltmeter sensitivity, (Wright, Davis et al. 1997) have been able to determine fracture azimuths and dips down to 3,000 m. Most importantly, they have used down hole tiltmeters in remote observation wells to determine hydrofracture dimensions, height, width and length. This approach might be used in time-lapse monitoring of hydrofracture growth.

Recently, (Ovens, Larsen et al. 1998) analyzed the growth of water injection hydrofractures in a low-permeability chalk field. Water injection above fracture propagation pressure is used there to improve oil recovery. Ovens et al. have calculated fracture growth with Koning's (Koning 1985), and Ovens-Niko (Ovens, Larsen et al. 1998) 1D models. Their conclusions are similar to those in this Part. Most notably, they report hydrofractures tripling in length in 800 days.

Numerous attempts have been undertaken to model fracture propagation both numerically and analytically. We just note the early fundamental papers (Barenblatt 1959c), (Barenblatt 1959b), (Barenblatt 1959a), (Biot 1956), (Biot 1972), (Zheltov and Khristianovich 1955), and refer the reader to a monograph (Valko and Economides 1995) for further references.

We do not attempt to characterize the geometry of the hydrofracture. In the mass balance equation presented below, the fracture area and the injection pressure and rate are most important. Because the hydrofracture width is much less than its two other dimensions and the characteristic width of the pressure propagation zone, we neglect it when we derive and solve the pressure diffusion equation. At the same time, we assume a constant effective hydrofracture width when we account for the fracture volume in the fluid mass balance.

First, we present a 2D model of pressure diffusion from a growing fracture. We apply the self-similar solution of the transient pressure equation by Gordeyev and Entov (Gordeyev and Entov 1997). This solution is obtained under the assumption of constant injection pressure. Using Duhamel's principle, see e.g. (Tikhonov and Samarskii 1963) we generalize the Gordeyev and Entov solution to admit variable injection pressure, which of course is not self-similar. We use this solution to conclude that the flow of water injected into a low-permeability formation preserves its linear structure for a long time. Moreover, in the diatomite waterfloods, the flow is almost strictly linear because the distance between neighboring wells in a staggered line drive is about 45 m, and this is approximately equal to one half of the fracture length.

Therefore, we restrict our analysis to 1D linear flow, noting that in a higher permeability formation the initially linear flow may transform into a pseudo-radial one at a much earlier stage. In this context, we revisit Carter's theory (Carter 1957), (Howard and Fast, 1957) of fluid injection through a growing hydrofracture. Aside from the mass balance considerations, we incorporate variable injection pressure into our model. In particular, a new simple expression is obtained for the cumulative fluid injection as a function of the variable injection pressure and the hydrofracture area. Fracture growth is expressed in terms of readily available field measurements.

I.2 Hydrofracture Growth—Theory

Pressure diffusion in 2D is analyzed using the self-similar solution by Gordeyev and Entov (1997), obtained under the assumption of constant injection pressure. Since this solution as represented by Eqs. (2.5) and (3.4) in (Gordeyev and Entov 1997) has a typographical error, we briefly overview the derivation and present the correct form (Eq. (14) below). Using Duhamel's principle, we generalize this solution to admit time-dependent injection pressure.

The fluid flow is two-dimensional and it satisfies the well-known pressure diffusion equation (Muskat 1946)

$$\frac{\partial p(t, x, y)}{\partial t} = \alpha_w \nabla^2 p(t, x, y), \tag{1}$$

where p(t,x,y) is the pressure at point (x,y) of the reservoir at time t, $\alpha_w$ is the overall hydraulic diffusivity, and $\nabla^2$ is the Laplace operator. The coefficient $\alpha_w$ combines both the formation and fluid properties, (Zwahlen and Patzek 1997).

In Eq. (1) we have neglected the capillary pressure. As first implied by Rapoport and Leas (Rapoport and Leas, 1953), the following inequality determines when capillary pressure effects are important in a waterflood $$N_{RL} \equiv \sqrt{\frac{\phi}{k}}\,\frac{\mu u L}{k_{rw}\varphi\gamma_{ow}\cos\theta} < 3 \tag{2}$$

where u is the superficial velocity of water injection, and L is the macroscopic length of the system. In the low-permeability, porous diatomite, $k \approx 10^{-16}$ m$^2$, $\phi=0.50$, $u \approx 10^{-7}$ m/s, $L \approx 10$ m, $k_{rw} \approx 0.1$, $\gamma_{ow} \cos\theta \approx 10^{-3}$ N/m, and $\mu \approx 0.5\times10^{-3}$ Pa-s. Hence the Rapoport-Leas number (Rapoport and Leas, 1953) for a typical waterflood in the diatomite is of the order of 100, a value that is much larger than the criterion given in Eq. (2). Thus capillary pressure effects are not important for water injection at a field scale. Of course, capillary pressure dominates at the pore scale, determines the residual oil saturation to water, and the ultimate oil recovery. This, however, is a completely different story, see (Patzek, 2000).

To impose the boundary conditions, consider a pressure diffusion process caused by water injection from a vertical rectangular hydrofracture totally penetrating a homogeneous, isotropic reservoir filled with a slightly compressible fluid of similar mobility. Assume that the fracture height does not grow with time. The fracture width is negligible in comparison with the other fracture dimensions and the characteristic length of pressure propagation, therefore we put it equal to zero.

Denote by L(t) the half-length of the fracture. Place the injector well on the axis of the fracture and require the fracture to grow symmetrically with respect to its axis. Then, it is convenient to put the origin of the coordinate system at the center of the fracture, as indicated in FIG. 1.

The pressure inside the fracture is maintained by water injection, and it may depend on time. Denote the pressure in the fracture by $p_0(t,y)$, $-L(t) \leqq y \leqq L(t)$. Then the boundary-value problem can be formulated as follows: find a function p(t,x,y), which satisfies the differential equation (1) for all (t,x,y), $t \geqq 0$, and (x,y) outside the line segment $\{-L(t) \leqq y \leqq L(t), x=0\}$, such that the following initial and boundary conditions are satisfied:

$$p(0, x,y)=0, \tag{3}$$

$$p(t,0,y)|_{-L(t)\leqq y\leqq L(t)}=p_0(t,y) \tag{4}$$

and $$p(t,x,y)\approx 0 \text{ for sufficiently large } r=\sqrt{x^2+y^2}. \tag{5}$$

The conditions of equations (3) and (5) mean that pressure is measured with respect to the initial reservoir pressure at the depth of the fracture. In the examples below, the low reservoir permeability implies that pressure remains at the initial level at distances of 30–60 m from the injection hydrofracture for 5–50 years.

To derive the general solution for pressure diffusion from a growing fracture, we rescale Eq. (1) using the fracture half-length as the variable length scale:

$$x=L(t)\xi, y=L(t)\eta. \tag{6}$$

and $\tau=t$. In the new variables, equation (1) takes on the form $$L^2(\tau)\frac{\partial p(\tau,\xi,\eta)}{\partial\tau} = \alpha_w\nabla^2 p(\tau,\xi,\eta) + L(\tau)L'(\tau)\left(\xi\frac{\partial p(\tau,\xi,\eta)}{\partial\xi} + \eta\frac{\partial p(\tau,\xi,\eta)}{\partial\eta}\right) \tag{7}$$

Boundary condition (4) transforms into $$p(\tau,\xi,\eta)|_{-1\leqq\xi\leqq1}=p_0(\tau,\epsilon L(\tau)) \tag{8}$$

Initial condition (3) and boundary condition (5) transform straightforwardly.

In elliptic coordinates $$\epsilon=\cos h\phi\,\cos\theta, \eta=\sin h\phi\,\sin\theta \tag{9}$$

Eq. (7) and boundary conditions (8), (5), respectively, transform into $$4DL^2(\tau)\frac{\partial p(\tau,\varphi,\theta)}{\partial\tau} = 4\alpha_w\nabla^2 p(\tau,\varphi,\theta) + \frac{d}{d\tau}(L(\tau)^2)\left(\sin h2\varphi\frac{\partial p(\tau,\varphi,\theta)}{\partial\varphi} - \sin 2\theta\frac{\partial p(\tau,\varphi,\theta)}{\partial\theta}\right) \text{ and} \tag{10}$$

$$p(\tau, 0, \theta) = p_0(\tau, L(\tau)\cos\theta), \tag{11}$$

$$\lim_{\varphi\to\infty} p(\tau,\varphi,\theta) = 0 \tag{12}$$

Because the problem is symmetric, we can restrict our considerations to the domain $\{x \geqq 0, y \geqq 0\}$. The symmetry requires that there be no flow through the coordinate axes, that it imposes two additional Neumann boundary conditions:

$$\left.\frac{\partial p(t,\xi,\eta)}{\partial\xi}\right|_{\substack{\xi=0\\ \eta\geq0}} = \left.\frac{\partial p(t,\xi,\eta)}{\partial\eta}\right|_{\substack{\xi>1\\ \eta=0}} = 0 \tag{13}$$

For constant injection pressure, $p_0(\tau,\theta)=p_0$=const, and the square-root of time fracture growth, $L(t)=\sqrt{at}$, a self-similar solution can be obtained:

$$p(\tau,\varphi,\theta) = p_0\left(1 - U_0\int_0^{\varphi}\exp\left(\frac{-a\cosh(2v)}{8\alpha_w}\right)dv\right), \tag{14}$$

where $$U_0 = \frac{2}{K_0\left(\frac{k_\tau}{2}\right)}, k_\tau = \frac{a}{4\alpha_w}$$

where and $K_0(\cdot)$ is the modified Bessel function of the second kind (Carslaw and Jaeger, 1959, Tikhonov and Samarskii, 1963). Note that Equations (2.5) and (3.4) in (Gordeyev and Entov, 1997) have one extra division by cosh (2v). This typo is corrected in Eq. (14).

To obtain the solution with the time-dependent injection pressure, we need to express solution (14) in the original Cartesian coordinates. From (9)

$$\varphi(t, x, y) = \operatorname{arccosh}\left(\sqrt{\frac{at + x^2 + y^2 + \sqrt{(at + x^2 + y^2)^2 - 4aty^2}}{2at}}\right) \tag{15}$$

The solution (14) can be extended to the case of time-dependent injection pressure by using Duhamel's principle (Tikhonov and Samarskii, 1963). For this purpose put $$U(t, x, y) = 1 - U_0 \int_0^{\varphi(t,x,y)} \exp\left(\frac{-a\cosh(2v)}{8\alpha_w}\right) dv \tag{16}$$

Then for the boundary condition (4), with $p_0(t,y)=p_0(t)$, one obtains $$p(t, x, y) = \int_0^t \frac{\partial U(t-\tau, x, y)}{\partial t} p_0(\tau)\, d\tau \tag{17}$$

The assumption of square-root growth rate $L(t)=\sqrt{at}$ reasonably models that fact that the growth has to slow down as the fracture increases. At the same time, it leads to a simple exact solution given in Eq. (17). The fourth-root growth rate obtained in (Gordeyev and Zazovsky, 1992) behaves similarly at larger t, therefore, the square-root rate represents a qualitatively reasonable approximation. This growth rate model was used for the leakoff flow analysis in (Valko and Economides, 1995).

I.3 Hydrofracture Growth Examples

Figure 2A:
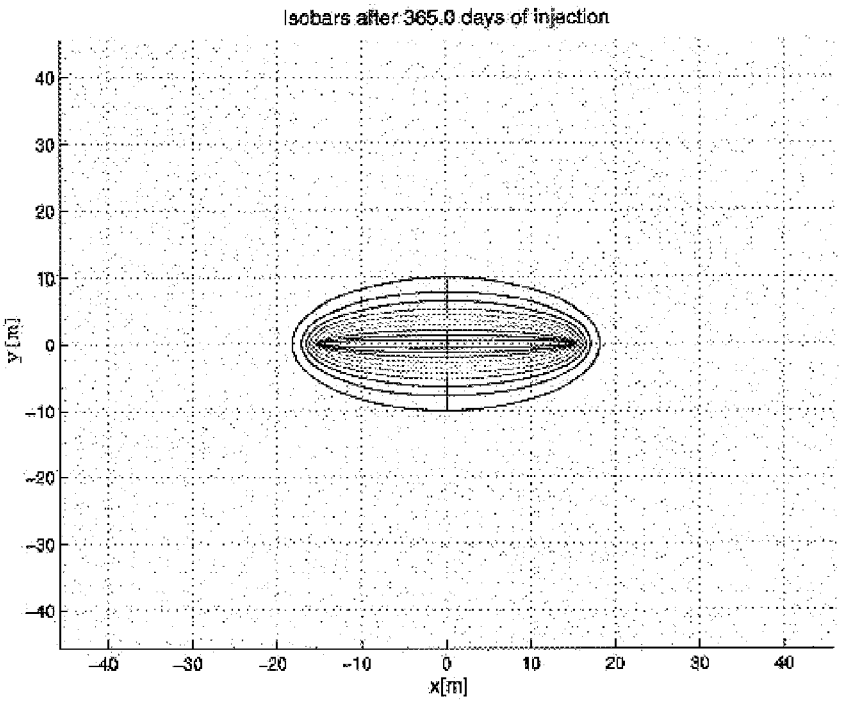
FIG. 2 Relative pressure distribution surrounding a fracture after 1 year of injection.
Figure 2B:
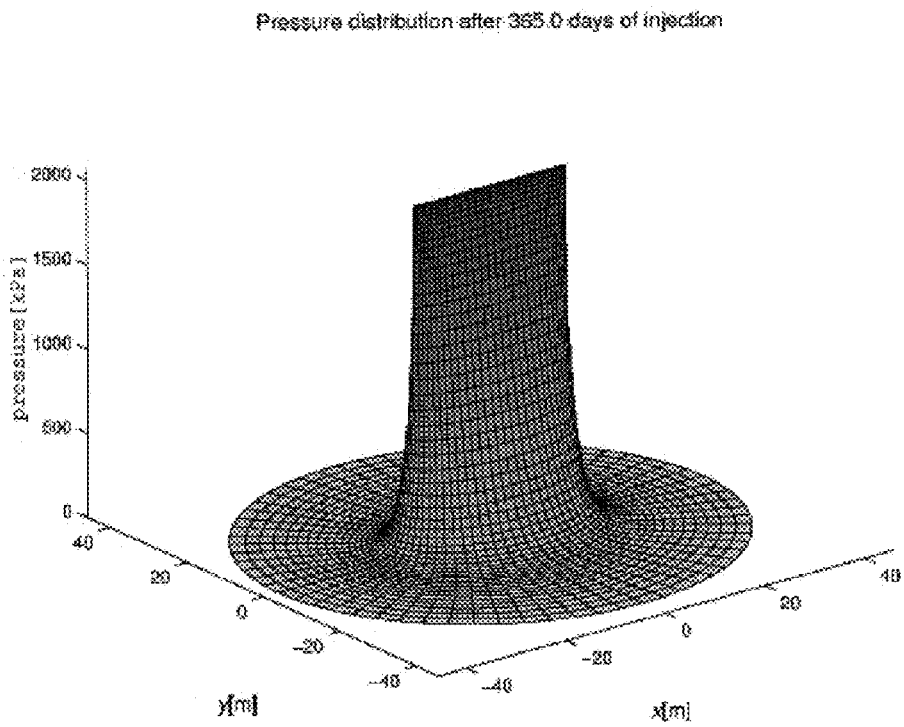
Figure 3A:
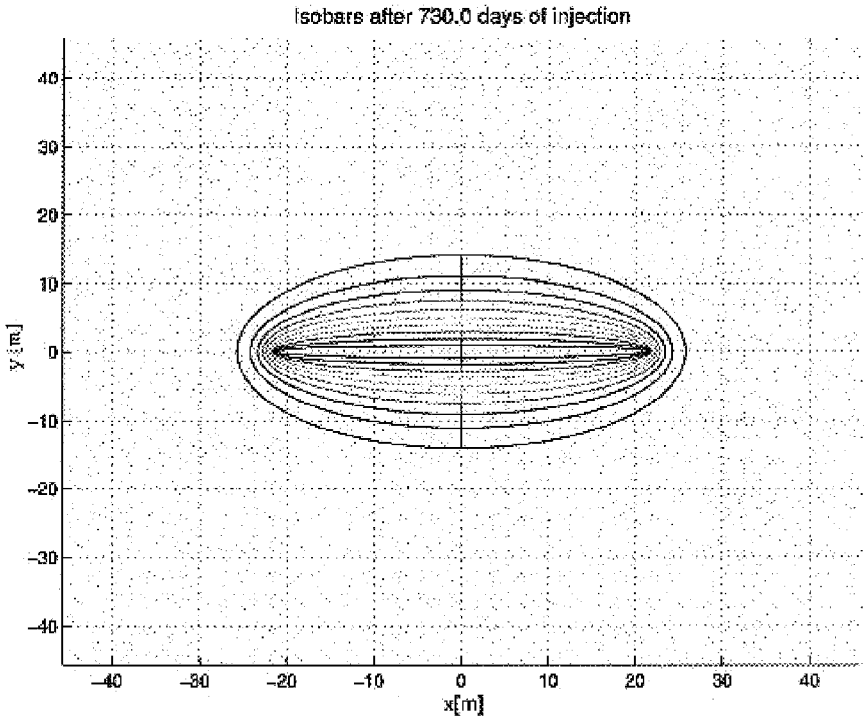
FIG. 3 Relative pressure distribution surrounding the fracture after 2 years of injection.
Figure 3B:
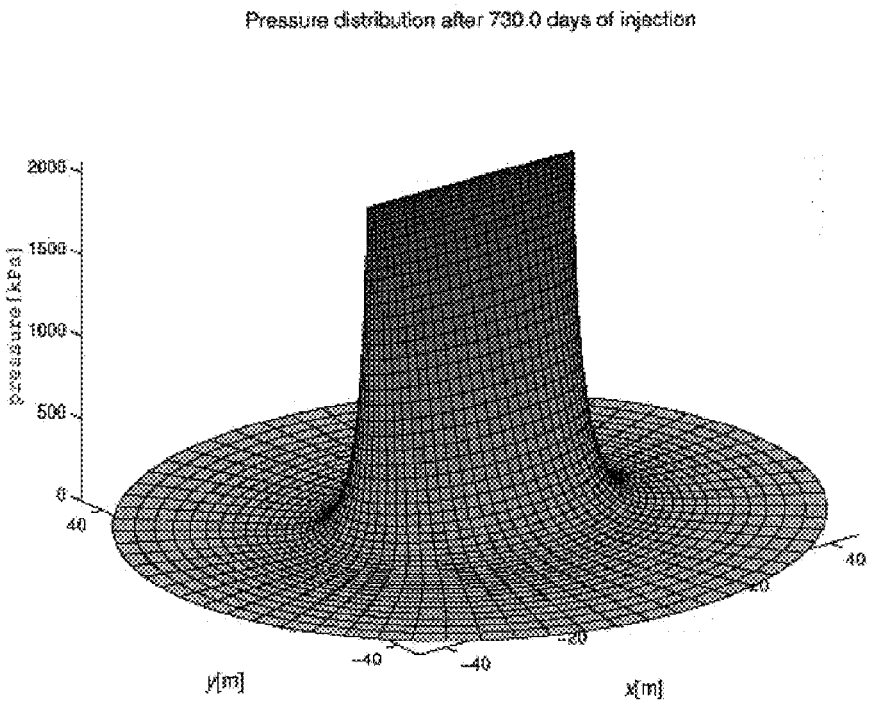
Figure 4A:
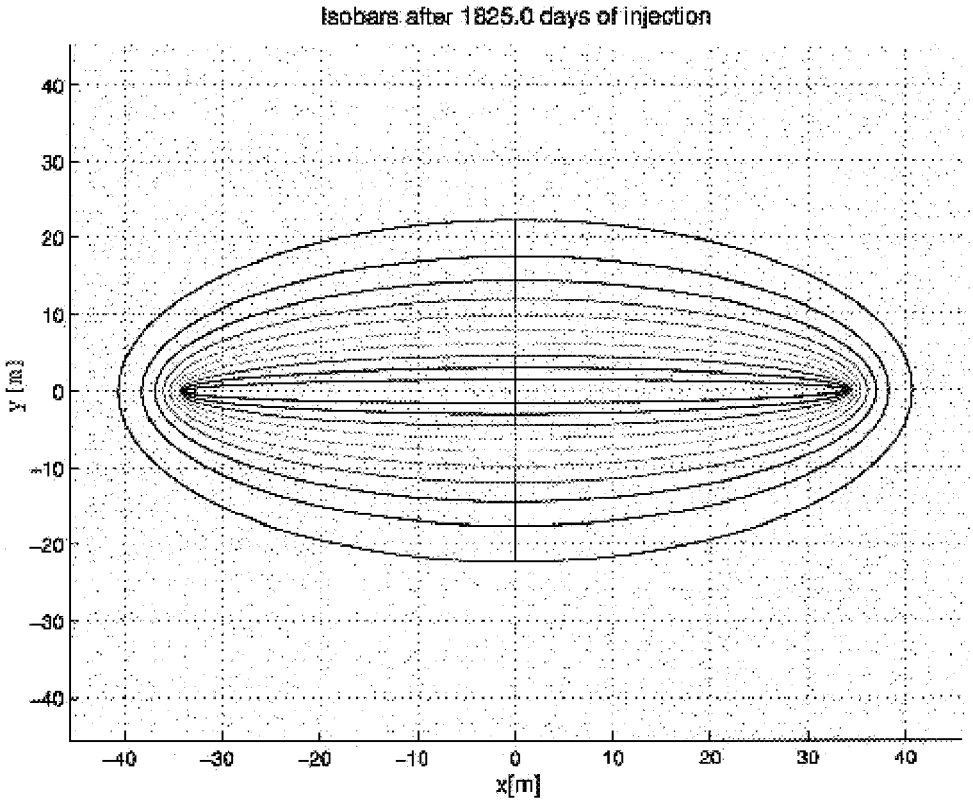
FIG. 4 Relative pressure distribution surrounding the fracture after 5 years of injection.
Figure 4B:
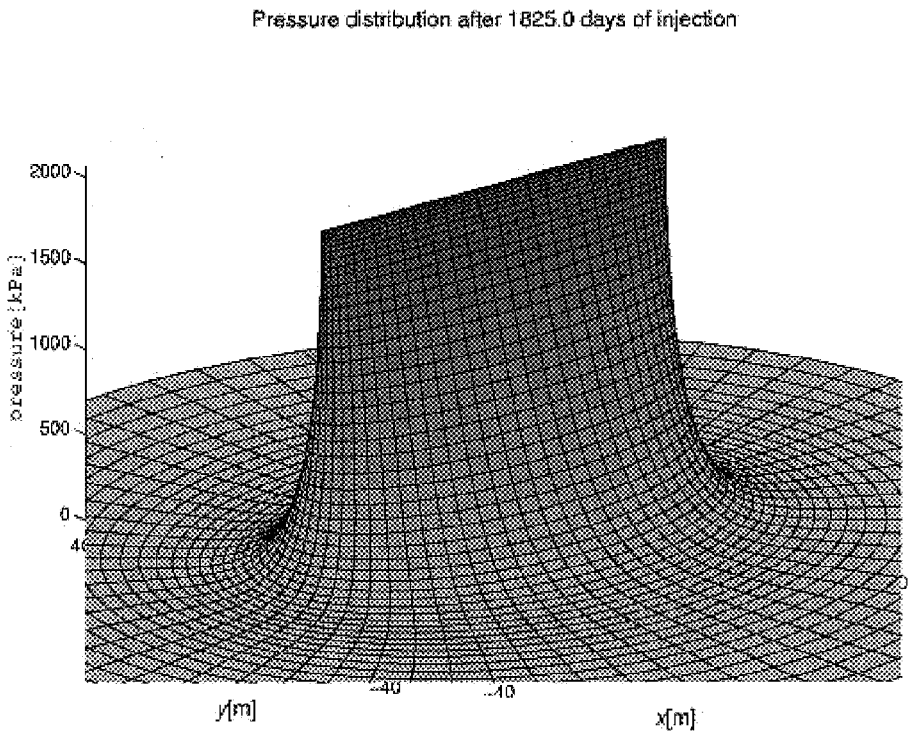
Figure 5A:
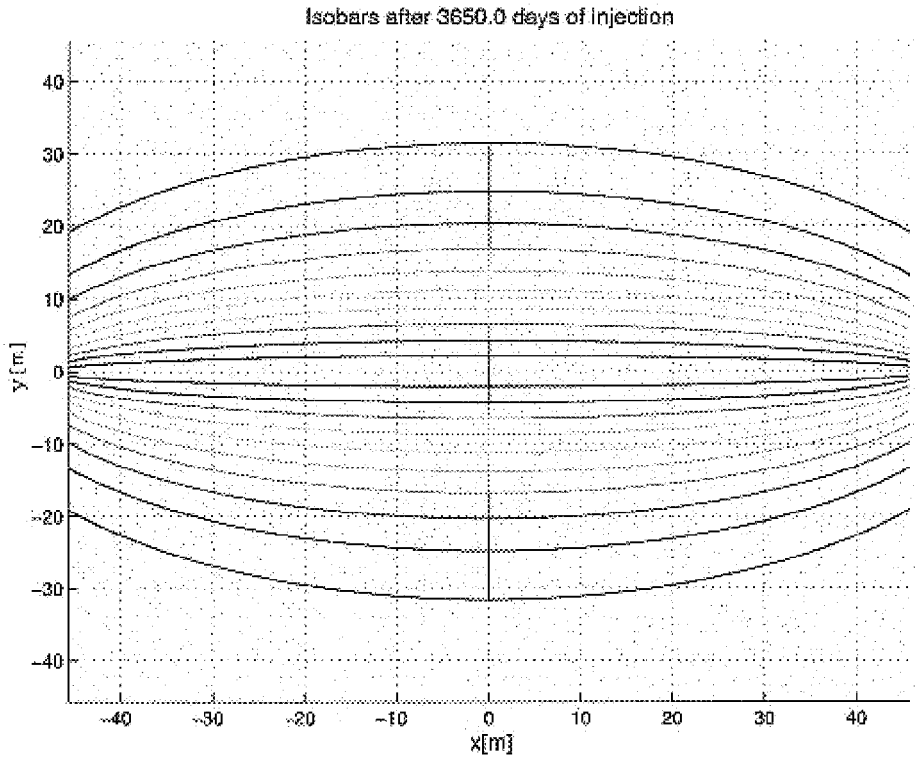
FIG. 5 Relative pressure distribution surrounding the fracture after 10 years of injection demonstrating the change of scale in the isobar contour plot when compared with FIG. 4.
Figure 5B:
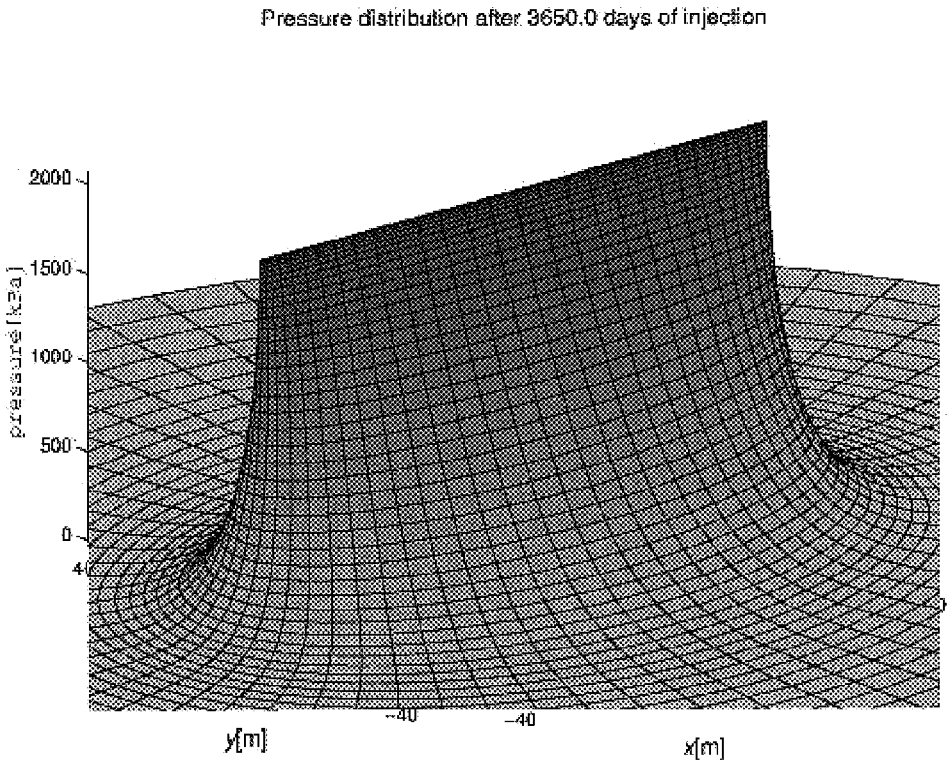

Here we present the results of several simulations of pressure diffusion in the layer G at South Belridge diatomite, see Table 1 and (Zwahlen and Patzek, 1997a). In the simulations, we have assumed that the pressure in the hydrofracture is hydrostatic and is maintained at $2.07\times10^4$ Pa (≈300 psi) above the initial formation pressure in layer G. The fracture continues to grow as the square root of time, and it grows up to 30 m tip-to-tip during the first year of injection. FIG. 2–FIG. 4 show the calculated pressure distributions after 1, 2, 5 and 10 years of injection in layer G. For permeability and diffusivity we use more convenient units milliDarcy [md] (1 md≈$9.869\times10^{-16}$ $m^2$) and $m^2$/Day (86400 $m^2$/Day=1 $m^2$/s).

TABLE 1

South Belridge, Section 33, properties of diatomite layers.

| Layer | Thickness [m] | Depth [m] | Porosity | Permeability [md] | Diffusivity [$m^2$/Day] |
|---|---|---|---|---|---|
| G | 62.8 | 223.4 | 0.57 | 0.15 | 0.0532 |
| H | 36.6 | 273.1 | 0.57 | 0.15 | 0.0125 |
| I | 48.8 | 315.2 | 0.54 | 0.12 | 0.0039 |
| J | 48.8 | 364.5 | 0.56 | 0.14 | 0.0395 |
| K | 12.8 | 395.3 | 0.57 | 0.16 | 0.0854 |
| L | 49.4 | 426.4 | 0.54 | 0.24 | 0.0396 |
| M | 42.7 | 472.4 | 0.51 | 0.85 | 0.0242 |

Note that even after 10 years of injection, the high-pressure region does not extend beyond 30 m from the fracture. The flow direction is orthogonal to the isobars. The oblong shapes of the isobars demonstrate that the flow is close to linear and it is almost perpendicular to the fracture even after a long time.

Figure 6A:
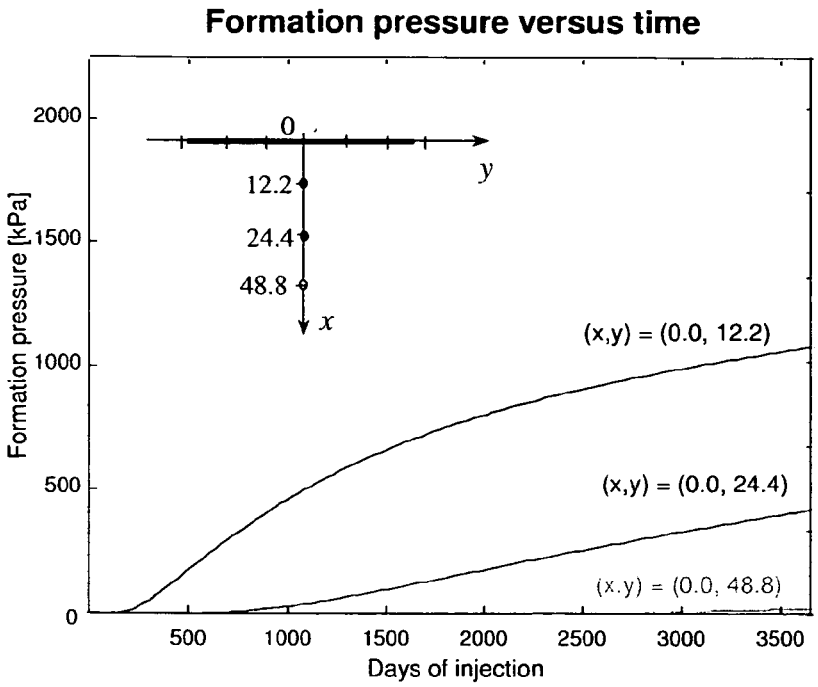
FIG. 6 Pressure histories at three fixed points, 12, 24 and 49 m away from the fracture, looking down on fracture center (left) and fracture wing 30 m along the fracture (right).
Figure 6B:
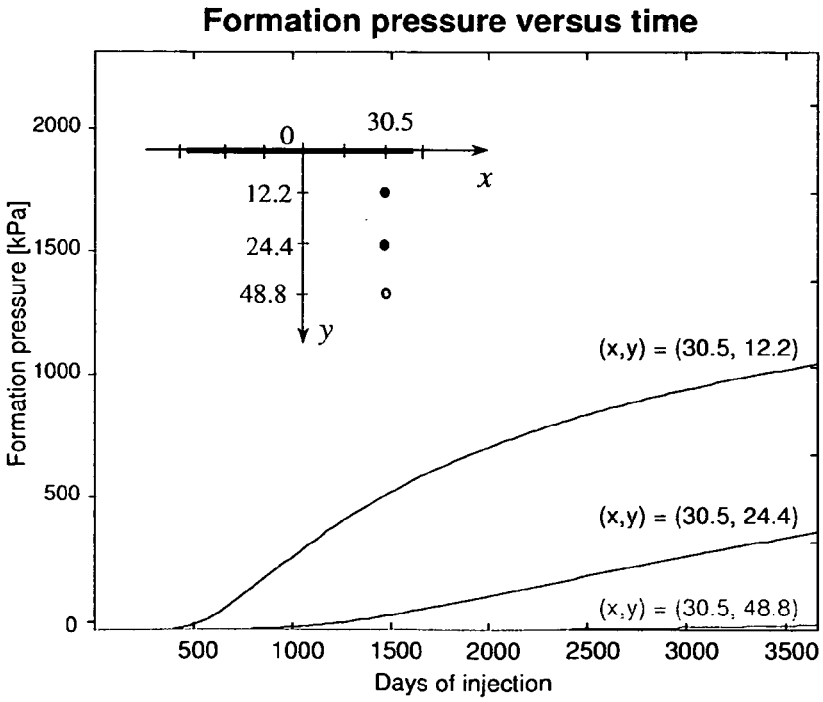

FIG. 6 shows how the formation pressure builds up during 10 years of injection in the plane intersecting the fracture center (left) and intersecting its wing 30 m along the fracture (right). Comparison of the two plots in FIG. 6 demonstrates that the injected water flow is remarkably parallel.

Figure 7A:
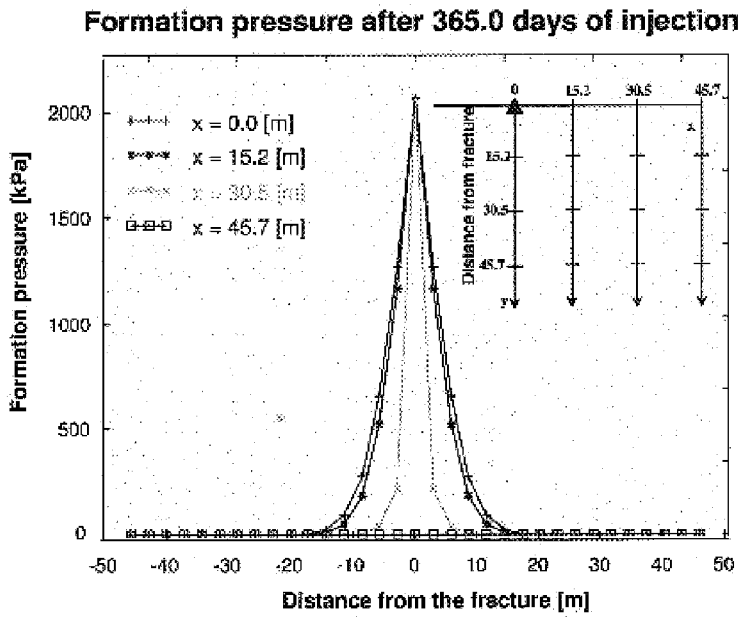
FIG. 7 Pressure distributions along four cross-sections orthogonal to the fracture after 1 and 2 years of injection.
Figure 7B:
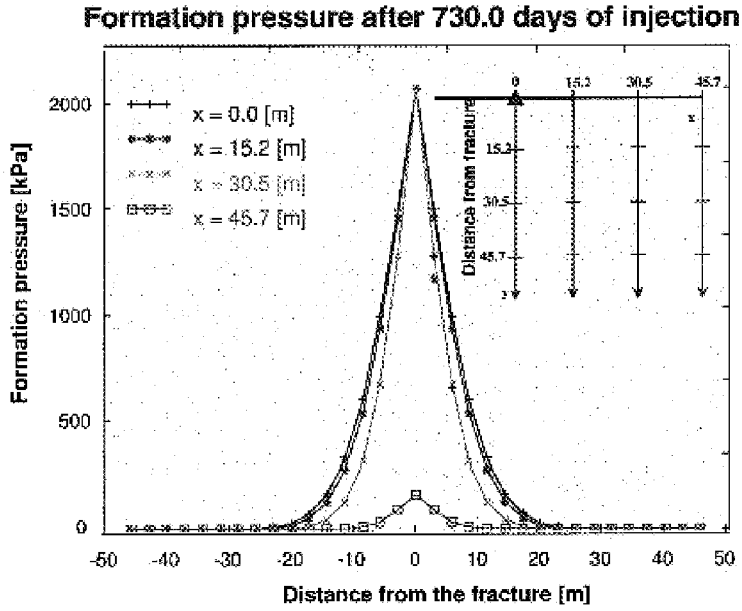
Figure 8A:
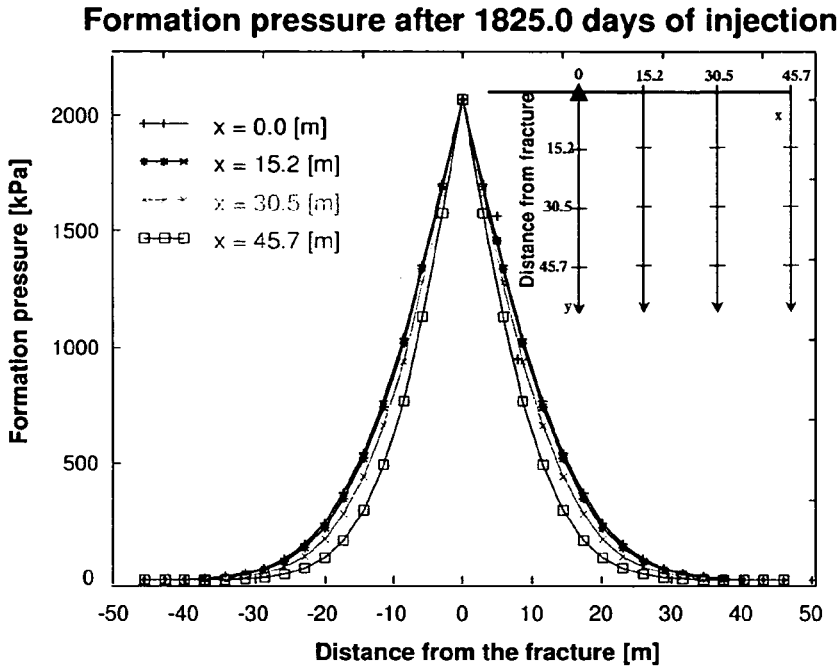
FIG. 8 Pressure distributions in the same cross-sections after 5 and 10 years of injection.
Figure 8B:
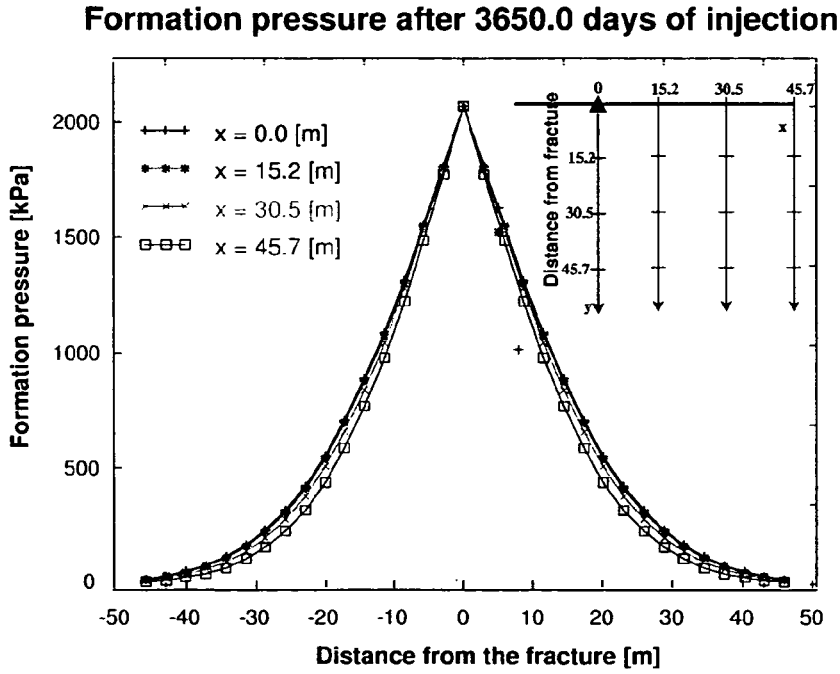

Another illustration is provided by FIGS. 7 and 8, where the formation pressure is plotted versus the distance from the fracture at 0, 15, 30 and 46 m away from the center. The pressure distribution is very close to parallel soon after the fracture length reaches the respective distance. For instance, in FIG. 7 the pressure distribution at the cross-section 45 m away from the center is different because the fracture is not yet long enough. After 5 years, the pressure distribution becomes almost parallel at all distances from the center.

Figure 9A:
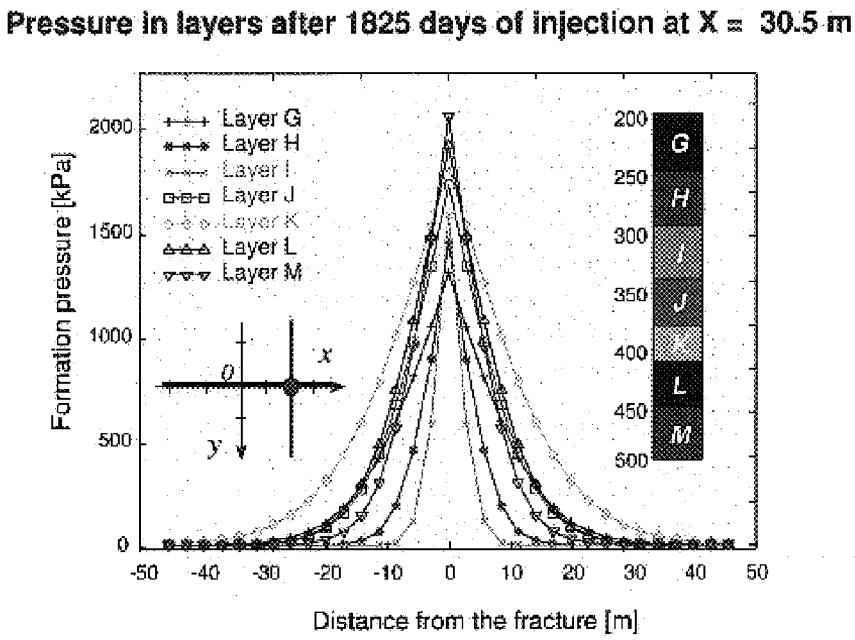
FIG. 9 Pressure distributions in diatomite layers after 5 years of injection showing cross-sections at 0 and 30.5 m from the center of the fracture.
Figure 9B:
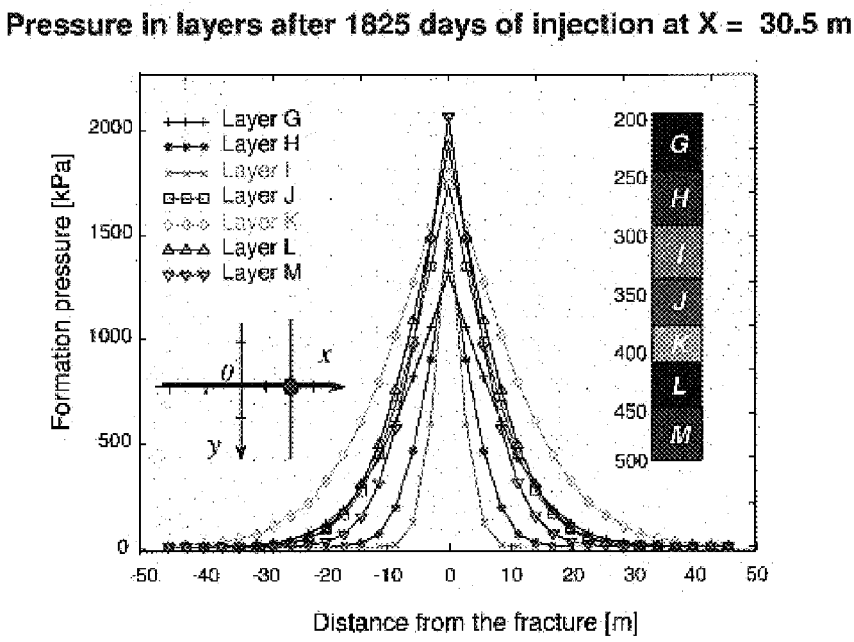

As we remarked earlier, diatomaceous reservoirs are layered and the layers are non-communicating. The linearity of flow is observed in the different layers, FIG. 9. Computations show that in each layer the pressure distribution after 5 years of injection is almost the same looking down on the center of the fracture and on its wing 30 m away from the center. Therefore, the injected water flow is essentially linear. This observation allows us to cast our water injection model as one-dimensional. In the following section, we incorporate the variable injection pressure into Carter's model and obtain an elegant equation expressing the cumulative fluid injection through the injection pressure and the fracture size.

I.4 Carter's Model Revisited

Here, we proceed to formulate a one-dimensional model of isothermal fluid injection from a vertical highly conductive fracture that fully penetrates a low-permeability reservoir. We neglect the compressibility of the injected fluid and assume that the flow is horizontal, transient, and perpendicular to the fracture plane. It is important that the hydrofracture may grow during the injection. We denote by A(t) and dA(t)/dt the fracture area and the rate of fracture growth at time t, respectively. We start counting time right after completion of the fracturing job, so A(0) is not necessary equal to zero. We denote by q(t) and $p_{inj}(t)$ the injection rate and the average down hole injection pressure, respectively. We assume that the fluid pressure is essentially the same throughout the fracture at each time.

Let us fix a current time t and pick an arbitrary time $\tau$ between 0 and t. As the fracture is growing, different parts of it become active at different times. We define $u_\tau(t)$ as the fluid superficial leak-off velocity at time t across that portion of the fracture, which opened between $\tau$ and $\tau+\Delta\tau$, where $\Delta\tau$ is a small increment of time. The area of the part of the fracture, which has been created in the time interval $[\tau, \tau+\Delta\tau]$, is equal to $A(\tau+\Delta\tau)-A(\tau)$. Hence, the rate of fluid leak-off through this area is equal to $\Delta q_\tau(t)\approx 2u_\tau(t)(A(\tau+\Delta\tau)-A(\tau))$. The coefficient of 2 is implied by the assumption that the fracture is two-sided and the fluid leaks symmetrically into the formation. The rate of leak-off from the originally open fracture area is $q_0(t)=2u_0(t)A(0)$. Let us split the time interval [0,t] by a partition $\{0=\tau_0<\tau_1<\ldots<\tau_K=t\}$ into small contiguous non-overlapping subintervals $[\tau_k, \tau_k+\Delta\tau_k]$, $\Delta\tau_k=\tau_{k+1}-\tau_k$, and apply the above calculations to each subinterval. Summing up over all intervals $[\tau_k, \tau_k+\Delta\tau_k]$ and adding the rate of water accumulation inside the fracture V(t)/dt, one gets:

$$q(t) \approx 2u_0(t)A(0) + 2u_{\tau_0}(t)(A(\tau_0 + \Delta\tau_0) - A(\tau_0)) + 2u_{\tau_1}(t)(A(\tau_1 + \Delta\tau_1) - A(\tau_1)) + \ldots + 2u_{\tau_{K-1}}(t)(A(\tau_{K-1} + \Delta\tau_{K-1}) - A(\tau_{K-1})) + \frac{dV}{dt}. \quad (18)$$

Here V(t) is the volume of the fracture at time t. It is convenient for further calculations to introduce an effective or average fracture width $$w\colon\ w = \frac{V(t)}{A(t)}.$$

We assume that w is constant. Passing to the limit as $$\max_k(\Delta\tau_k) \to 0,$$

we obtain $$q(t) = 2u_0(t)A(0) + 2\int_0^t u_\tau(t)\frac{dA(\tau)}{d\tau}\,d\tau + w\frac{dA(t)}{dt} \quad (19)$$

Eq. (19) extends the original Carter's model (Howard and Fast, 1957) of fracture growth by accounting for the initial fracture area A(0) and admitting a general dependence of the leak-off velocity on t and $\tau$ (in original Crater's model $u_\tau(t)=u(t-\tau)$).

In order to incorporate the variable injection pressure into Eq. (19), we need to find out how $u_\tau(t)$ depends on $p_{inj}(t)$. From Darcy's law $$u_\tau(t) = -\frac{kk_{rw}}{\mu}\frac{\partial p_\tau(0,t)}{\partial x} \quad (20)$$

Here k and $k_{rw}$ are the absolute rock permeability and the relative water permeability in the formation outside the fracture, and $\mu$is the water viscosity, $$\frac{\partial p_\tau(0,t)}{\partial x}$$

is the pressure gradient on the fracture face along the part of the fracture that opened at time $\tau$, and $p_\tau(x,t)$ is the solution to the following boundary-value problem:

$$\frac{\partial p_\tau}{\partial t} = \alpha_w\frac{\partial^2 p_\tau}{\partial x^2},\quad t \ge \tau,\quad x \ge 0, \quad (21)$$

$$p_\tau(x,\tau) = \begin{cases} p_{inj}(\tau), & x = 0, \\ p_i, & x > 0, \end{cases} \qquad p_\tau(0,t) = p_{inj}(t)$$

Here $\alpha_w$ and $p_i$ denote, respectively, the hydraulic diffusivity and the initial formation pressure. The solution to the boundary-value problem (21) characterizes the distribution of pressure outside the fracture caused by fluid injection. Hence, $p_\tau(x,t)$ is the pressure at time t at a point located at distance x from a portion of the fracture that opened at time $\tau$. Solving the boundary value problem (21), we obtain $$\left.\frac{\partial p_\tau(x,t)}{\partial x}\right|_{x=+0} = -\left(\frac{1}{\sqrt{\pi\alpha_w(t-\tau)}}[p_{inj}(\tau) - p_i] + \frac{1}{\sqrt{\pi\alpha_w}}\int_\tau^t \frac{p'_{inj}(\xi)}{\sqrt{t-\xi}}\,d\xi\right), \quad (22)$$

where the prime denotes derivative. Substitution into (20) yields $$u_\tau(t) = \frac{kk_r}{\mu}\left(\frac{1}{\sqrt{\pi\alpha_w}(t-\tau)}[p_{inj}(\tau) - p_i] + \frac{1}{\sqrt{\pi\alpha_w}}\int_\tau^t \frac{p'_{inj}(\xi)}{\sqrt{t-\xi}}\,d\xi\right) \quad (23)$$

Combining Eqs. (23) and (19), we obtain $$q(t) = w\frac{dA(t)}{dt} + 2\frac{kk_{rw}}{\mu\sqrt{\pi\alpha_w}}(p_{inj}(0) - p_i)\left(\frac{A(0)}{\sqrt{t}} + \int_0^t \frac{1}{\sqrt{t-\xi}}\frac{dA(\xi)}{d\xi}\,d\xi\right) + 2\frac{kk_{rw}}{\mu\sqrt{\pi\alpha_w}}\int_0^t p'_{inj}(\tau)\left(\frac{A(\tau)}{\sqrt{t-\tau}} + \int_\tau^t \frac{1}{\sqrt{t-\xi}}\frac{dA(\xi)}{d\xi}\,d\xi\right)d\tau \quad (24)$$

Further calculations imply that Eq. (24) can be recast into the following equivalent form:

$$Q(t) = wA(t) + 2\frac{kk_{rw}}{\mu\sqrt{\pi\alpha_w}}\int_0^t \frac{(p_{inj}(\tau) - p_i)A(\tau)}{\sqrt{t-\tau}}\,d\tau, \quad (25)$$

where $$Q(t) = \int_0^t q(\tau)\,d\tau$$

is the cumulative injection at time t.

Eq. (24) states the following. Current injection rate cannot be determined solely from the current fracture area and the current injection pressure; instead, it depends on the entire history of injection. The convolution with $1/\sqrt{t-\tau}$ implies that recent history is the most important factor affecting the current injection rate. The last conclusion is natural. Since the fracture extends into the formation at the initial pressure, the pressure gradient is greater on the recently opened portions of the fracture.

Our model allows us to calculate analytically the pressure gradient (22) and the leak-off velocity at the boundary. Therefore, we avoid errors from numerical differentiation of the pressure distribution at the fracture face where the gradient takes on its largest value.

I.5 Hydrofracture Growth—Discussion

Eq. (25) encompasses the following special cases:

Case (1) If there is no fracture growth and injection pressure is constant, i.e., $A(t)\equiv A_0$ and $p_{inj}(t)\equiv p_{inj}$, then $$Q(t) = wA_0 + 4A_0\frac{kk_{rw}}{\mu\sqrt{\pi\alpha_w}}(p_{inj} - p_i)\sqrt{t} \tag{26}$$

and injection rate must decrease inversely proportionally to the square root of time:

$$q(t) = 2\frac{kk_{rw}}{\mu\sqrt{\pi\alpha_w}}(p_{inj} - p_i)\frac{A_0}{\sqrt{t}} \tag{27}$$

The leak-off velocity is $$u(t) = \frac{q(t)}{2A_0} = \frac{kk_{rw}}{\mu}\frac{(p_{inj} - p_i)}{\sqrt{\pi\alpha_w t}} = \frac{C}{\sqrt{t}}, \quad \text{where } C = \frac{kk_{rw}}{\mu}\frac{(p_{inj} - p_i)}{\sqrt{\pi\alpha_w}} \tag{28}$$

The coefficient C is often called leakoff coefficient, see e.g. (Kuo, et al., 1984). The cumulative fluid injection can be expressed through C:

$$Q(t) = wA_0 + 4A_0\frac{kk_{rw}}{\mu}\frac{(p_{inj} - p_i)}{\sqrt{\pi\alpha_w}}\sqrt{t} = wA_0 + 4A_0C\sqrt{t} = wA_0 + (\text{Early Injection slope})\sqrt{t}, \tag{29}$$

where the "Early Injection Slope" characterizes fluid injection prior to fracture growth and prior to changes in injection pressure.

Equation (27) provides another proof of inevitability of fracture growth. The only way to prevent it at constant injection pressure is to decrease the injection rate according to $1/\sqrt{t}$. This strategy did not work in the field (Patzek, 1992).

Case (2) If there is no fracture growth, but injection pressure depends on time, then the cumulative injection is $$Q(t) = wA_0 + 2A_0\frac{kk_{rw}}{\mu\sqrt{\pi\alpha_w}}\int_0^t \frac{(p_{inj}(\tau) - p_i)}{\sqrt{t-\tau}}\,d\tau \tag{30}$$

If injection pressure is bounded, $p_{inj}(t)\leqq P_0$, then $$Q(t) \le wA_0 + 2A_0\frac{kk_{rw}}{\mu\sqrt{\pi\alpha_w}}(P_0 - p_i)\sqrt{t} \tag{31}$$

Consequently, injection rate cannot satisfy $q(t)\geqq q_0>0$ for all t, because otherwise one would have $Q(t)\geqq wA_0+q_0t$, that contradicts Eq. (31) for $$t > 4\frac{A_0^2(P_0 - p_i)^2}{q_0^2}\frac{k^2k_{rw}^2}{\mu^2\pi\alpha_w} \tag{32}$$

The expression on right-hand side of Eq. (32) estimates the longest elapsed time of fluid injection at a rate greater than or equal to $q_0$, without fracture extension and without exceeding the maximum injection pressure. For the South Belridge diatomite (Patzek, 1992, Zwahlen and Patzek, 1997b), Eq. (32) implies that this time is 100–400 days for $q_0$=7950 l/Day per fracture at a depth of 305 m. Maintaining high injection rate requires an increase of the down whole pressure that makes fracture growth inevitable, regardless of the design of injection wells and injection policy.

Case (3) At constant injection pressure, both the cumulative injection and the injection rate are completely determined by the fracture growth rate:

$$Q(t) = wA(t) + 2\frac{kk_{rw}}{\mu\sqrt{\pi\alpha_w}}(p_{inj} - p_i)\int_0^t \frac{A(\tau)}{\sqrt{t-\tau}}\,d\tau, \tag{33}$$

$$q(t) = w\frac{dA(t)}{dt} + 2\frac{kk_{rw}}{\mu\sqrt{\pi\alpha_w}}(p_{inj} - p_i)\left(\frac{A(0)}{\sqrt{t}} + \int_0^t \frac{1}{\sqrt{t-\xi}}\frac{dA(\xi)}{d\xi}d\xi\right) \tag{34}$$

This means that if the fracture stops growing at a certain moment, the injection rate must decrease inversely proportionally to the square root of time. Perhaps the most favorable situation would be obtained if the fracture grew slowly and continuously and supported the desired injection rate at a constant pressure. However, since the fracture growth is beyond our control, such an ideal situation is hardly attainable.

Case (4) If the cumulative injection and injection rate are, respectively, equal to $$Q(t) = wA_0 + 4\frac{kk_{rw}}{\mu\sqrt{\pi\alpha_w}}(p_{inj} - p_i)A_0\sqrt{t} + q_0t \tag{35}$$

$$q(t) = 2\frac{kk_{rw}}{\mu\sqrt{\pi\alpha_w}\sqrt{t}}(p_{inj} - p_i)A_0 + q_0, \tag{36}$$

then the solution to Eq. (34) with respect to A(t) is provided by $$A(t) = A_0 + \frac{q_0w}{4\pi C^2}\left[e^{\tau_D}\operatorname{erfc}\left(\sqrt{\tau_D}\right) + \frac{2}{\sqrt{\pi}}\sqrt{\tau_D} - 1\right], \tag{37}$$

where $$\tau_D = \frac{4\pi C^2}{w^2} t + \frac{\pi}{4}\left(\frac{\text{Early Injection Slope}}{\text{Initial Fracture Volume}}\right)^2 t \tag{38}$$

is the dimensionless drainage time of the initial fracture, and $wA_0$ is the "spurt loss" from the instantaneous creation of fracture at t=0 and filling it with fluid. Formula (36) for the injection rate consists of two parts: the first component is the leak-off rate when there is no fracture extension and the second, constant, component is "spent" on the fracture growth. Conversely, the first constant term in the solution (37) is produced by the first term in (36) and the second additive term is produced by the constant component $q_0$ of q(t) in (36). In particular, if $A_0=0$, we recover Carter's solution (see Eq. (A5), (Howard and Fast, 1957)).

If $q(t)\approx q_0$ for longer injection times, then $$A(t) \approx A_0\left(1 + \frac{q_0}{\pi C A_0}\sqrt{t}\right) = A_0\left(1 + \frac{4q_0}{\pi\ \text{Early Injection Slope}}\sqrt{t}\right), \tag{39}$$

where the average fluid injection rate $q_0$ and the Early Injection Slope are in consistent units. For short injection times, the hydrofracture area may grow linearly with time, see e.g., (Valko and Economides, 1995), page 174.

Eq. (39) allows one to calculate the fracture area as a function of the average injection rate and the early slope of cumulative injection versus the square root of time. All of these parameters are readily available if one operates a new injection well for a while at a low and constant injection pressure to prevent fracture extension. The initial fracture area (i.e., its length and height) is known approximately from the design of the hydrofracturing job (Wright and Conant, 1995, Wright, et al., 1997). In Part II, we show how our model can be used to estimate the hydrofracture size from the injection pressure-rate data.

The most important restriction in Carter's and our derivation is the requirement that the injection pressure is not communicated beyond the current length of the fracture. Hagoort, et al. (1980) have shown numerically that for a homogeneous reservoir the fracture propagation rate is only about half of that predicted by the Carter formula (Eq. (37) with $A_0=0$). This is because the formation pressure increases beyond the current length of the hydrofracture, thus confining it. If fracture growth is slower than predicted by the mass balance (39), then there must be flow parallel to the fracture plane or additional formation fracturing perpendicular to the fracture plane, or both. Either way, the leak-off rate from the fracture must increase.

We address the issue of injection control subject to the fracture growth below in Part I.

I.6 Hydrofracture Growth—Conclusions

We have analyzed 2D, transient water injection from a growing vertical hydrofracture. The application of the self-similar solution by (Gordeyev and Entov 1997) to a low-permeability rock leads us to conclude that the water flow is approximately orthogonal to the fracture plane for a long time.

We have revised Carter's transient mass balance of fluid injection through a growing fracture and complemented the mass balance equation with effects of variable injection pressure. The extended Carter formula has been presented in a new simplified form.

We have proved that the rate of fluid injection through a static hydrofracture must fall down to almost zero if injection pressure is bounded by, say, the overburden stress.

Thus, ultimately, fracture growth is inevitable regardless of mechanical design of injection wells and injection policy. However, better control of injection pressure through improved mechanical design is always helpful.

In diatomite, fracture extension must occur no later than 100–400 days for water injection rates of no less than 8000 l/Day per fracture and down hole injection pressure increasing up to the fracture propagation stress.

In 20 fluid injection wells in three different locations in the Belridge diatomite, in some 40 water injectors in the Lost Hills diatomite, and in several water injectors in the Dan field, the respective hydrofractures underwent continuous extension with occasional, discrete failures. Therefore, as we have predicted, extensions of injection hydrofractures are a norm in low-permeability rock.

These hydrofracture extensions manifested themselves as constant injection rates at constant injection pressures. The magnitude of hydrofracture extension can be estimated over a period of 4–7 years from the initial slope of the cumulative injection versus the square root of time, average injection rate, and by assuming a homogeneous reservoir. In the diatomite, the hydrofracture areas may extend by a factor of 2.5–5.5 after 7 years of water or steam injection. In the Dan field, the rate of growth is purposefully higher, a factor of 2–3 in 3 years of water injection.

II Control Model

II.1 Control Model—Introduction

In this Part II, we design an optimal injection controller using methods of optimal control theory. The controller inputs are the history of the injection pressure and the cumulative injection, along with the fracture size. The output parameter is the injection pressure and the control objective is the injection rate. We demonstrate that the optimal injection pressure depends not only on the instantaneous measurements, but it is determined by the whole history of the injection and of the fracture area growth. We show the controller robustness when the inputs are delayed and noisy and when the fracture undergoes abrupt extensions. Finally, we propose a procedure that allows estimation of the hydrofracture size at no additional cost.

Our ultimate goal of this invention is to design an integrated system of field-wide waterflood surveillance and supervisory control. As of now, this system consists of Waterflood Analyzer (De and Patzek, 1999) and a network of individual injector controllers, all implemented in modular software. We design an optimal controller of water injection into a low permeability rock through a hydrofractured well. We control the water injection rate as a prescribed function of time and regulate the wellhead injection pressure. The controller is based on the optimization of a quadratic performance criterion subject to the constraints imposed by a model of the injection well-hydrofracture-formation interactions. The input parameters are the injection pressure, the cumulative volume of injected fluid and the area of injection hydrofracture. The output is the injection pressure, and the objective of the control is a prescribed injection rate that may be time-dependent. We show that the optimal output depends not only on the instantaneous measurements, but also on the entire history of measurements.

The wellhead injection pressures and injection rates are readily available if the injection water pipelines are equipped with pressure gauges and flow meters, and the respective measurements are appropriately collected and stored as time series. The cumulative injection is then calculated from a straightforward integration. The controller processes the data and outputs the appropriate injection pressure. In an ideal situation, it can be used "on line", i.e. implemented as an automatic device. But it also can be used as a tool to determine the injection pressure, which can be applied through manual regulation. Automation of the process of data collection and control leads to a better definition of the controller and, therefore, reduces the risk of a catastrophic fracture extension.

Measurements of the hydrofracture area are less easily available. Holzhausen and Gooch (1985), Ashour and Yew (1996), and Patzek and De (1998) have developed a hydraulic impedance method of characterizing injection hydrofractures. This method is based on the generation of low frequency pressure pulses at the wellhead or beneath the injection packer, and on the subsequent analysis of acoustic waves returning from the wellbore and the fracture. Wright and Conant, (1995) use tiltmeter arrays to estimate the fracture orientation and growth. An up-to-date overview of hydrofracture diagnostics methods has been presented by Warpinski (1996).

The controller input requires an effective fracture area rather than its geometric structure, see (Patzek and Silin, 2001). The effective fracture area implicitly incorporates variable permeability of the surrounding formation, and it also accounts for the decrease of permeability caused by formation plugging. To identify the effective fracture area, we propose in the present invention to utilize the system response to the controller action. For this purpose one needs to maintain a database of injection pressure and cumulative injection, which are collected anyway. Hence, the proposed method does not impose any extra measurement costs, whereas the other methods listed above are quite expensive.

Above, we considered a model of transient fluid injection into a low-permeability rock through a vertical hydrofracture. We arrived at a model describing transient fluid injection into a very low permeability reservoir, e.g., diatomite or chalk, for several years. We have modified the original Carter's model (Howard and Fast, 1957) of transient leak-off from a hydrofracture to account for the initial fracture area. We also have extended Carter's model to admit variable injection pressure and transformed it to an equivalent simpler form. As a result, we have arrived at a Volterra integral convolution equation expressing the cumulative fluid injection through the history of injection pressure and the fracture area (Patzek and Silin, 2001), Eq. (24).

The control procedure is designed in the following way. First, we determine what cumulative injection (or, equivalently, injection rate) is the desirable goal. This decision can be made through waterflood analysis (De and Patzek, 1999), reservoir simulation and economics, and it is beyond the scope of this invention. Second, we reformulate the control objective in terms of the cumulative injection. Since the latter is just the integral of injection rate, this reformulation imposes no additional restrictions. Then, by analyzing the deviation of the actual cumulative injection from the target cumulative injection, and using the measured fracture area, the controller determines injection pressure, which minimizes this deviation. Control is applied by adjusting a flow valve at the wellhead and it is iterated in time, FIG. 10.

The convolution nature of the model does not allow us to obtain the optimal solution as a genuine feedback control and to design the controller as a standard closed-loop system. At each time, we have to account for the previous history of injection. However, the feedback mode may be imitated by designing the control on a relatively short time interval, which slides with time. When an unexpected event happens, e.g., a sudden fracture extension occurs, a new sliding interval is generated and the controller is refreshed promptly.

A distinctive feature of the controller proposed here is that the injection pressure is computed through a model of the injection process. Although we cannot predict when and how the fracture extensions happen, the controller automatically takes into account the effective fracture area changes and the decrease of the pressure gradient caused by the saturation of the surrounding formation with the injected water. Here we present the theoretical background of the controller.

This section is organized as follows. The modified Carter's model of hydrofracture growth has been previously described. Next, we derive the system of equations characterizing the optimal injection pressure. Then we discuss how this system of equations can be solved for different models of fracture growth. Next, we obtain and compare three modes of optimal control: exact optimal control, optimal control produced by the system of equations, and piecewise-constant optimal control. Finally, we present several examples. The optimal injection pressure is computed through the minimization of a quadratic performance criterion using optimal control theory methods. Therefore, a considerable part of this Part is devoted to the development of mathematical background.

II.2 Control Model—Theory

We depart from the standard model by Carter, and augment it. Initially assume a transient linear flow from a vertical fracture through which an incompressible fluid (water) is injected into the surrounding formation. The flow is orthogonal to the fracture faces. The fluid is injected under a pressure $p_{inj}(t)$ that is uniform inside the fracture but may depend on time t. Under these assumptions, the cumulative injection can be calculated from the following equation, restated here for convenience from earlier Eq. (25):

$$Q(t) = wA(t) + 2\frac{kk_{rw}}{\mu\sqrt{\pi\alpha_w}}\int_0^t \frac{(p_{inj}(\tau) - p_i)A(\tau)}{\sqrt{t-\tau}}\,d\tau. \tag{40}$$

Here k and $k_{rw}$ are, respectively, the absolute rock permeability and the relative water permeability in the formation outside the fracture, and μ is the water viscosity. Parameters $\alpha_w$ and $p_i$ denote the constant hydraulic diffusivity and the initial pressure in the formation (we should parenthetically note that in the future, hydraulic diffusivity can be made time-dependent). The effective fracture area at time t is measured as A(t) and its effective width is denoted by w. The coefficient 2 in Eq. (40) reflects the fact that a fracture has two faces of approximately equal areas, so the total fracture surface area is equal to 2 A(t). The first term on the right-hand side of Eq. (40) represents the portion of the injected fluid spent on filling up the fracture volume. It is small in comparison with the second term in (40). We assume that the permeability inside the fracture is much higher than outside it, so at any time variation of the injection pressure throughout the fracture is negligibly small. We introduce A(t) as an effective area because the actual permeability may change in time because of formation plugging (Barkman and Davidson, 1972) and changing water saturation.

It follows from (40) that the initial value of the cumulative injection is equal to wA(0). The control objective is to keep the injection rate q(t) as close as possible to a prescribed target injection rate $q_*(t)$. Since equation (40) is formulated in terms of cumulative injection, it will be more convenient to formulate the optimal control problem in terms of target cumulative injection $$Q_*(t) = Q_*(0) + \int_0^t q_*(\tau)\,d\tau. \tag{41}$$

If control maintains the actual cumulative injection close to $Q_*(t)$, then the actual injection rate is close to $q_*(t)$ on average.

To formulate an optimal control problem, we need to select a performance criterion for the process described by (40). Suppose that we are planning to apply control on a time interval [θ,T], T>θ≧0. In particular, this means that the cumulative injection and the injection pressure are known on the interval [0,θ], along with the effective fracture area function A(t). On the interval [θ,T] we want to apply such an injection pressure that the resulting cumulative injection will be as close as possible to (41). This requirement may be formulated in the following way:

Minimize $$J[p_{inj}] = \frac{1}{2}\int_\vartheta^T w_q(t)(Q(t) - Q_*(t))^2\,dt + \frac{1}{2}\int_\vartheta^T w_p(t)(p_{inj}(t) - p_*(t))^2\,dt \tag{42}$$

subject to constraint (40).

The weight functions $w_p$ and $w_q$ are positive-defined. They reflect a trade-off between the closeness of the actual cumulative injection Q(t) to the target $Q_*(t)$, and the well-posedness of the optimization problem. For small values of $w_p$, minimization of functional (42) enforces Q(t) to follow the target injection strategy $Q_*(t)$. However, if the value of $w_p$ becomes too small, then the problem of minimization of functional (42) becomes ill-posed (Tikhonov and Arsenin 1977) and (Vasil'ev 1982). Moreover, in the equation characterizing the optimal control, derived below, the function $w_p$ is in the denominator, which means that computational stability of this equation deteriorates as $w_p$ approaches zero. At the same time, if we consider a specific mode of control, e.g., piecewise constant control, then the well-posedness of the minimization problem is not affected if $w_p \equiv 0$. The function $p_*(t)$ defines a reference value of the injection pressure. Theoretically this function can be selected arbitrarily; however, practically it is better if it gives a rough estimate of the optimal injection pressure. Below, we discuss the ways in which $p_*(t)$ can be reasonably specified.

The optimization problem we just have formulated is a linear-quadratic optimal control problem. In the next section, we derive the necessary and sufficient conditions of optimality in the form of a system of integral equations.

II.3 Optimal Injection Pressure Control Model

Here we obtain necessary and sufficient optimality conditions for problem (40)–(42). We analyze the obtained equations in order to characterize optimal control in two different modes: the continuous mode and the piecewise-constant mode. Also, we characterize the injection pressure function, which provides an exact identity $$Q(t) \equiv Q_*(t), \theta \leqq t \leqq T.$$

Put $U(t) = p_{inj}(t) - p_*(t)$ and $V(t) = Q(t) - Q_*(t)$, θ≦t≦T. Then the optimal control problem transforms into minimize $$J = \frac{1}{2}\int_\vartheta^T w_q(t)V(t)^2\,dt + \frac{1}{2}\int_\vartheta^T w_p(t)U(t)^2\,dt \tag{43}$$

subject to $$V(t) = -Q_*(t) + wA(t) + 2\frac{kk_{rw}}{\mu\sqrt{\pi\alpha_w}}\int_0^\vartheta \frac{(p_{inj}(\tau) - p_i)A(\tau)}{\sqrt{t-\tau}}\,d\tau + 2\frac{kk_{rw}}{\mu\sqrt{\pi\alpha_w}}\int_\vartheta^t \frac{(p_*(\tau) - p_i)A(\tau)}{\sqrt{t-\tau}}\,d\tau + 2\frac{kk_{rw}}{\mu\sqrt{\pi\alpha_w}}\int_\vartheta^t \frac{U(\tau)A(\tau)}{\sqrt{t-\tau}}\,d\tau \tag{44}$$

In this setting, the control parameter is function U(t). We have deliberately split the integral over [0,T] into two parts in order to single out the only term depending on the control parameter U(t).

A perturbation δU(t) of the control parameter U(t) on the interval [θ,T] produces variation of functional (43) and constraint (44):

$$\delta J = \int_\vartheta^T w_q(t)V(t)\delta V(t)\,dt + \int_\vartheta^T w_q(t)U(t)\delta U(t)\,dt; \tag{45}$$

$$\delta V(t) - 2\frac{kk^*_{rw}}{\mu\sqrt{\pi\alpha_w}}\int_\vartheta^t \frac{A(\tau)}{\sqrt{t-\tau}}\delta U(\tau)\,d\tau = 0. \tag{46}$$

The integral in (46) is taken only over [θ,T] because the control U(t) is perturbed only on this interval and, by virtue of (44), this perturbation does not affect V(t) on [0,θ]. Using the standard Lagrange multipliers technique (Vasil'ev, 1982), we infer that the minimum of functional (43) is characterized by the following equation:

$$U(t) = -2\frac{kk_{rw}}{\mu\sqrt{\pi\alpha_w w_p(t)}}A(t)\int_t^T \frac{w_q(\tau)}{\sqrt{\tau - t}}V(\tau)\,d\tau,\ \vartheta \le t \le T \tag{47}$$

Taking (44) into account and passing back to the original variables, we obtain that the optimal injection pressure $p_0(t)$ and the cumulative injection $Q_0(t)$ are provided by solving the following system of equations $$Q_0(t) = wA(t) + 2\frac{kk_{rw}}{\mu\sqrt{\pi\alpha_w}}\int_0^\vartheta \frac{(p_{inj}(\tau) - p_i)A(\tau)}{\sqrt{t-\tau}}\,d\tau + 2\frac{kk_{rw}}{\mu\sqrt{\pi\alpha_w}}\int_\vartheta^t \frac{(p_0(\tau) - p_i)A(\tau)}{\sqrt{t-\tau}}\,d\tau \tag{48}$$

-continued $$p_0(t) = p_*(t) - 2\frac{kk_{rw}}{\mu\sqrt{\pi\alpha_w w_p(t)}}A(t)\int_t^T \frac{w_q(\tau)}{\sqrt{\tau - t}}(Q_0(\tau) - Q_*(\tau)),\ d\tau,\ \vartheta \le t \le T \tag{49}$$

Now we begin to analyze the resulting control model. The importance of a nonzero weight function $w_p(t)$ is obvious from equation (49). The injection pressure, i. e., the controller output is not defined if $w_p(t)$ is equal to zero.

Equation (49), in particular, implies that the optimal injection pressure satisfies the condition $p_0(T)=p_*(T)$. This is an artifact caused by the integral quadratic criterion (42) affecting the solution in a small neighborhood of T, but it makes important the appropriate selection of the function $p_*(T)$. For example, the trivial function $p_*(t)\equiv 0$ is not a good choice of the reference function in (42) because it enforces zero injection pressure by the end of the current subinterval. A rather simple and reasonable selection is provided by $p_*(t)\equiv P_*$, where $P_*$ is the optimal constant pressure on the interval $[\theta,T]$. The equation characterizing $P_*$ will be obtained below, see Eq. (60).

Notice that the optimal cumulative injection $Q_0(t)$ depends on the entire history of injection pressure up to time t. Also, the optimal injection pressure is determined by Eq. (49) on the entire time interval $[\theta,T]$. This feature prohibits a genuine closed loop feedback control mode. However, there are several ways to circumvent this difficulty.

First, we can organize the process of control as a step-by-step procedure. We split the whole time interval into reasonably small pieces, so that on each interval we can expect that the formation properties do not change too much. Then we compute the optimal injection pressure for this interval and apply it at the wellhead by adjusting the control valve. As soon as either the measured cumulative injection or the fracture begins to deviate from the estimates, which were used to determine the optimal injection pressure, the control interval $[\theta,T]$ has to be refreshed. It also means that we must revise the estimate of the fracture area A(t) for the refreshed interval and the expected optimal cumulative injection. Thus, the control is designed on a sliding time interval $[\theta,T]$. Another useful method is to refresh the control interval before the current interval expires even if the measured and computed parameters stay in good agreement. Computer simulations show that even a small overlap of the subsequent control intervals considerably improves the controller performance. This modification simplifies the choice of the function $p_*(t)$ in Eq. (42), because the condition $p_0(T)=p_*(T)$ plays an important role only in a small neighborhood of the endpoint T.

Another manner of obtaining the optimal control from Eq. (49) is to change the model of fracture growth. So far, we have treated the fracture as a continuously growing object. It is clear, however, that the area of the fracture may grow in steps. This observation leads to the piecewise-constant fracture growth model. We can design our control assuming that the fracture area is constant on the current interval $[\theta,T]$. If independent measurements tell us that the fracture area has changed, the interval $[\theta T]$ and the control must be refreshed immediately. Equations (48) and (49) are further simplified and the optimal solution can be obtained analytically for a piecewise constant fracture growth model, see Eq. (75) below.

Before proceeding further, let us make a remark concerning the solvability of the system of integral equations (48)–(49). For simplicity let us assume that both weight functions $w_p$ and $w_q$ are constant. In this case, one may note that the integral operators on the right-hand sides of (48) and (49) are adjoint to each other. More precisely, if we define an integral operator $$Df(\cdot)(t) = 2\frac{kk_{rw}}{\mu\sqrt{\pi\alpha_w}}\int_\vartheta^t \frac{f(\tau)A(\tau)}{\sqrt{t-\tau}}d\tau, \tag{50}$$

then its adjoint operator is equal to $$D^* g(\cdot)(t) = 2\frac{kk_{rw}}{\mu\sqrt{\pi\alpha_w}}A(t)\int_\vartheta^t \frac{g(\tau)}{\sqrt{t-\tau}}d\tau. \tag{51}$$

The notation $Df(\cdot)$ means that operator D transforms the whole function $f(t)$, $\theta \leqq t \leqq T$, rather than its particular value, into another function defined on $[\theta,T]$, and $Df(\cdot)(t)$ denotes the value of that other function at t. The notation $D^*g(\cdot)(t)$ is similar.

If both weight functions $w_p(t)$ and $w_q(t)$ are constant, then the system of equations (48), (49) can be expressed in the operator form as $$\begin{cases} Q = DP + b_Q, \\ P = -\frac{w_q}{w_p}D^*Q + b_p, \end{cases} \tag{52}$$

where $$b_Q(t) = wA(t) + 2\frac{kk_{rw}}{\mu\sqrt{\pi\alpha_w}}\int_0^\vartheta \frac{(p_{inj}(\tau) - p_i)A(\tau)}{\sqrt{t-\tau}}d\tau, \tag{53}$$

$$b_p(t) = p_*(t) + 2\frac{w_q}{w_p}\frac{kk_{rw}}{\mu\sqrt{\pi\alpha_w}}A(t)\int_t^T \frac{1}{\sqrt{\tau - t}}Q_*(\tau)d\tau \tag{54}$$

and Q and P denote, respectively, the cumulative injection and injection pressure on the interval $[\theta,T]$. From (52) one deduces the following equation with one unknown function P:

$$\left(D^*D + \frac{w_p}{w_q}Id\right)P = -D^*b_Q + \frac{w_p}{w_q}b_p, \tag{55}$$

where Id is the identity operator. The operator inside the brackets on the left-hand side of (55) is self-adjoint and positive-definite. Therefore, the solution to Eq. (55) can be efficiently obtained, say, with a conjugate gradient algorithm. Note that as the ratio $$\frac{w_p}{w_q}$$

increases, the term $$\frac{w_p}{w_q}$$

Id dominates (55), and equation (55) becomes better posed. When $w_p=0$, the second term in functional (43) must be dropped and in order to solve (55) one has to invert a product of two Volterra integral operators. Zero belongs to the continuous spectrum of operator D (Kolmogorov and Fomin, 1975) and, therefore, the problem of inversion of such an operator might be ill-posed.

In the discretized form, the matrix that approximates operator D is lower triangular; however, the product D*D does not necessarily have a sparse structure. The above mentioned ill-posedness of the inversion of D manifests itself by the presence of a row of zeros in its discretization. Thus, for the discretized form we obtain the same rule: the larger the ratio $w_p/w_q$ is, the better posed is equation (55). However, if $w_p/w_q$ is too large, then criterion (43) estimates the deviation of the injection pressure from $p_*(t)$ on $[\theta,T]$ rather than the ultimate objective of the controller. A reasonable compromise in selecting the weights $w_p$ and $w_q$, that provides well-posedness of the system of integral equations (48)–(49) without a substantial deviation from the control objectives, should be found empirically.

II.4 Piecewise Constant Injection Pressure

In this section, the control is a piecewise-constant function of time. This means that the whole time interval, on which the injection process is considered, is split into subintervals with a constant injection pressure on each of them. The simplicity of the optimal control obtained under such assumptions makes it much easier to implement in practice. However, piecewise constant structure of admissible control definitely may deteriorate the overall performance in comparison with the class of arbitrary admissible controls. At the same time, an arbitrary control can be approximated by a piecewise-constant control with any accuracy as the longest interval of constancy goes to zero.

In order to avoid cumbersome calculations, we further assume that the injection pressure is constant on entire sliding interval $[\theta,T]$ introduced in the previous section. Denote by P the value of the injection pressure on $[\theta,T]$. Then Eq. (40) reduces to $$Q(t) = wA(t) + 2\frac{kk_{rw}}{\mu\sqrt{\pi\alpha_w}}\int_0^{\vartheta}\frac{(p_{inj}(\tau)-p_i)A(\tau)}{\sqrt{t-\tau}}d\tau + 2\frac{kk_{rw}}{\mu\sqrt{\pi\alpha_w}}\int_{\vartheta}^{t}\frac{A(\tau)}{\sqrt{t-\tau}}d\tau(P-p_i) \tag{56}$$

Put $$a_q(t) = 2\frac{kk_{rw}}{\mu\sqrt{\pi\alpha_w}}\int_{\vartheta}^{t}\frac{A(\tau)}{\sqrt{t-\tau}}d\tau \text{ and} \tag{57}$$

$$b_q(t) = wA(t) + 2\frac{kk_{rw}}{\mu\sqrt{\pi\alpha_w}}\int_0^{\vartheta}\frac{(p_{inj}(\tau)-p_i)A(\tau)}{\sqrt{t-\tau}}d\tau. \tag{58}$$

In the case of constant injection pressure the necessity of the regularization term in (42) is eliminated and one obtains the following optimization problem:

minimize the quadratic functional $$J[P] = \frac{1}{2}\int_{\vartheta}^{T}(b_q(t)+a_q(t)(P-p_i)-Q_*(t))^2\,dt \tag{59}$$

among all constant injection pressures P.

Clearly, the solution to this problem is characterized by $J'[P]=0$ and the optimal value $P_*$ of the constant injection pressure on the interval $[\theta,T]$ is characterized by $$P_* = p_i - \frac{\int_{\vartheta}^{T}(b_q(t)-Q_*(t))a_q(t)dt}{\int_{\vartheta}^{T}a_q^2(t)dt}. \tag{60}$$

Since the fracture area is always positive, the denominator in (60) is nonzero (cf. Eq. (57)) and $P_*$ is well defined. As above, in order to apply (60) one needs an estimate of the fracture area one the interval $[\theta,T]$, so this interval should not be too long, so that formation properties do not change considerably on it.

The obtained value $P_*$ can be used to compute a more elaborate control strategy by solving (48), (49) for $p_*(t)\equiv P_*$ on $[\theta,T]$. Note that $b_q(t)$ is equal to the historic cumulative injection until $t\geqq\theta$, through the part of the fracture, which opened by the time $\theta$. If the actual cumulative injection follows the target injection closely enough, then the value of $b_q(t)$ should be less than $Q_*(t)$, so normally we should have $P_*>p_i$.

II.5 Exact Optimization

Another possibility to keep the injection rate at the prescribed level is to solve Equation (40) with $Q(t)=Q_*(t)$ on the left-hand side. Theoretically, the injection pressure obtained this way outperforms both the optimal pressure obtained by solving equations (48) and (49), and the piecewise-constant optimal pressure. However, to compute the exactly optimal injection pressure one needs to know the derivative dA(t)/dt. Since measurements of the fracture area are never accurate, the derived error in estimating dA(t)/dt will be large and probably unacceptable. However, we present the exactly optimal solution here because it can be used for reference and in a posteriori estimates.

In order to solve Eq. (40) we apply the Laplace transform. Denote the solution to Eq. (40) by $Q_*(t)$. Clearly, $Q_*(0)=wA(0)$. Put $A_1(t)=A(t)-A(0)$ and $Q_1(t)=Q_*(t)-Q_*(0)$ and denote by $f(t)$ the product $(p_{inj}(t)-p_i)A(t)$. Hence, equation (40) transforms into $$Q_1(t) = wA_1(t) + 2\frac{kk_{rw}}{\mu\sqrt{\pi\alpha_w}}\int_0^{t}\frac{f(\tau)}{\sqrt{t-\tau}}d\tau \tag{61}$$

Application of the Laplace transform to equation (61) produces $$L[Q_1](s) = wL[A_1](s) + 2\frac{kk_{rw}}{\mu\sqrt{\pi\alpha_w}}\frac{\sqrt{\pi}}{\sqrt{s}}L[f](s) \tag{62}$$

Hence $$2\frac{kk_{rw}}{\mu\sqrt{\alpha_w}}\sqrt{\pi}\,L[f](s)=\frac{\sqrt{\pi}}{\sqrt{s}}(sL[Q_1](s)-wsL[A_1](s)) \tag{63}$$

From (63) one infers that $$2\frac{kk_{rw}}{\mu\sqrt{\alpha_w}}\sqrt{\pi}\,f(t)=\int_0^t\frac{\frac{d}{d\tau}(Q_1(\tau)-wA_1(\tau))}{\sqrt{t-\tau}}d\tau \tag{64}$$

In the original notation, (64) finally implies that $$P_{inj}(t)=p_i+\frac{\mu\sqrt{\alpha_w}}{2\sqrt{\pi}\,kk_{rw}A(t)}\int_0^t\frac{q_*(\tau)-w\frac{dA(\tau)}{d\tau}}{\sqrt{t-\tau}}d\tau. \tag{65}$$

Note that from (65)

$$p'_{inj}(0)=p_i. \tag{66}$$

Hence, the idealized exact optimal control assumes a gentle startup of injection. If both functions $q_*(t)$ and $dA(t)/dt$ are bounded, then for a small positive t the function $p_{inj}(t)$ increases approximately proportionally to the square root of time.

If our intention is to keep the injection rate constant, $q_*(t)\equiv q_*$, then (65) further simplifies to $$P_{inj}(t)=p_i+\frac{\mu\sqrt{\alpha_w}\sqrt{t}}{\sqrt{\pi}\,kk_{rw}A(t)}q_*-\frac{\mu\sqrt{\alpha_w}}{2\sqrt{\pi}\,kk_{rw}A(t)}w\int_0^t\frac{\frac{dA(\tau)}{d\tau}}{\sqrt{t-\tau}}d\tau. \tag{67}$$

Without fracture growth, the last integral in (67) vanishes and the injection pressure increases proportionally to the square root of time. The pressure cannot increase indefinitely; at some point this inevitably will lead to a fracture extension. In addition, (66)–(67) imply that the optimal injection pressure cannot be constant for all times.

It is interesting to note that if $A(t)=\sqrt{at}$, see (Silin and Patzek 2001), the integral in Eq. (67) does not depend on t and we get $$P_{inj}(t)=p_i+\frac{\mu\sqrt{\alpha_w}}{kk_{rw}\sqrt{\pi a}}q_*-\frac{\mu w\sqrt{\pi\alpha_w a}}{4kk_{rw}\sqrt{t}} \tag{68}$$

Therefore, in this particular case the optimal injection pressure at constant injection rate $q_*$ asymptotically approaches a constant value $$p_\infty=p_i+\frac{\mu\sqrt{\alpha_w}}{kk_{rw}\sqrt{\pi a}}q_* \tag{69}$$

as $t\to\infty$.

II.6 Piecewise Constant Fracture Growth Model

So far, the fracture growth has been continuous, providing a reasonable approximation at a large time scale. However, it is natural to assume that the fracture grows in small increments. As we mentioned above, constant fracture area stipulates increase of injection pressure (or injection rate decline that we are trying to avoid). An increase of the pressure results in a step-enlargement of the fracture. The latter, in turn, increases flow into the formation and causes a decrease of the injection pressure as the controller response. An increase of the flow rate causes an even bigger drop in the injection pressure because of the growing fracture area, and because the pressure gradient is greater on the faces of the recently opened portions of the fracture than in the older parts of the fracture. The injection rate starts to decrease due to the increasing formation pressure, this causes the controller to increase the injection pressure, and the process repeats in time.

We assume that considerable changes of the fracture area can be detected by observation. This implies that on the current interval, on which the controller is being designed, the fracture area can be handled as a constant. In other words, $A(t)\equiv A(\theta)$, $\theta\leqq t\leqq T$. Then the derivative of A(t) is equal to a sum of Dirac delta-functions $$\frac{dA(t)}{dt}=\sum_{\vartheta_j<t}(A(\vartheta_j+0)-A(\vartheta_j-0))\delta(t-\vartheta_j), \tag{70}$$

where $A(-0)=0$. It is not difficult to see that (40) transforms into $$Q(t)=wA(\vartheta_K)+2\frac{kk_{rw}}{\mu\sqrt{\pi\alpha_w}}\sum_{\vartheta_j<t}A(\vartheta_j)\int_{\vartheta_j}^{T_j^{end}}\frac{(p_{inj}(\tau)-p_i)}{\sqrt{t-\tau}}d\tau+2\frac{kk_{rw}}{\mu\sqrt{\pi\alpha_w}}A(\vartheta_k)\int_{\vartheta_K}^{t}\frac{(p_{inj}(\tau)-p_i)}{\sqrt{t-\tau}}d\tau, \tag{71}$$

where $[\theta y_K,T_K]$ is the current sliding interval containing t. On the preceding interval $[0,\theta_K]$, the control was designed on the contiguous intervals $[\theta_j,T_j]$, $0=\theta_0<\theta_1<\ldots<\theta_{K-1}$. As discussed above, the actual interval of application of the design control may be shorter than $[\theta_j,T_j]$. We denote it by $[\theta_j,T_j^{end}]$, $\theta_j<T_j^{end}\leqq T_j$, so that $\theta_{j+1}=T_j^{end}$ and every two consequent intervals are overlapping. The optimal continuous pressure $p_K(t)$ and respective cumulative injection $Q_K(t)$ defined on an interval $[\theta_K,T_K]$ are obtained from the solution of the following system of equations $$Q_K(t)=wA(\vartheta_K)+2\frac{kk_{rw}}{\mu\sqrt{\pi\alpha_w}}\sum_{\vartheta_j<t}A(\vartheta_j)\int_{\vartheta_j}^{T_j^{end}}\frac{(p_{inj}(\tau)-p_i)}{\sqrt{t-\tau}}d\tau+2\frac{kk_{rw}}{\mu\sqrt{\pi\alpha_w}}A(\vartheta_K)\int_{\vartheta_K}^{t}\frac{(p_K(\tau)-p_i)}{\sqrt{t-\tau}}d\tau \tag{72}$$

$$p_K(t)=p*(t)-2\frac{kk_{rw}}{\mu\sqrt{\pi\alpha_w}\,w_p(t)}A(\vartheta_K)\int_t^{T_K}\frac{w_q(\tau)}{\sqrt{t-\tau}}(Q_K(\tau)-Q*(\tau))d\tau,\quad \vartheta_K<t\leq T_K \tag{73}$$

Again, although $p_K(t)$ and $Q_K(t)$ are defined on the whole interval $[\theta_K,T_K]$, they are going to be applied on a shorter interval $[\theta_K,T_K^{end}]$ and the new interval begins at $\theta_{K+1}=T_K^{end}$. An important distinction between the systems of equations (72)–(73) and (48)–(49) is that in (72)–(73) there is no dependence of the optimal injection pressure and the respective cumulative injection on the fracture area on $[\theta_K, T_K]$. On the other hand, the assumption of the constant area itself is an estimate of A(t) on the interval $[\theta_K, T_K]$.

For the exactly optimal control, i.e., the injection pressure which produces cumulative injection precisely coinciding with $Q_*(t)$, one obtains the following expression (see Eq. (65)):

$$p_{inj}(t) = p_i + \frac{\mu\sqrt{\alpha_w}}{2\sqrt{\pi}\,kk_{rw}A(\vartheta_K)}\left(\int_0^t \frac{q*(\tau)}{\sqrt{t-\tau}}\,d\tau - w\sum_{0<\vartheta_j<t}\frac{(A(\vartheta_j)-A(\vartheta_{j-1}))}{\sqrt{t-\vartheta_j}}\right), \tag{74}$$

where, again, $[\theta_K, T_K]$ is the first interval containing t. If, further, the target injection rate is constant on each interval, i.e. $q_*(t) \equiv q_{*j}$, $\theta_j < t \leq T_j^{end}$, then (74) transforms into $$p_{inj}(t) = p_i + \frac{\mu\sqrt{\alpha_w}}{2\sqrt{\pi}\,kk_{rw}A(\vartheta_K)}\sum_{0<\vartheta_j<t}\left(2q*_j\left(\sqrt{t-\vartheta_{j-1}} - \sqrt{t-\vartheta_j}\right) - w(A(\vartheta_j)-A(\vartheta_{j-1}))\Big/\sqrt{t-\vartheta_j}\right) \tag{75}$$

The respective cumulative injection in this case is $$Q(t) = wA(\vartheta_K) + \frac{kk_{rw}}{\mu\sqrt{\pi\alpha_w}}\sum_{0<\vartheta_j<t}A(\vartheta_j)\int_{\vartheta_j}^{T_j^{end}}\frac{p_{inj}(\tau)-p_i}{\sqrt{t-\tau}}\,d\tau + \frac{kk_{rw}}{\mu\sqrt{\pi\alpha_w}}A(\vartheta_K)\int_{\vartheta_K}^{t}\frac{p_{inj}(\tau)-p_i}{\sqrt{t-\tau}}\,d\tau \tag{76}$$

Note that it follows from (75) that at each instant $\theta_j$ of fracture growth there is a short in time, but large in magnitude pressure drop. In the piecewise constant model this drop is singular of order $O(1/\sqrt{t-\theta_j})$. Practically, even during gradual fracture extensions, if the area grows continuously at a high rate then the injection pressure drops sharply.

Further simplifications of the solution occur if the injection pressure is piecewise constant as well. We adjust the sliding intervals to the intervals where the injection pressure is constant. Equation (40) then transforms into $$Q(t) = wA(\vartheta_K) + 4\frac{kk_{rw}}{\mu\sqrt{\pi\alpha_w}}\sum_{\vartheta_j<t}A(\vartheta_j)(P_j-p_i)\left(\sqrt{t-\vartheta_j} - \sqrt{t-T_j^{end}}\right) + A(\vartheta_K)(P_K-p_i)\sqrt{t-\vartheta_K} \tag{77}$$

Here $P_j$ is the value of the pressure on the interval $[\theta_j, T_j^{end}]$ and $P_K$ is the injection pressure on the current interval. The optimal value of $P_K$ is obtained by minimization of functional (59) for $\theta=\theta_K$, $T=T_K$ with $$a_q(t) = 4\frac{kk_{rw}}{\mu\sqrt{\pi\alpha_w}}A(\vartheta_K)\sqrt{t-\vartheta_K}, \tag{78}$$

$$b_q(t) = wA(\vartheta_K) + 4\frac{kk_{rw}}{\mu\sqrt{\pi\alpha_w}}\sum_{\vartheta_j<t}(P_j-p_i)A(\vartheta_j)\left(\sqrt{t-\vartheta_j} - \sqrt{t-T_j^{end}}\right) \tag{79}$$

Straightforward calculations produce the following result:

$$\begin{aligned} P_*^{const} = {} & p_i - \frac{1}{3}\frac{\mu\sqrt{\pi\alpha_w}}{kk_{rw}}\frac{1}{\sqrt{(t-\vartheta_K)}}w - \\ & \frac{1}{2(T-\vartheta_K)^2A(\vartheta_K)}\sum_{\vartheta_k<t}(P_*^k-p_i)A(\vartheta_k)\times \\ & \Bigg((2T-\vartheta_k-\vartheta_K)\sqrt{T-\vartheta_k}\sqrt{T-\vartheta_K} - \\ & (\vartheta_K-\vartheta_k)^2\ln\left(\frac{\sqrt{T-\vartheta_K}+\sqrt{T-\vartheta_k}}{\sqrt{\vartheta_K-\vartheta_k}}\right) - \\ & (2T-T_k^{end}-\vartheta_K)\sqrt{T-T_k^{end}}\sqrt{T-\vartheta_K} + \\ & (\vartheta_K-T_k^{end})^2\ln\left(\frac{\sqrt{T-\vartheta_K}+\sqrt{T-T_k^{end}}}{\sqrt{\vartheta_K-T_k^{end}}}\right)\Bigg) + \\ & \frac{1}{15}\frac{\mu\sqrt{\pi\alpha_w}}{kk_{rw}}\frac{1}{A(\vartheta_K)\sqrt{T-\vartheta_K}}[5Q*(\vartheta_K)+3q*(T-\vartheta_K)] \end{aligned} \tag{80}$$

The last formula, Eq. (80) provides a very simple method of computing the optimal constant injection pressure. It does not require any numerical integration, so the computation of (80) can be performed with very high precision.

II.7 Control Model—Results

Controller Simulation and Implementation

In this section we discuss several simulations of the controller. The computations below have been preformed using our controller simulator running under MS Windows.

Figure 10:
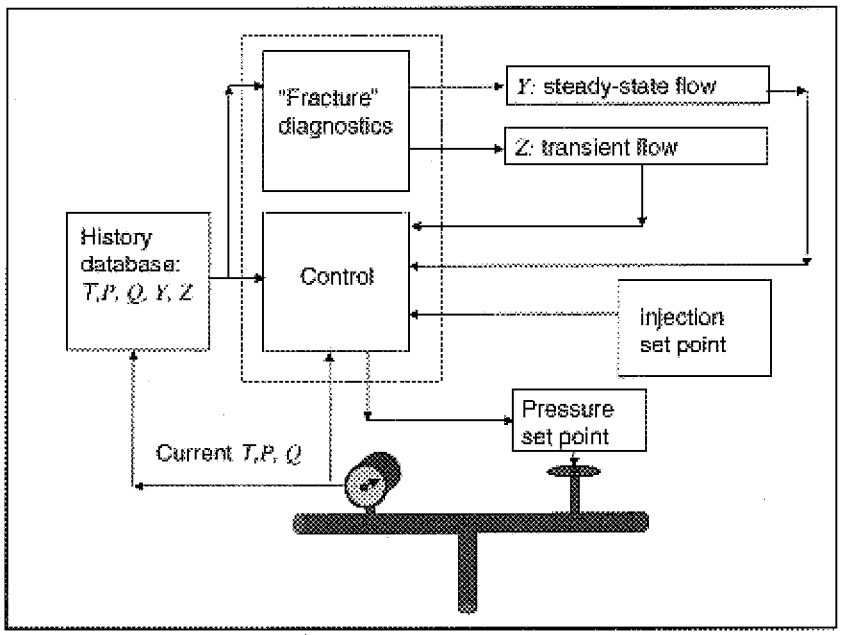
FIG. 10 The waterflood controller schematic diagram.

In general, the controller implementation is described in FIG. 10. As inputs, the controller needs the current measurements of the fracture area, the target cumulative injection, and the record of injection history. We admit that these data may be inaccurate, may have measurement errors, delays in measurements, etc. The controller processes these inputs and the optimal value of the injection pressure is produced on output. Based on the latter value, the wellhead valve is adjusted in order to set the injection pressure accordingly.

The stored measurements may grow excessively after a long period of operations and with many injectors. However, far history of injection pressure contributes very little to the integral on the right-hand side of Eq. (40). Therefore, to calculate the current optimal control value, it is critical to know the history of injection parameters only on some time interval ending at the time of control planning, rather than the entire injection history. To estimate the length of such interval, an analysis and a procedure similar to the ones developed in (Silin and Tsang, 2000) can be applied.

In our simulations we have used the following parameters. The absolute rock permeability, k=0.15 md; the relative permeability of water $k_{rw}$=0.1; the water viscosity $\mu=0.77\times10^{-3}$ Pa-s; the hydraulic diffusivity $\alpha_w=0.0532$ $m^2$/Day; the initial reservoir pressure $p_i=2.067\times10^4$ Pa; the target injection rate $q_*=3.18\times10^5$ l/Day; and the fracture width w=0.0015 m. These formation properties correspond to the diatomite layer G discussed in Part I, Table 1 above. The controller has been simulated over a time period of 8 years. In the computations we have assumed that the initial area of a single fracture face $A_0$ is approximately equal to 900 square meters. Note that since the fracture surface may have numerous folds, ridges, forks etc., the effective fracture face area is greater than the area of its geometric outline. Therefore, the area of 900 square meters does not necessarily imply that the fracture face can be viewed simply as a 30-by-30 m square.

First, we simulate a continuous fracture growth model and the optimal injection pressure is obtained by solving the system of integral equations (48)–(49). The length of the interval on which the optimal control was computed equals 20 days. Since we used 25% overlapping, the control was actually refreshed every 15 days. We assume that the fracture grows as the square root of time and its area approximately quadruples in 8 years. This growth rate agrees with the observations reported in Part I.

Figure 11:
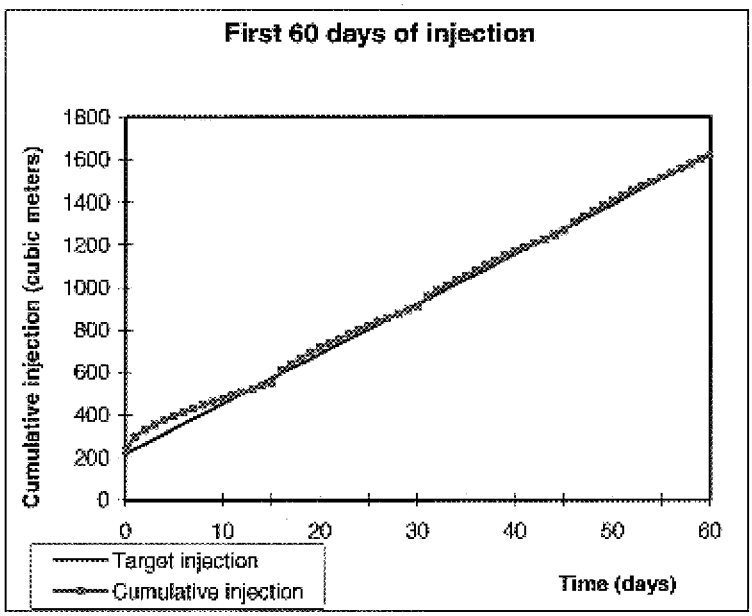
FIG. 11 Target and optimal cumulative injection for a continuous fracture growth model.
Figure 12:
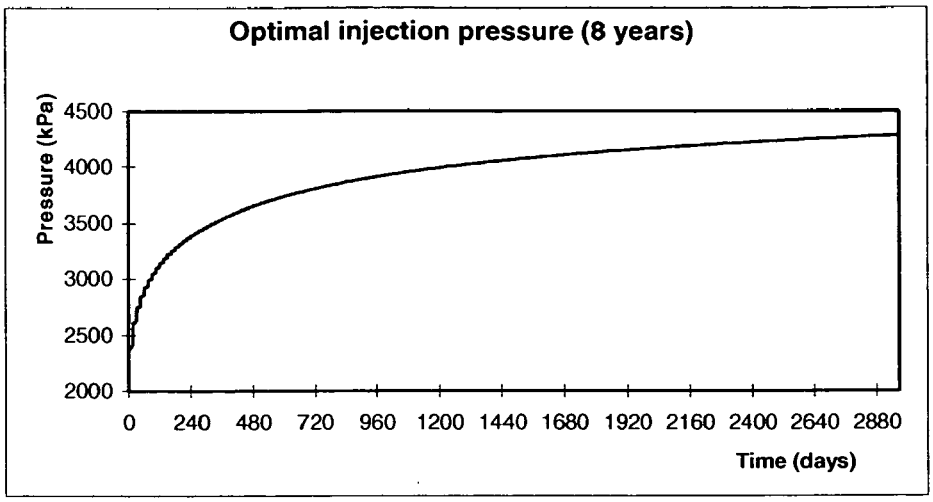
FIG. 12 PRIOR ART
FIG. 12 The optimal injection pressure for a continuous square-root-of time fracture growth model.

FIG. 11 shows that the cumulative injection produced by the optimal injection pressure—prescribed by the controller as in FIG. 12—barely deviates from the target injection. The quasi-periodic oscillations of the slope are caused by the interval-wise design of control.

A comparison of piecewise constant pressure with the optimal pressure in continuous mode (see Eq. (60) and Eqs. (48)–(49), respectively) results in a difference of less than 1%. The respective cumulative injection is almost the same as the one found for the continuous pressure mode.

Figure 13:
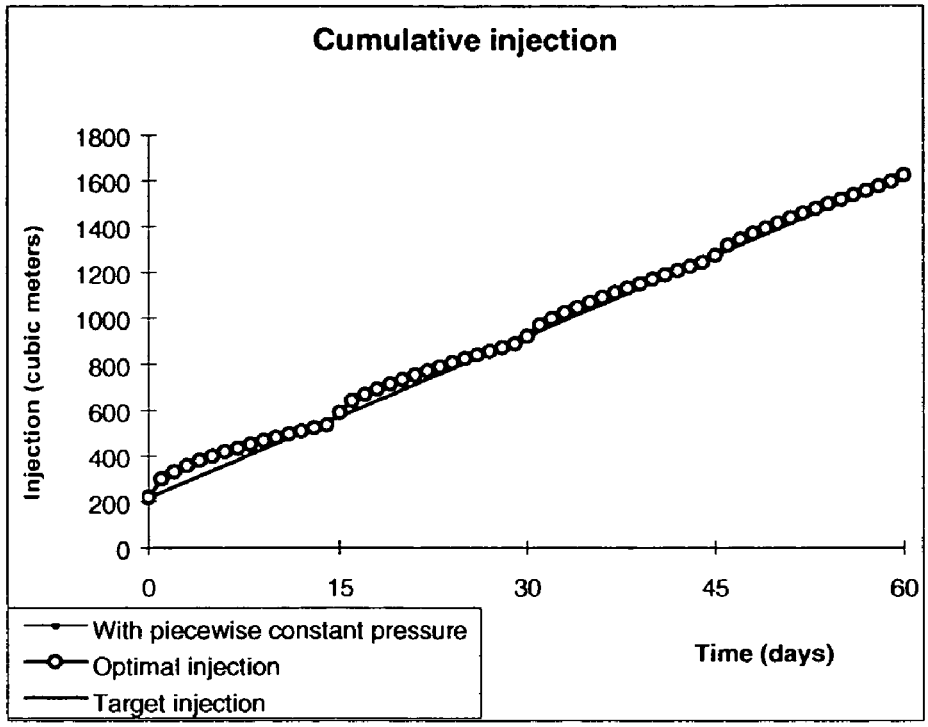
FIG. 13 Cumulative injection in piecewise constant and continuous control modes.
Figure 14:
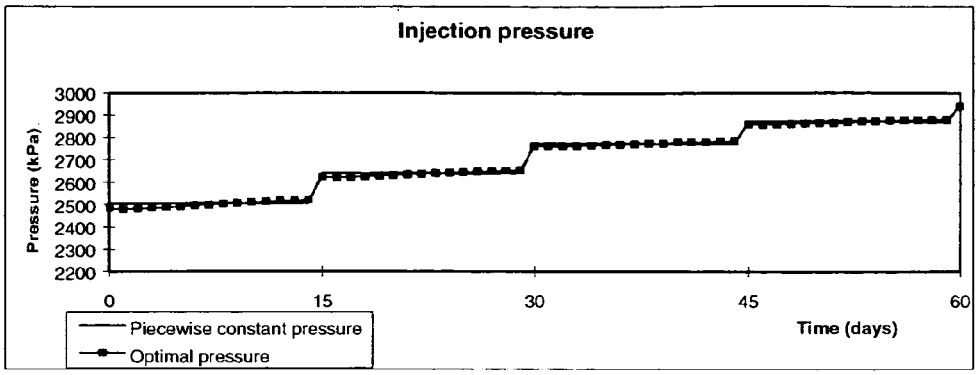
FIG. 14 Comparison between piecewise constant and continuous mode of control: piecewise constant fracture growth model.

For a piecewise constant fracture growth model the simulation results remain basically the same. The cumulative injection during the first 60 days is shown in FIG. 13. Again, one observes a vanishing oscillatory behavior of the slope caused by refreshing the control every 15 days. The pressures are plotted in FIG. 14. The piecewise constant pressure computed using the explicit formula in Eq. (80) only slightly differs from the optimal pressure obtained by solving the system of equations (72)–(73).

We do not show the cumulative injection produced by the exactly optimal pressure because by construction it coincides with the target injection.

Figure 15:
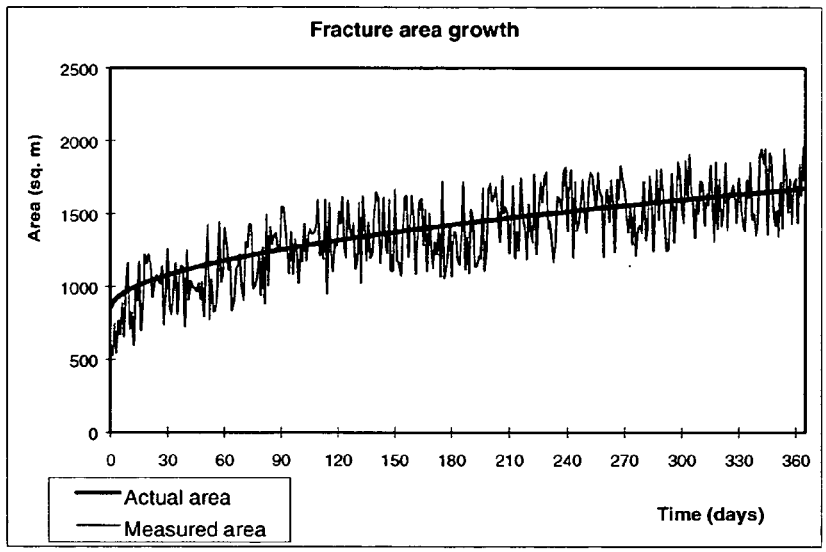
FIG. 15 Fractures are measured with a random error.

In the simulations above, we have assumed that all necessary input data are available with perfect accuracy. This is a highly idealized choice, only to demonstrate the controller performance without interference of disturbances and delays. Now let us assume that the measurements become available with a 15-day delay, which in our case equals one period of control planning. Also assume that the measurements are disturbed by noise which is modeled by adding a random component to the fracture area. Thus, as the controller input we have A(t−15 days delay)+error(t), instead of A(t). In this manner we have introduced both random and systematic errors into the measurements of the fracture area. The range of error(t) is about 40% of the initial fracture face area A(0). FIG. 15 shows the actual and the observed fracture area growth.

Figure 16:
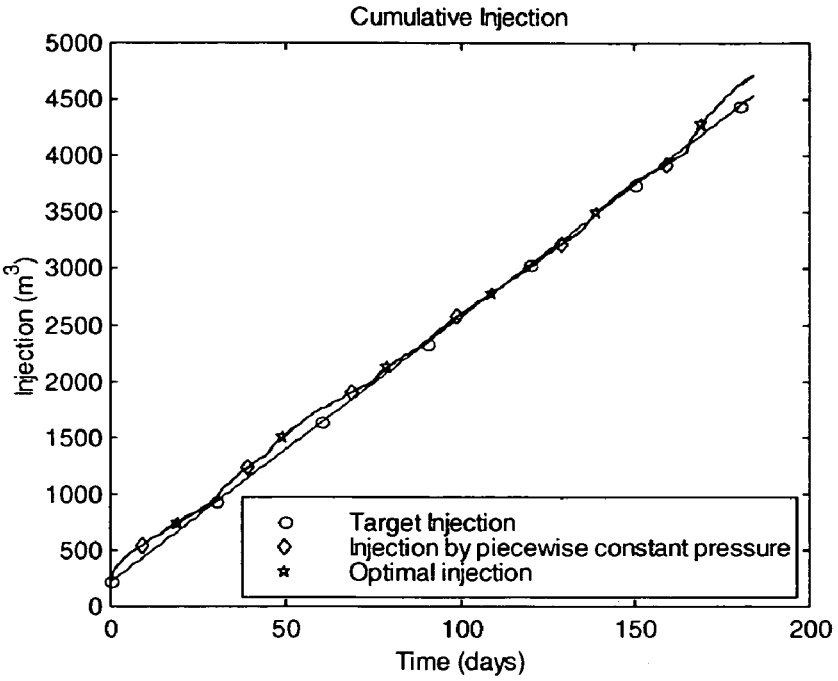
FIG. 16 Comparison between the cumulative injection produced by two modes of optimal control and the target injection.
Figure 17:
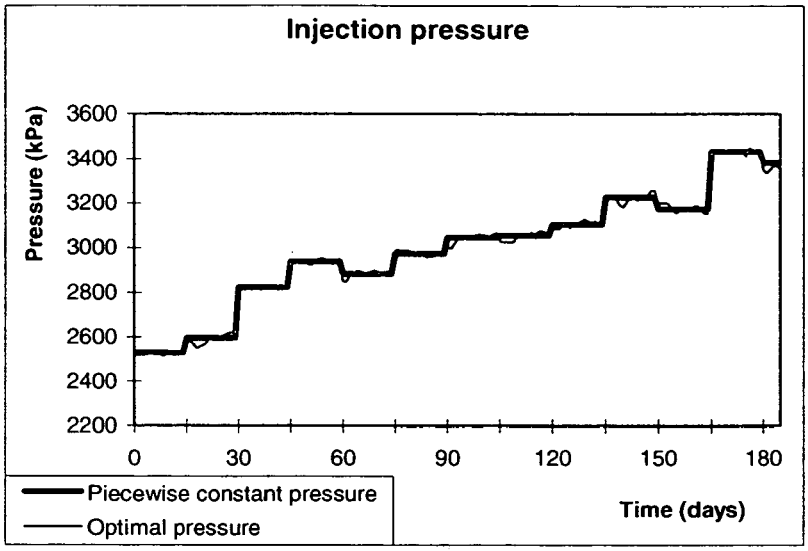
FIG. 17 PRIOR ART
FIG. 17 Two modes of optimal injection pressure.

The performance of the controller is illustrated in FIG. 16. Again, the distinction between the injection produced by the optimal pressure and the injection produced by piecewise constant optimal pressure is hardly visible. The difference between the target injection and the injection produced by the controller is still small. The injection pressure during the first six months is shown in FIG. 17. Again, the piecewise constant pressure and the pressure obtained by solving the system of integral equations (48)–(49) do not differ much.

Figure 18:
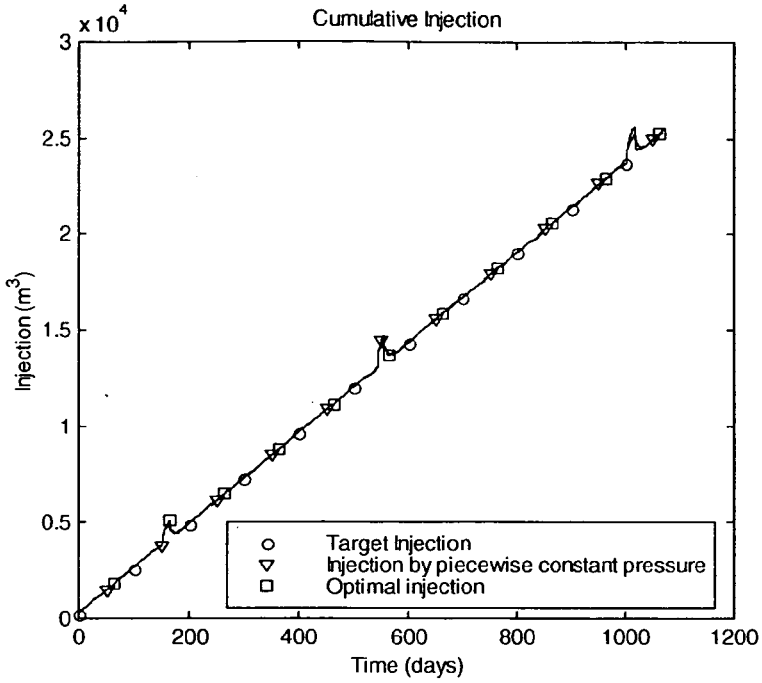
FIG. 18 Cumulative injection experiences perturbations at fracture extensions and then returns to a stable performance by the controller.
Figure 19:
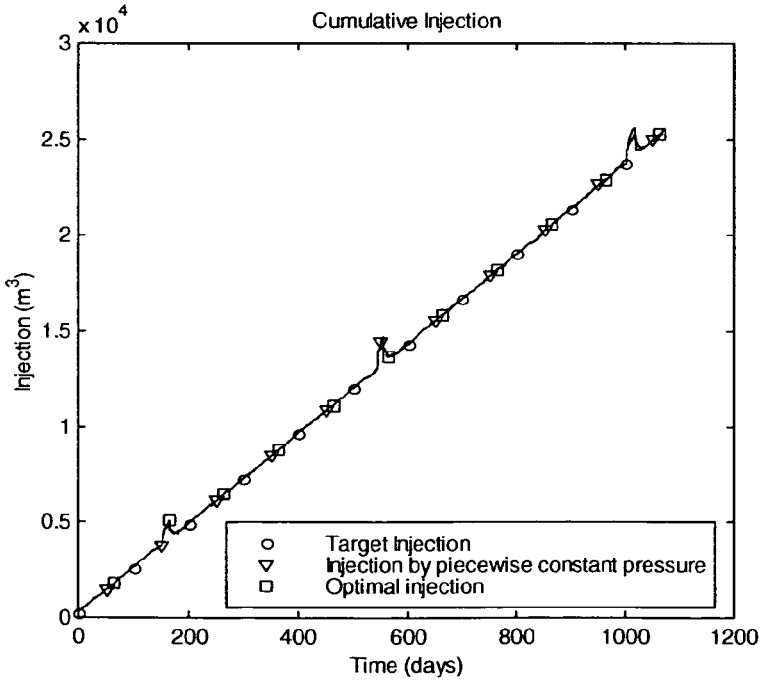
FIG. 19 Two modes of optimal injection pressure at the presence of fracture extensions.

Now, let us consider a situation where at certain moments the fracture may experience sudden and large extensions. In the forthcoming example, the fracture experienced three extensions during the first 3 years of injection. On the $152^{nd}$ day of injection its area momentarily increased by 80%, on the $545^{th}$ day it increased by 50%, and on the $1004^{th}$ day it further increased by another 30% (see FIG. 18). In the simulation the measurements were available with a 15-day delay and perturbed with a random error of up to 40% of A(0). At each moment of the fracture extension the controller reacted correctly and decreased the injection pressure accordingly, FIG. 19. The optimal pressure obtained from the solution to the system of integral equations (48)–(49) is more stable and the piecewise constant optimal pressure does not reflect the oscillations in the measurements due to its nature. The resulting cumulative injection also demonstrates stability with respect to the oscillations in the measurements. However, the injection rate, which is equal to the slope of the cumulative injection experiences abrupt changes, see FIG. 18.

The exactly optimal injection pressure presented in Eq. (65) is obtained by solving an integral equation (40) with respect to $p_{inj}(t)$. The main difficulty with implementation of this solution is that we need to know not only the fracture area, but its growth rate dA(t)/dt as well. Clearly, the latter parameter is extremely sensitive to measurement errors. In a continuous fracture growth model, an interpolation technique can be applied for estimating the extension rate. In a piecewise constant fracture growth model, Eq. (65) reduces to a much simpler Eq. (75). Therefore, in such a case the exactly optimal injection pressure can be obtained with little effort. However, since exactly optimal control is designed on entire time interval, from the very beginning of the operations, its performance can be strongly affected by perturbations in the input parameters caused by measurements errors. Moreover, each fracture extension is accompanied by a singularity in Eq. (75). Therefore, a control given by Eq. (65) or Eq. (75) can be used for qualitative studies, or as the function $p_*(t)$ in criterion (42), rather than for a straightforward implementation.

II.8 Control Model—Model Inversion into Fracture Area

As we remarked in the Introduction, the effective fracture area A(t) is the most difficult to obtain input parameter. The existing methods of its evaluation are both inaccurate and expensive. However, the controller itself is based upon a model and this model can be inverted in order to provide an estimate of A(t). Namely, equation (40) can be solved with respect to A(t). This solution can be used for designing the next control interval and passed to the controller for computing the injection pressure. If a substantial deviation of the computed injection rate from the actual one occurs, the control interval needs to be refreshed while the length of the extrapolation interval is kept small.

An obvious drawback of such an algorithm is the necessity of planning the control to the future. At the same time, as we have demonstrated above, a delay in the controller input is not detrimental to its performance if the control interval is small enough. Automated collection of data would reduce this delay to a value that results in definitely better performance than could be achieved with manual operations.

Figure 20A:
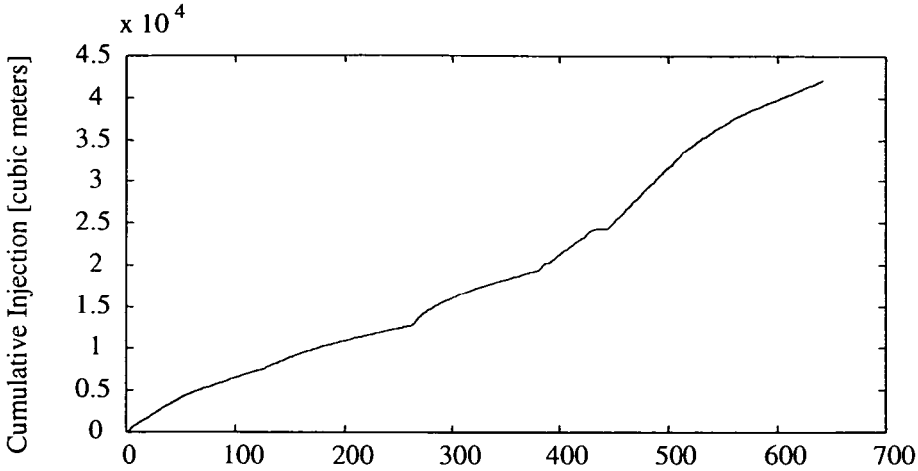
FIG. 20*a* Straightforward fracture growth estimation—cumulative injection versus time.
Figure 20B:
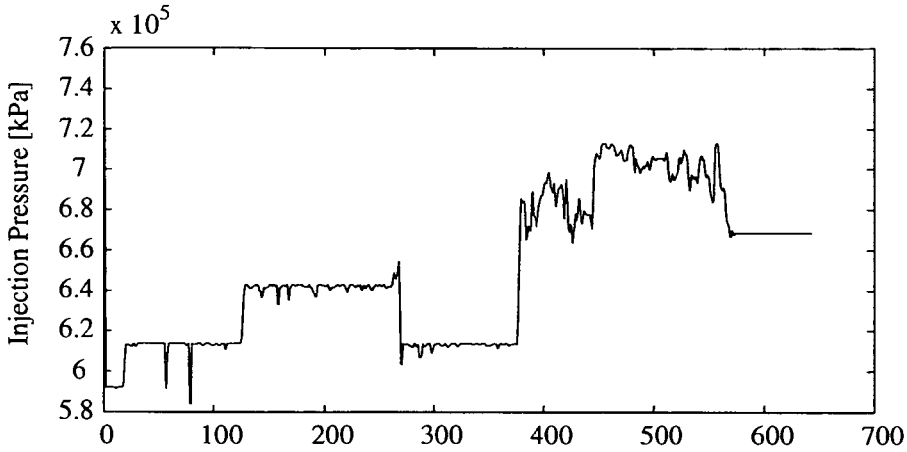
FIG. 20*b* Straightforward fracture growth estimation—injection pressure versus time.
Figure 20C:
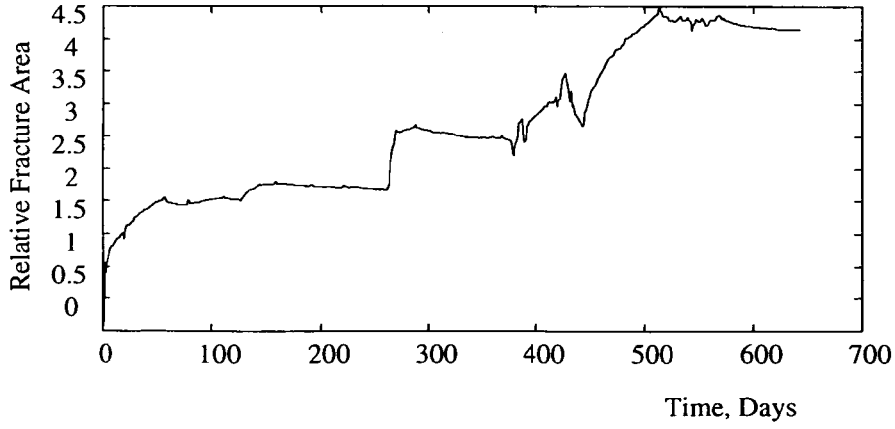
FIG. 20*c* Straightforward fracture growth estimation—relative fracture area versus time.
Figure 21:
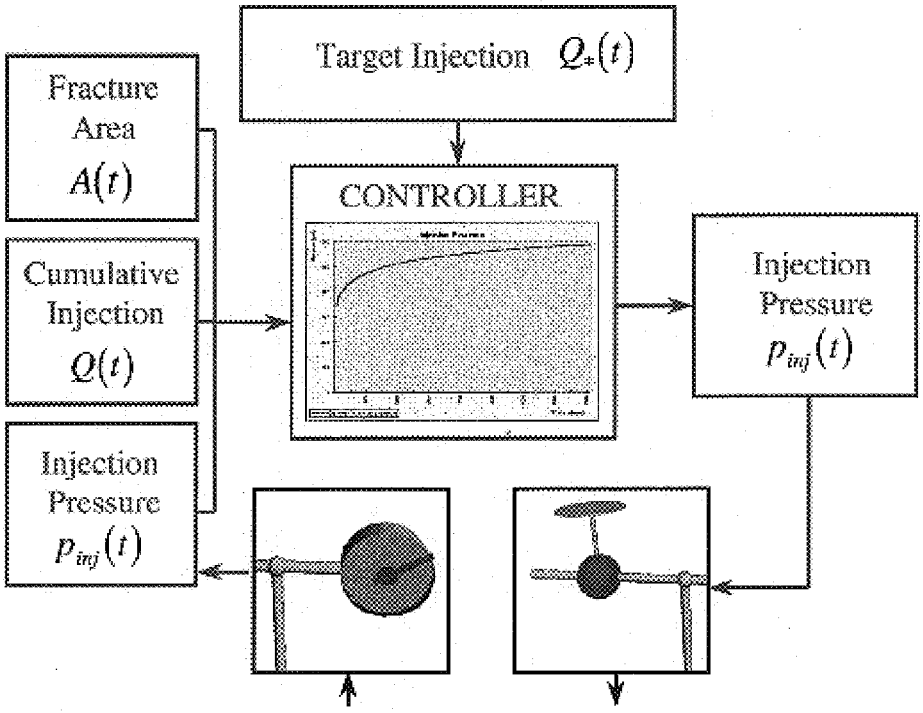
FIG. 21 PRIOR ART
FIG. 21 The controller schematic.

For a better fracture and formation properties status estimation a procedure similar to the well operations data analysis method developed in (Silin and Tsang, 2000) can be used. We will address this issue in more detail elsewhere. Here we just present an example of straightforward estimation algorithm based on Eq. (40), with FIG. 20 *a, b*, and *c*. FIG. 20*a* shows the plot of cumulative injection, FIG. 20*b* shows the injection pressure during 700 days of injection. The plot in FIG. 20*c* shows the calculated relative fracture area, i.e. the dimensionless area relative to the initial value. One can see that noticeable changes in injection conditions and hydrofracture status occurred between 200 and 300 days and after 400 hundred days of injection.

The advantage of the proposed procedure is in its cost. Because the injection and injection pressure data are collected anyway, the effective fracture area is obtained "free of charge." In addition, the computed estimate of the area is based on the same model as the controller, so it is exactly the required input parameter.

II.9 Control Model—Conclusions

A control model of water injection into a low-permeability formation has been developed. The model is based on Part 1 of this invention, also presented in (Silin and Patzek 2001), where the mass balance of fluid injected through a growing hydrofracture into a low-permeability formation has been investigated. The input parameters of the controller are the injection pressure, the injection rate and an effective fracture area. The output parameter is the injection pressure, which can be regulated by opening and closing the valve at the wellhead.

The controller is designed using principles of the optimal control theory. The objective criterion is a quadratic functional with a stabilizing term. The current optimal injection pressure depends not only on the current instantaneous measurements of the input parameters, but on the entire history of injection. Therefore, a genuine closed loop feedback control mode impossible. A procedure of control design on a relatively short sliding interval has been proposed. The sliding interval approach produces almost a closed loop control.

Several modes of control and several models of fracture growth have been studied. For each case a system of equations characterizing the optimal injection control has been obtained. The features affecting the solvability of such a system have been studied. We demonstrate that the pair of forward and adjoint systems can be represented in an operator form with a symmetric and positive definite operator. Therefore, the equations can be efficiently solved using standard iterative methods, e.g., the method of conjugate gradients.

The controller has been implemented as a computer simulator. The stable performance of the controller has been illustrated by examples. A procedure for inversion of the control model for estimating the effective fracture has been proposed.

III Control Model of Water Injection into a Layered Formation

III.1 Summary

Here we develop a new control model of water injection from a growing hydrofracture into a layered soft rock. We demonstrate that in transient flow the optimal injection pressure depends not only on the instantaneous measurements, but also on the whole history of injection and growth of the hydrofracture. Based on the new model, we design an optimal injection controller that manages the rate of water injection in accordance with the hydrofracture growth and the formation properties. We conclude that maintaining the rate of water injection into a low-permeability rock above a reasonable minimum inevitably leads to hydrofracture growth, to establishment of steady-state flow between injectors and neighboring producers, or to a mixture of both. Analysis of field water injection rates and wellhead pressures leads us to believe that direct links between injectors and producers can be established at early stages of waterflood, especially if the injection policy is aggressive. Such links may develop in thin highly permeable reservoir layers or may result from failure of the soft rock under stress exerted by injected water. These links may conduct a substantial part of injected water. Based on the field observations, we now consider a vertical hydrofracture in contact with a multi-layer reservoir, where some layers have high permeability and quickly establish steady state flow from an injector to neighboring producers.

The main result of this Part III is the development of an optimal injection controller for purely transient flow, and for mixed transient/steady-state flow in a layered formation. The objective of the controller is to maintain the prescribed injection rate in the presence of hydrofracture growth and injector-producer linkage. The history of injection pressure and cumulative injection, along with estimates of the hydrofracture size are the controller inputs. By analyzing these inputs, the controller outputs an optimal injection pressure for each injector. When designing the controller, we keep in mind that it can be used either off-line as a smart advisor, or on-line in a fully automated regime.

Because our controller is process model-based, the dynamics of actual injection rate and pressure can be used to estimate effective area of the hydrofracture. The latter can be passed to the controller as one of the inputs. Finally, a comparison of the estimated fracture area with independent measurements leads to an estimate of the fraction of injected water that flows directly to the neighboring producers through links or thief-layers.

III.2 Introduction

Our ultimate goal is to design an integrated system of field-wide waterflood surveillance and supervisory control system. As of now, this system consists of the Waterflood Analyzer, (De and Patzek 1999) and a network of individual injector controllers, all implemented in modular software. In the future, our system will incorporate a new generation of micro-electronic-mechanical sensors (MEMS) and actuators, subsidence monitoring from satellites, (De, Silin et al. 2000), and other revolutionary technologies.

It is difficult to conduct a successful waterflood in a soft low-permeability rock (Patzek 1992; Patzek and Silin 1998; Silin and Patzek 2001). On one hand, injection is slow and there is a temptation to increase the injection pressure. On the other hand, such an increase may lead to irrecoverable reservoir damage: disintegration of the formation rock and water channeling from the injectors to the producers.

In this Part III of the invention, we design an optimal controller of water injection into a low-permeability rock from a growing vertical hydrofracture. The objective of control is to inject water at a prescribed rate, which may change with time. The control parameter is injection pressure. The controller is based on the optimization of a quadratic performance criterion subject to the constraints imposed by the interactions between wells, the hydrofracture and the formation. The inputs include histories of cumulative volume of injected fluid, wellhead injection pressure, and relative hydrofracture area, as shown in FIG. 20*a*, FIG. 20*b* and FIG. 20*c*. The output, optimal injection pressure, is determined not only by the instantaneous measurements, but also by the history of observations. With time, however, the system "forgets" distant past by deleting relatively unimportant (numerically speaking) historical data points.

The wellhead injection pressures and rates are readily available if the injection water pipelines are equipped with pressure gauges and flow meters, and if the respective measurements are appropriately collected and stored as time series. It is now a common field practice to collect and maintain such data. The measurements of hydrofracture area are not as easily available. There are several techniques described in the literature. For example, references (Holzhausen and Gooch 1985; Ashour and Yew 1996; Patzek and De 1998) develop a hydraulic impedance method of characterizing injection hydrofractures. This method is based on the generation of low frequency pressure pulses at the wellhead or beneath the injection packer, and on the subsequent analysis of the reflected acoustic waves. An extensive overview of hydrofracture diagnostics methods has been presented in (Warpinski 1996). The theoretical background of fracture propagation was developed in (Barenblatt 1961).

The direct measurements of hydrofracture area with currently available technologies can be expensive and difficult to obtain. We define an effective fracture area as the area of injected water-formation contact in the hydrofractured zone. Clearly, a geometric estimate of the fracture size is insufficient to estimate this effective area.

We propose a model-based method of identification of the effective fracture area from the system response to the controller action. In order to implement this method, one needs to maintain a database of injection pressures and cumulative injection. As noted earlier, such databases are usually readily available and the proposed method does not impose extra measurement costs.

Earlier we proposed, (Patzek and Silin 1998; Silin and Patzek 2001), a model of linear transient, slightly compressible fluid flow from a growing hydrofracture into low-permeability, compressible rock. A similar analysis can be performed for heterogeneous layered rock. Our analysis of field injection rates and injection pressures leads to a conclusion that injectors and producers may link very early in a waterflood. Consequently, we expand our prior water injection model to include a hydrofracture that intersects multiple reservoir layers. In some of layers, steady-state flow develops between the injector and neighboring producers.

As in (Silin and Patzek 2001), here we consider slow growth of the hydrofracture during water injection, not a spur fracture extension during initial fracturing job. Our analysis involves only the volumetric balance of injected and withdrawn fluids. We do not try to calculate the shape or the orientation of hydraulic fracture from rock mechanics because they are not needed here.

The control procedure is designed in the following way. First, we determine what cumulative injection (or, equivalently, injection rate) is the desirable goal. This decision can be made through a waterflood analysis (De and Patzek 1999), reservoir simulation, and from economical considerations. Second, by analyzing the deviation of actual cumulative injection from the target cumulative injection, and using the estimated fracture area, the controller determines the injection pressure, which minimizes this deviation. Control is applied by adjusting a flow valve at the wellhead and it is iterated in time, as shown in FIG. 20 *a, b*, and *c*.

The convolution nature of the model prevents us from obtaining the optimal solution as a genuine feedback control and designing the controller as a standard closed-loop system. At each time step, we have to account for the previous history of injection. However, the feedback mode may be imitated by designing the control on a relatively short interval that slides with time. When an unexpected event happens, e.g., a sudden fracture extension occurs, a new sliding interval is generated and the controller is refreshed. These unexpected events are detected using fracture diagnostics described elsewhere in this invention.

Our controller is process model-based. Although we cannot predict yet when and how the fracture extensions occur, the controller automatically takes into account the effective fracture area changes and the decline of the pressure gradient caused by gradual saturation of the surrounding formation with injected water. The concept of effective fracture area implicitly accounts for the change of permeability in the course of operations.

This Part III is organized as follows. First, we review a modified Carter's model of transient water injection from a growing hydrofracture. Second, we extend this model to incorporate the case of layered formation with possible channels or thief-layers. Third, we illustrate the model by several field examples. Fourth, we formulate the control problem and present a system of equations characterizing optimal injection pressure. We briefly elaborate on how this system of equations can be solved for different models of hydrofracture growth, as already described above. Finally, we extend our analysis of the control model to the case of layered reservoir with steady-state flow in one or several layers.

III.3 Modified Carter's Model

Figure 31:
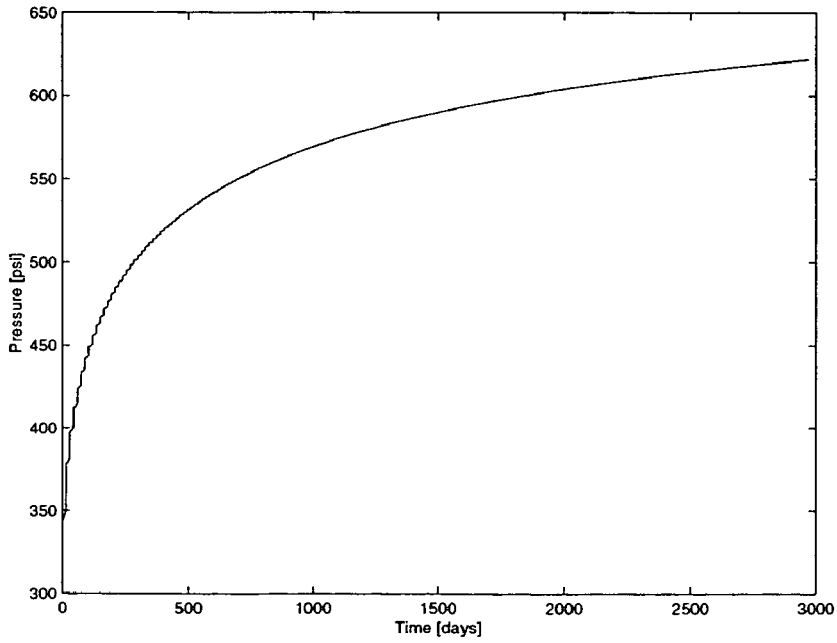
FIG. 31 Optimal injection pressures when hydrofracture grows as the square root of time.
Figure 32:
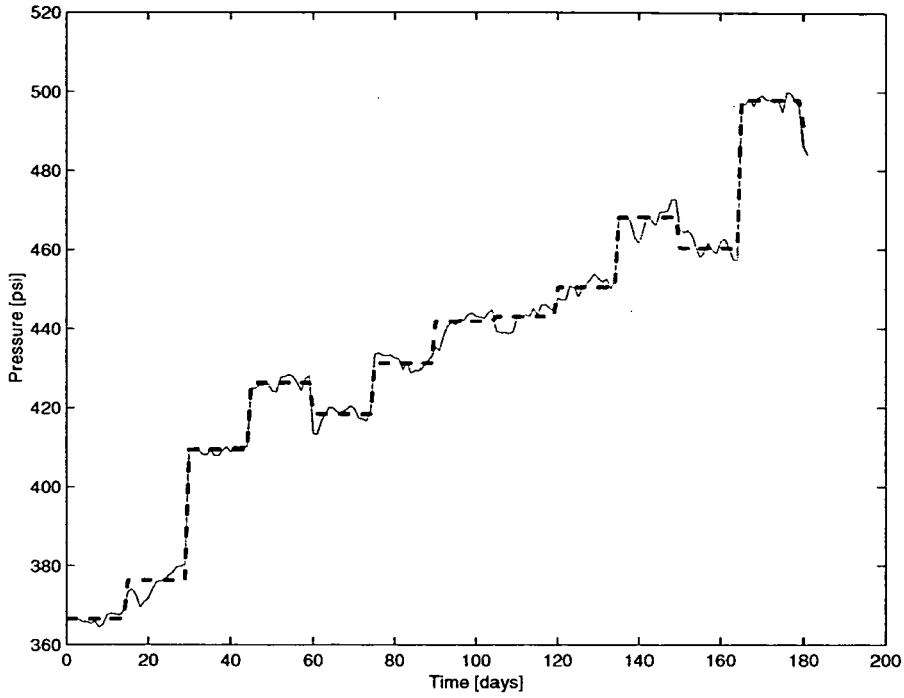
FIG. 32 Optimal (solid line) and piecewise constant (dashed line) injection pressures if fracture area is estimated with random disturbances.
Figure 33:
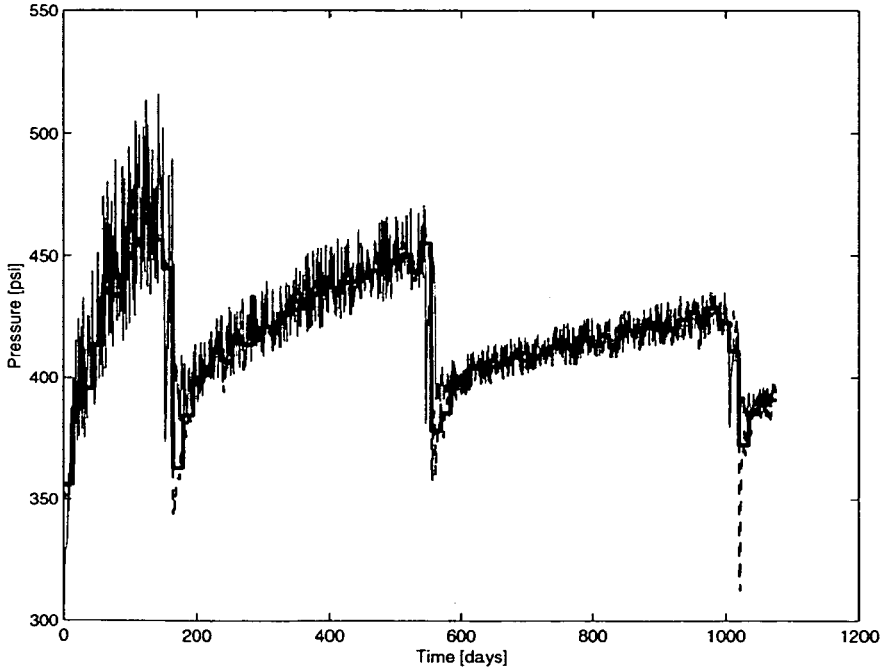
FIG. 33 Three modes of optimal pressure when fracture area is measured with delay and random disturbances while the fracture experiences extensions (see FIG. 34), where the jagged line plots exact optimal pressure, the solid line plots piecewise constant optimal pressure and the dashed line plots the optimal pressure obtained by solving system of equations (105)–(106)
Figure 34:
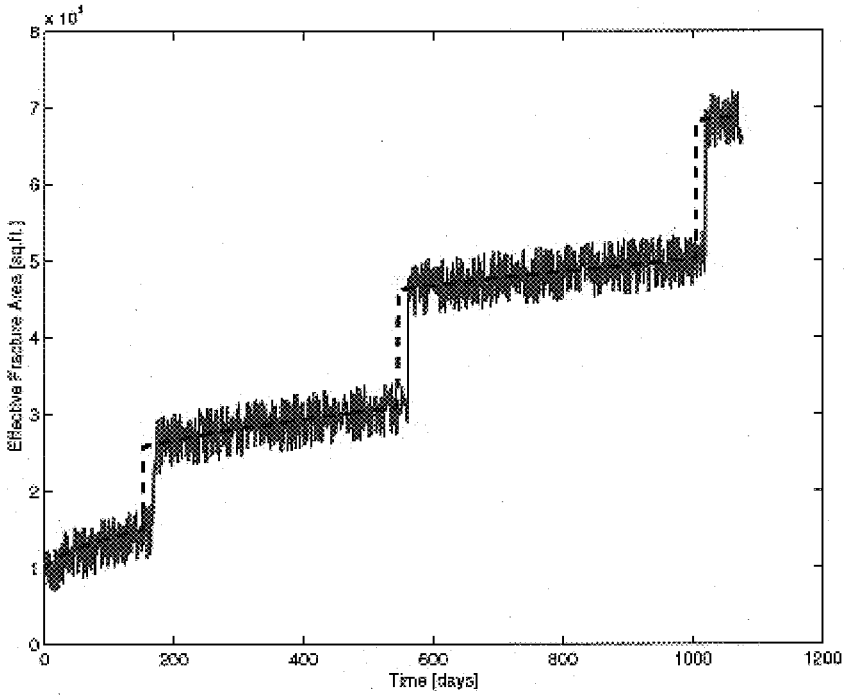
FIG. 34 Fracture growth with several extensions (dashed line), where the hydrofracture area is measured with random noise and delay (jagged line).

We assume transient linear flow from a vertical hydrofracture through which a slightly compressible fluid (water) is injected perpendicularly to the fracture faces, into the surrounding uniform rock of low permeability. The fluid is injected under a uniform pressure, which depends on time. In this context, "transient" means that the pressure distribution in the formation is changing with time and, e.g., maintaining a constant injection rate requires variable pressure. A typical pressure curve for a constant injection rate confirmed by numerous field observations is presented in FIG. 31. Under these assumptions, the cumulative injection can be calculated from the following equation (Patzek and Silin 1998; Silin and Patzek 2001):

$$Q(t) = wA(t) + 2\frac{kk_{rw}}{\mu_w\sqrt{\pi\alpha_w}}\int_0^t \frac{(p_{inj}(\tau) - p_i)A(\tau)}{\sqrt{t-\tau}}\,d\tau \tag{81}$$

Here k and $k_{rw}$ are, respectively, the absolute rock permeability and the relative water permeability in the formation outside the fracture, and $\lambda_w$ is the water viscosity. Parameters $\alpha_w$ and $p_i$ denote the hydraulic diffusivity and the initial pressure in the formation. The effective fracture area at time t is measured as A(t), and its constant width is denoted by w. Thus, the first term on the right-hand side of Eq. (81) represents the volume of injected fluid necessary to fill the fracture. This volume is small in comparison with the second term. We assume that the permeability inside the hydrofracture is much higher than the surrounding formation permeability, so at any time the pressure drop along the fracture is negligibly small. We introduce A(t) as an effective fracture area because the water-phase permeability may change with time due to formation plugging (Barkman and Davidson 1972) and increasing water saturation. In addition, the injected water may not fill the entire fracture volume. Therefore, in general, A(t) is not equal to the geometric area of the hydrofracture.

From Eq. (81) it follows that the initial value of the cumulative injection is equal to wA(0). The control objective is to keep the injection rate q(t) as close as possible to a prescribed target injection rate $q_*(t)$. Since Eq. (81) is formulated in terms of cumulative injection, it is more convenient to formulate the optimal control problem in terms of target cumulative injection:

$$Q*(t) = Q*(0) + \int_0^t q*(\tau)\,d\tau \tag{82}$$

If control maintains the actual cumulative injection close to $Q_*(t)$, then the actual injection rate is close to $q_*(t)$ on average.

III.4 Carter's Model for Layered Reservoir

We assume transient linear flow from a vertical hydrofracture injecting an incompressible fluid into the surrounding formation. The flow is perpendicular to the fracture faces. The reservoir is layered and there is no cross-flow between the layers. We also assume that the initial pressure distribution is hydrostatic. The vertical pressure variation inside each layer is neglected. Denote by N the number of layers and let $h_i$, i=1,2, . . . ,N, be the thickness of each layer. The area of the fracture in layer i is equal to $$A_i(t) = a_i \frac{h_i}{h_i} A(t) \tag{83}$$

where $h_t$ is the total thickness of injection interval:

$$h_t = \sum_{j=1}^{N} h_j,$$

and $a_i$ is a dimensionless coefficient characterizing fracture propagation in layer i. In those layers where the fracture propagates above average, we have $a_i>1$, whereas where the fracture propagates less, we have $a_i<1$. Clearly, the following condition is satisfied:

$$A_i(t) = \frac{h_i}{\sum_{j=1}^{N} h_j} A(t) \tag{84}$$

The injected fluid pressure $p_{inj}(t)$ depends on time t. If the permeability and the hydraulic diffusivity of layer i are equal, respectively, to $k_i$ and $\alpha_{wi}$, then cumulative injection into layer i is given by the following equation, (Patzek and Silin 1998; Silin and Patzek 2001):

$$Q_i(t) = wA_i(t) + 2\frac{k_i k_{rw_i}}{\mu_w\sqrt{\pi\alpha_{wi}}}\int_0^t \frac{(p_{inj}(\tau) - p_{init})A_i(\tau)}{\sqrt{t-\tau}}\,d\tau \tag{85}$$

Equation (85) is valid only in layers with transient flow. The layers where steady-state flow has been established must be treated differently. Note that in general the relative permeabilities $k_{rw_i}$ may vary in different layers. By assumption, the difference $p_{inj}-p_{init}$ is the same in all layers. Summed up for all i, and with Eq. (83), Eq. (85) implies:

$$Q(t) = wA(t) + 2\frac{\bar{k}}{\mu_w\sqrt{\pi}}\int_0^t \frac{(p_{inj}(\tau) - p_{init})A(\tau)}{\sqrt{t-\tau}}\,d\tau \tag{86}$$

where $$\bar{k} = \frac{1}{h_t}\sum_{i=1}^{N} a_i h_i \frac{k_i k_{rw_i}}{\sqrt{\alpha_{wi}}} \tag{87}$$

is the thickness- and hydraulic-diffusivity-averaged reservoir permeability.

From Eqs. (85)–(87) it follows that the portion of injected water entering layer i is $$Q_i(t) = \frac{wa_i h_i}{h_t}A(t) + \frac{k_i k_{rw_i} a_i h_i}{\mu_w\sqrt{\alpha_{wi}}\,h_t}\int_0^t \frac{(p_{inj}(\tau) - p_{init})A(\tau)}{\sqrt{t-\tau}}\,d\tau \tag{88}$$

Now, assume that all N layers fall into two categories: the layers with indices $i\epsilon I=\{i_1,i_2, . . . ,i_T\}$ are in transient flow, whereas the layers with indices $j\epsilon J=\{j_1,j_2, . . . ,j_S\}$ are in steady-state flow, i.e., a connection between the injector and producers has been established. From Eq. (88) we infer that the total cumulative injection into transient-flow layers is $$Q_I(t) = \sum_{i\in I}\frac{wa_i h_i}{h_t}A(t) + \sum_{i\in I}\frac{k_i k_{rw_i} a_i h_i}{\mu_w\sqrt{\alpha_{wi}}\,h_t}\int_0^t \frac{(p_{inj}(\tau) - p_{init})A(\tau)}{\sqrt{t-\tau}}\,d\tau \tag{89}$$

By definition, the sets of indices I and J are disjoint and together yield all the layer indices {1,2, . . . ,N}. It is natural to assume that the linkage is first established in the layers with highest permeability, i.e.

$$\min_{j\in J}(kk_{rw})_j > \max_{i\in I}(kk_{rw})_i \tag{90}$$

The flow rate in each layer from set J is given by $$q_j(t) = \frac{k_j k_{rw_j} A_j(t)}{\mu_w}\,\frac{p_{inj}(t) - p_{pump}(t)}{L_j} \tag{91}$$

where $L_j$ is the distance between the injector and its neighboring producer linked through layer j and $P_{pump}(t)$ is the down hole pressure at the producer. Here, for simplicity, we assume that all flow paths on one side of the hydrofracture connect the injector under consideration to one producer. The total flow rate into the steady-state layers is $$q_j(t) = (p_{inj}(t) - p_{pump}(t))A(t)\sum_{j\in J}\frac{k_j k_{rw_j} a_j h_j}{\mu_w h_t L_j} \tag{92}$$

Since circulation of water from an injector to a producer is not desirable, we come to the following requirement: $q_j(t)$ should not exceed an upper admissible bound $q_{adm}$: $q_j(t) \leqq q_{adm}$. Evoking Eq. (92), one infers that the following constraint is imposed on the injection pressure:

$$p_{inj}(t) \leqq p_{adm}(t), \tag{93}$$

where the admissible pressure $p_{adm}(t)$ is given by $$p_{adm}(t) = p_{pump}(t) + \frac{q_{adm}}{A(t)\sum_{j\in J}\frac{k_j k_{rw_j} a_j h_j}{L_j \mu_w h_t}} \tag{94}$$

Equation (94) leads to an important conclusion. Earlier we have demonstrated that injection into a transient-flow layer is determined by a convolution integral of the product of the hydrofracture area and the difference between the injection pressure and initial formation pressure. In transient flow, water injection rate does increase with the injector hydrofracture area, but water production rate does not. In contrast, from Eqs. (92) and (94) it follows that as soon as linkage between an injector and producer occurs, a larger fracture area increases the rate of water recirculation from the injector to the producer. At the initial transient stage of waterflood, a hydrofracture plays a positive role, it helps to maintain higher injection rate and push more oil towards the producing wells. With channeling, the role of the hydrofracture is reversed. The larger the hydrofracture area, the more water is circulated between injector and producers. As our analysis of actual field data shows, channeling is almost inevitable, sometimes at remarkably early stages of waterflood. Therefore, it does matter how the initial hydrofracturing job is done and how the waterflood is initiated. An injection policy that is too aggressive will result in a "fast start" of injection, but may cause severe problems later on, sometimes very soon. The restriction imposed by Eq. (94) on admissible injection pressure is more severe for a low-permeability reservoir with soft rock. In such a reservoir, there are no brittle fractures, but rather an ever-increasing rock damage, which converts the rock into a pulverized "process-zone". At the same time, well spacing in low-permeability reservoirs can be as small as 50 ft between the wells. Both these factors cause the admissible pressure in Eq. (94) to be less.

III.5 Field Examples

In this section, we illustrate the model of simultaneous transient and steady state flow by several examples. We assume that some of the relevant parameters do not vary in time arbitrarily, but are piecewise constant. Although such an assumption may not be valid in some situations, the field examples below show that the calculations match the data quite well and the assumption is apparently fulfilled.

Let us consider a situation where the injection pressure, the hydrofracture effective area, and the effective cross-section area of flow channels are piecewise constant functions of time. We also assume that the pump pressure at the linked producer is also a piecewise constant function of time. In fact, for the conclusions below it is sufficient that the aggregated parameters $$Y(t) = \sum_{j\in J}\frac{k_j k_{rw_j} a_j h_j}{\mu_w L_j h_t}(p_{inj}(t) - p_{pump}(t))A(t) \text{ and} \tag{95}$$

$$Z(t) = \sum_{i\in I}\frac{k_i k_{rw_i} a_i h_i}{\mu_w \sqrt{a_{wi}}\, h_t}(p_{inj}(t) - p_{init})A(t)$$

are piecewise constant functions of time, whereas individual terms in both equations (95) can vary arbitrarily. Let t be cumulative time measured from the beginning of observations, and denote by $$0=\theta_0<\theta_1<\theta_2<\ldots, \tag{96}$$

the time instants when either $Y^*(t)$ or $Z(t)$ changes its value. Further on, let $Y_i$ and $Z_i$ be the values which functions $Y(t)$ and $Z(t)$, respectively, take on in the interval $[\theta_{i-1},\theta_i]$, $i=1,2,\ldots$. Then, from Eqs. (89) and (92), the cumulative injections into the transient-flow ($Q_T$) and steady-state-flow ($Q_S$) layers are given by the following equations:

$$Q_S(t) = \sum_{i>0} Y_i((t-\theta_{i-1})_+ - (t-Q_i)_+) \text{ and} \tag{97}$$

$$Q_T(t) = \sum_{i>0} Z_i\left(\sqrt{(t-\theta_{i-1})_+} - \sqrt{(t-\theta_i)_+}\right)$$

where $(t)_* = \max\{0,t\}$. In Eq. (97), we neglect the volume of liquid residing inside the hydrofracture itself. Thus, for the total cumulative injection we get $$Q(t) = Q_T(t) + Q_S(t) = \sum_{i>0}\left[Y_i((t-\theta_{i-1})_+ - (t-\theta_i)_+) + Z_i\left(\sqrt{(t-\theta_{i-1})_+} - \sqrt{(t-\theta_i)_+}\right)\right] \tag{98}$$

Note that only the terms where $\theta_i<t$ are nonzero in Eqs (97) and (98), so that, for instance, $$Q_1(t)=Y_1 t \text{ and } Q_T(t)=Z_1\sqrt{t} \text{ for } 0<t<\theta_1 \tag{99}$$

The ratio between the respective $Y_i$ and $Z_i$ measures the distribution of the injected liquid between transient and steady state layers. If $Y_i >> Z_i$, then the injection is mostly transient. If, conversely, $Y_i << Z_i$, the flow is mostly steady state, and waterflooding is reduced essentially to water circulation between injectors and producers. The value $$T_i = \left(\frac{Z_i}{Y_i}\right)^2 \tag{100}$$

has the dimension of time. It has the following meaning. In the sum $Yt+Z\sqrt{t}$, which characterizes the distribution of the entire flow between steady-state and transient flow regimes, at early times the square root term dominates. Later on, both terms equalize, and at still larger t the linear term dominates.

The ratio (100) provides a characteristic time of this transition and it can be used as a criterion to distinguish between the flow regimes.

If additional information about the hydrofracture size, the reservoir, the hydrofracture layers, the absolute and relative permeabilities of individual layers, bottomhole injection and production pressures, and initial formation pressure, etc., were available, further quantitative analysis could be performed based on Eqs. (89), (92) and (95). Here we perform estimates of the aggregated coefficients (95) only.

Put $$\psi_{S,i}(t)=(t-\theta_{i-1})_+-(t-\theta_i)_+ \text{ and}$$

$$\psi_{T,i}=(t)=\sqrt{(-\theta_{i-1})_+}-\sqrt{(t-\theta_i)_+}, i=1,2,\ldots \tag{101}$$

then from equation (98) it follows that $$Q(t)=\sum_{i>0}[Y_i\psi_{S,i}(t)+Z_i\psi_{T,i}(t)] \tag{102}$$

If a well is equipped with a flow meter, then coefficients $Y_i$ and $Z_i$ can be estimated to match the measured cumulative injection curve with the calculated cumulative injection using Eqs. (101) and (102). Mathematically, it means solving a system of linear equations with respect to $Y_i$, $Z_i$ implied by minimum of the following quadratic target function:

$$F=\frac{1}{N}\sum_{n=1}^{N}\left(Q_M(t_n)-\sum_{i>0}[Y_i\psi_{S,i}(t_n)+Z_i\psi_{T,i}(t_n)]\right)^2 \tag{103}$$

Here $t_1$, $t_2$, etc., are the measurement times. The instants of time $\theta_i$, see Eq. (98), can be selected based on the information about the injection pressure and the jumps of injection rate.

Figure 22:
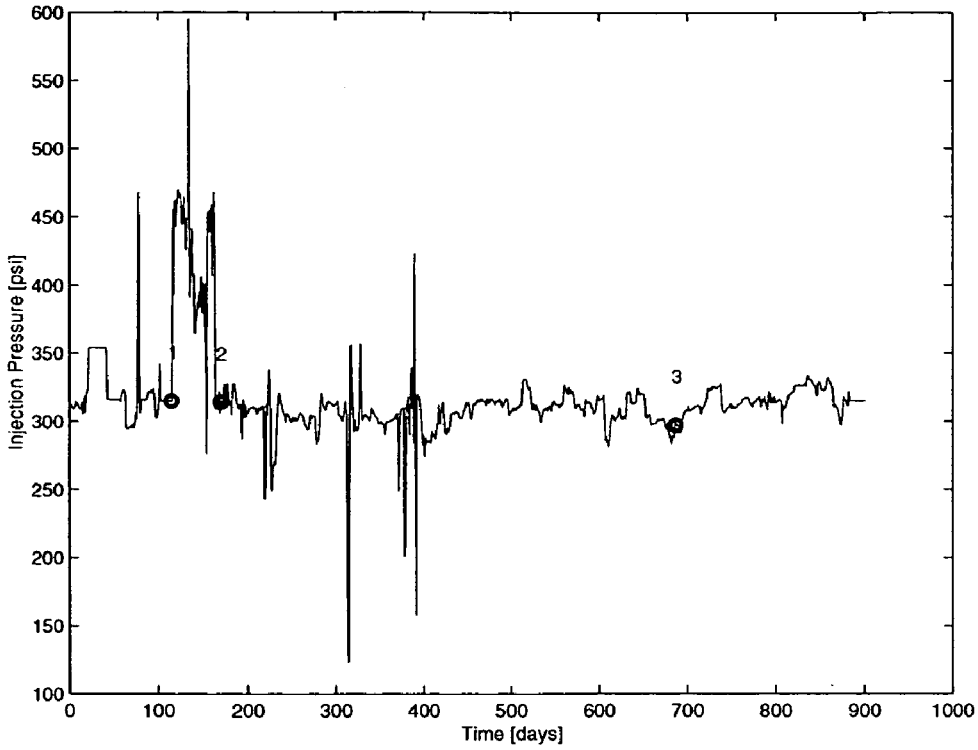
FIG. 22 Well "A" injection pressure.
Figure 23:
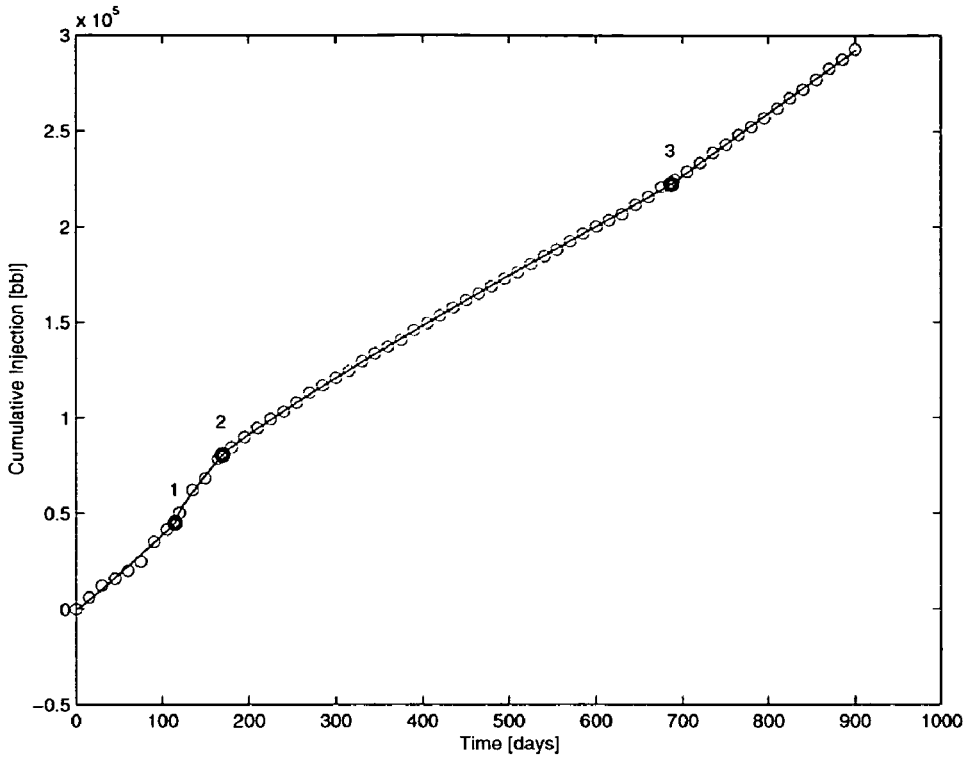
FIG. 23 Well "A" cumulative injection versus time, indicating that waterflooding is dominated by steady-state linkage with a producer where circles represent data, and the solid line represents computations.
Figure 24:
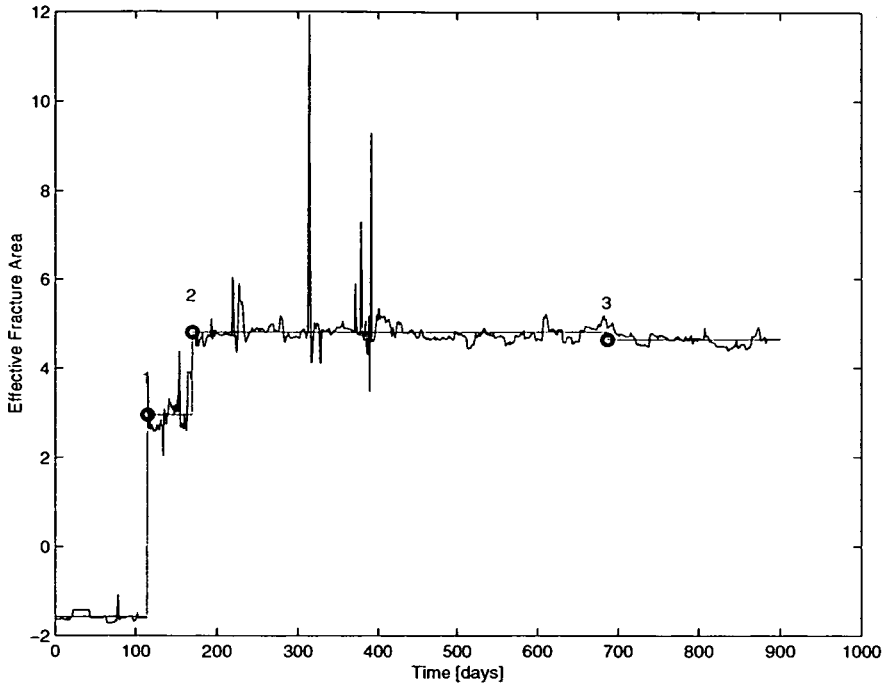
FIG. 24 Well "A" effective fracture area calculated using measured pressures (jagged line) and injection pressures averaged over respective intervals.
Figure 25:
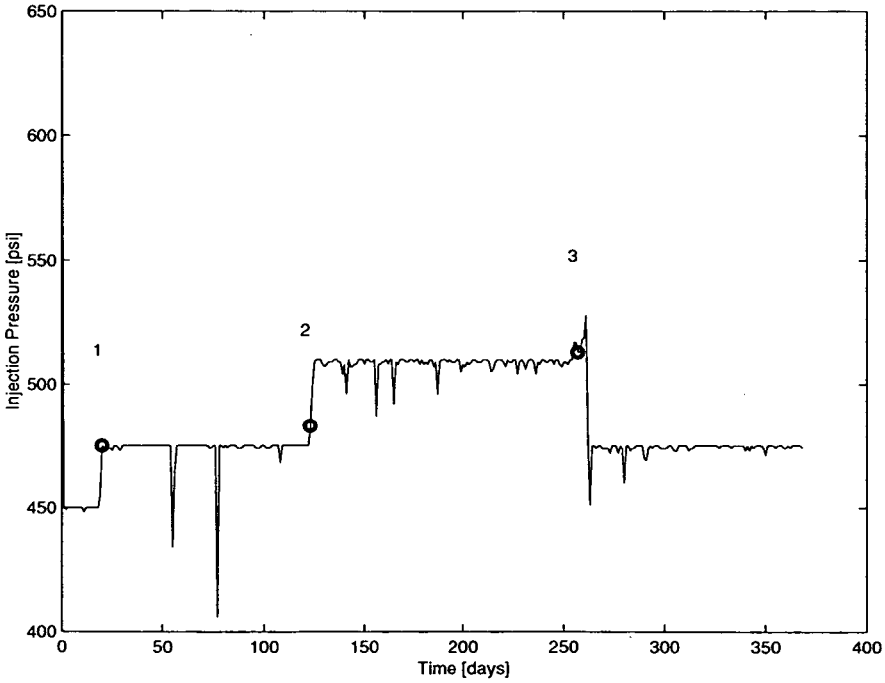
FIG. 25 Well "B" measured injection pressures versus time.
Figure 26:
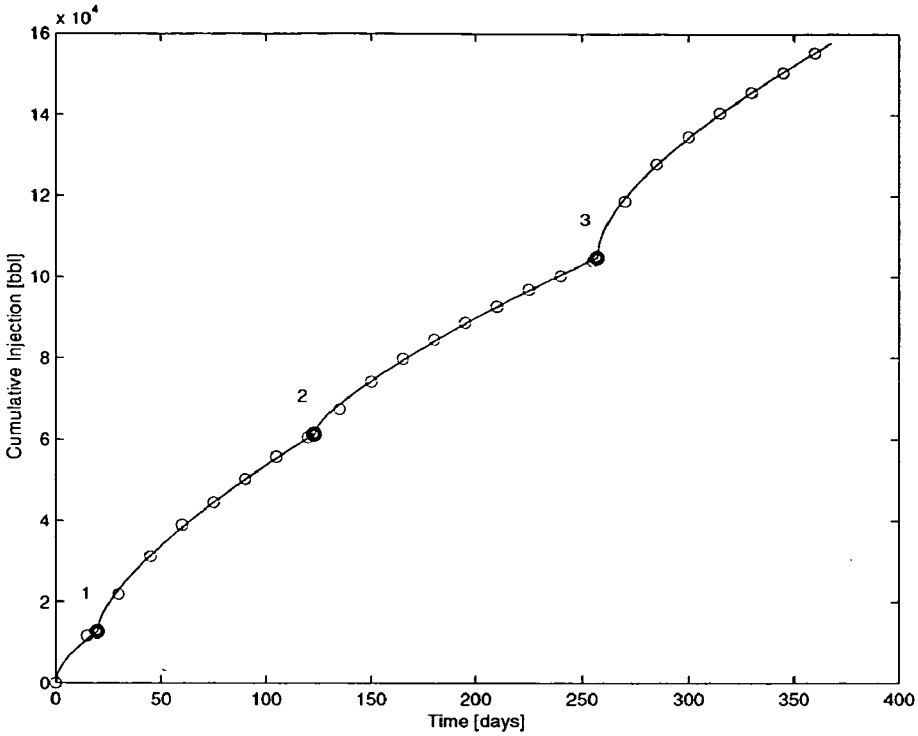
FIG. 26 Well "B" waterflooding is dominated by transient flow with possible hydrofracture extensions where circles represent data, and the solid line represents computations.
Figure 27:
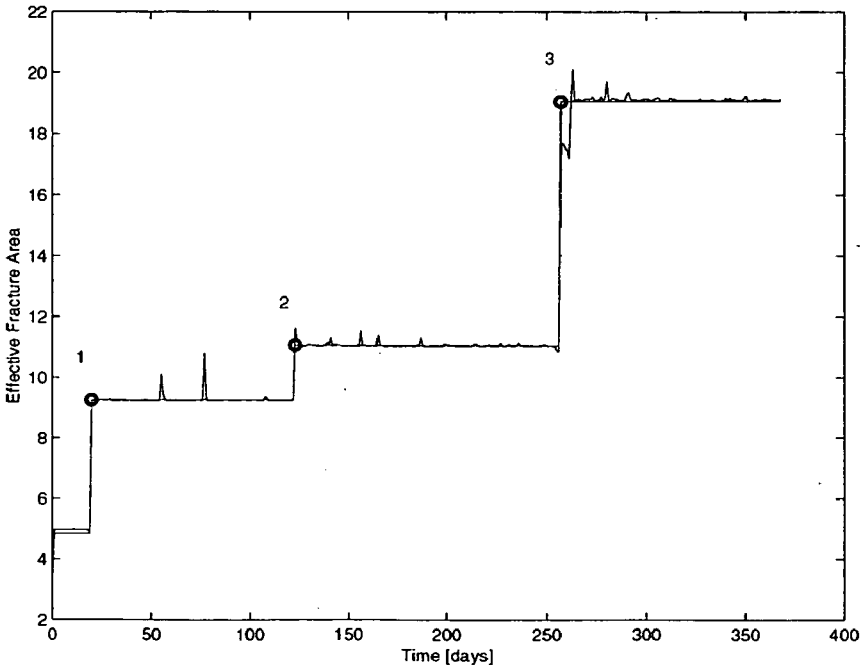
FIG. 27 Well "B" effective fracture area calculated using measured pressures (slightly jagged line) and injection pressures averaged over respective intervals almost coincide.
Figure 28:
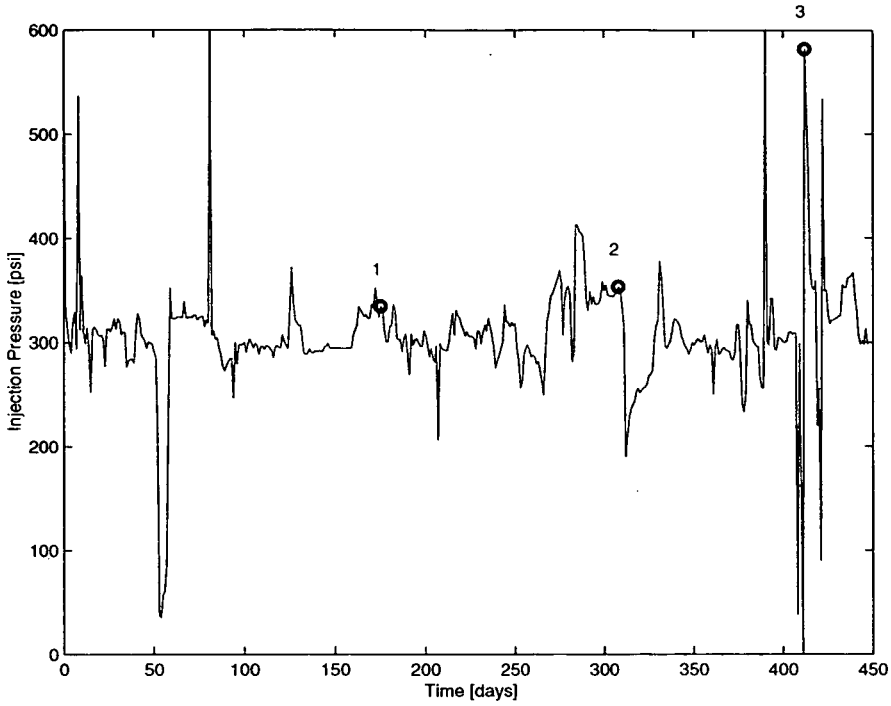
FIG. 28 Well "C" injection pressure has numerous fluctuations with no apparent behavior pattern.
Figure 29:
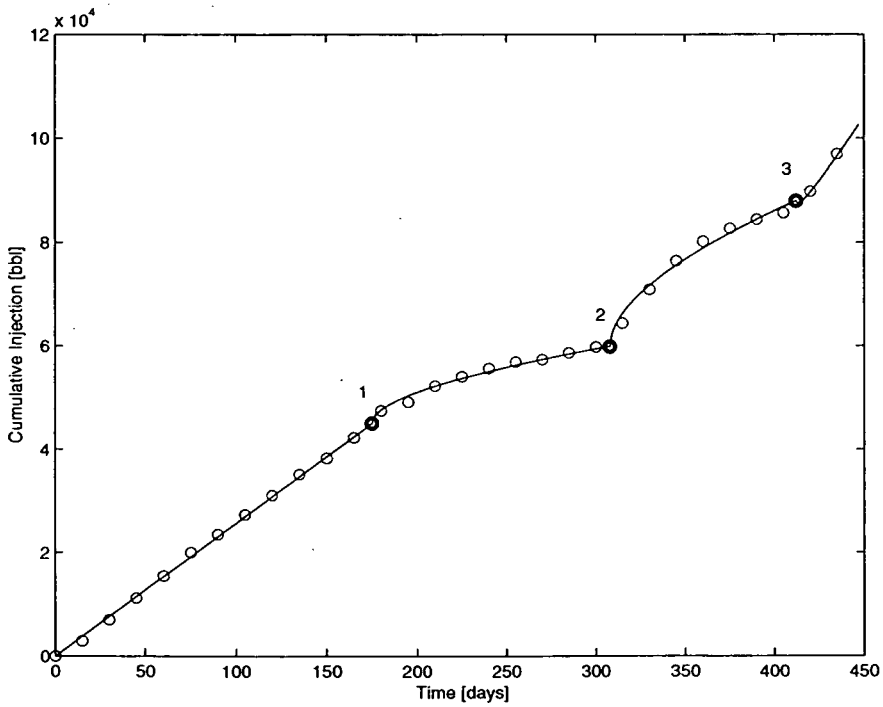
FIG. 29 Well "C" waterflooding has a mixed character where periods of transient flow are alternated with periods of mostly steady-state flow where circles represent data, and the solid line represents computations.
Figure 30:
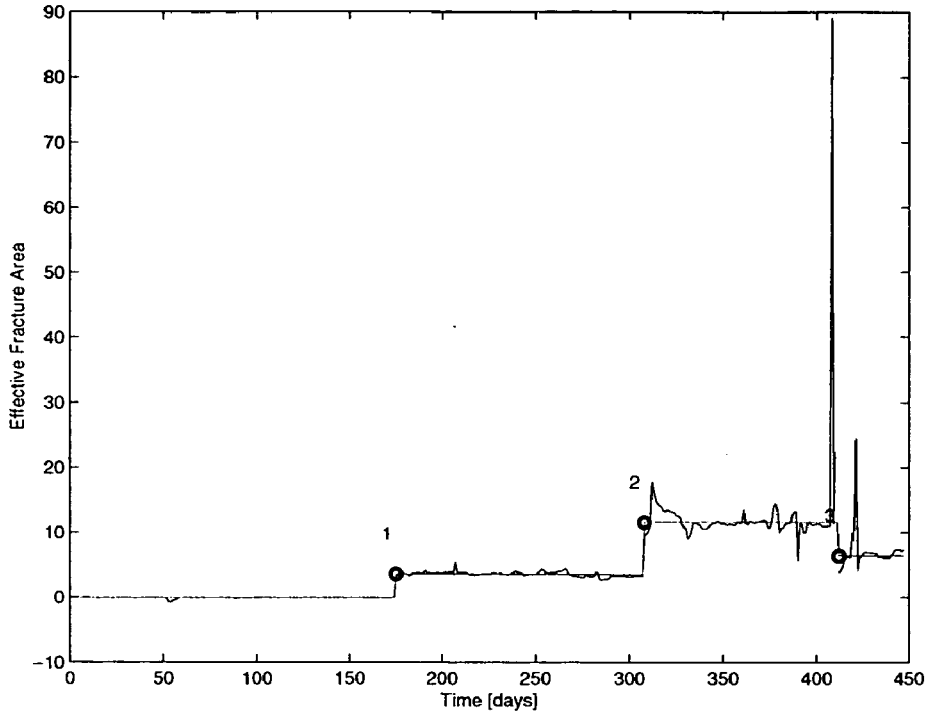
FIG. 30 Well "C" effective fracture area calculated using measured pressures (jagged line) and injection pressures averaged over respective intervals, indicating with the zero initial area estimates an implied possible linkage to a producer resulting in mostly steady-state flow.

Several water injectors in a diatomaceous oil field in California have been analyzed for the flow regimes. In FIG. 24–FIG. 30 we present examples of cumulative injection matches. In each case, we selected three values, $\theta_1$ through $\theta_3$, and obtained good fits of the field data. The time intervals are different for different wells according to the availability of data. The calculated coefficients $Y_i$, $Z_i$ are listed in Table 2, and the characteristic times (100) in Table 3. Matching the cumulative injection at early times is problematic because there is no information about well operation before the beginning of the sampled interval. From Eq. (89), it is especially true for wells with large hydrofractures. This explains why $Z_1$ is negative for wells "A" and "C". The negative value of $Y_4$ for well B cannot be interpreted this way, but the magnitude $|Y_4|$ is about 0.25% of the value of $|Z_4|$, well below the accuracy of the measurements, so $Y_4$ is equal to zero. Comparative analysis of the three wells leads to the following conclusions. Well A (FIG. 22–FIG. 24) has the lowest values of the characteristic times (100) in all three time intervals, and demonstrates behavior typical for a well with steady state flow. Apparently, a major breakthrough occurred at an early time, and a large portion of the injected water is circulated between this injector and the neighboring producers. Conversely, Well B (FIG. 25–FIG. 27) demonstrates a typical transient flow behavior. However, the growth of $Z_i$ from early to later times indicates that the hydrofracture could experience dramatic extensions at points 1 and 3 and a moderate extension at point 2, FIG. 27. In Well C (FIG. 28–FIG. 30), we recognize transient flow between points 1 and 3, with a fracture extension at point 2, FIG. 29–FIG. 30. The small value of $T_1$ (Table 3) may indicate presence of a small channel, which is later plugged due to the rock damage during fracture extension at time 1. The decreasing values $T_{2,3,4}$ indicate an increasing steady-state flow component ending up with mostly water recirculation after time 3.

III.6 Control Model

To formulate the optimal control problem, we must choose a performance criterion for the process described by Eq. (81). Suppose that we are planning to apply control on a time interval $[\theta,T]$, where $T>\theta\geqq 0$. In particular, we assume that the cumulative water injection and the injection pressure are known on interval $[0,\theta]$, along with the effective fracture area A(t). On interval $[\theta,T]$, we want to apply such an injection pressure that the resulting cumulative injection will be as close as possible to that given by Eq. (41). This requirement may be formulated as follows:

Minimize $$J[p_{inj}]=\frac{1}{2}\int_\theta^T w_q(t)(Q(t)-Q_*(t))^2\,dt+\frac{1}{2}\int_\theta^T w_p(t)(p_{inj}(t)-p_*(t))^2\,dt \tag{104}$$

subject to constraint given by Eq. (81).

The weight-functions $w_p$ and $w_q$ are positive. They reflect the trade-off between the closeness of actual cumulative injection Q(t) to the target $Q_*(t)$, and the well-posedness of the optimization problem. For small values of $w_p$, minimization of Eq. (42) forces Q(t) to follow the target injection strategy, $Q_*(t)$. However, if $w_p$ is too small, then the problem of minimization of Eq. (42) becomes ill-posed (Warpinski 1996), (Wright and A. 1995). Moreover, the function $w_p$ is in a denominator in equation (106) below, which characterizes the optimal control. Therefore, computational stability of this criterion deteriorates as $w_p$ approaches zero. At the same time, if we consider a specific mode of control, e.g., piecewise constant control, then the well-posedness of the minimization problem is not affected by $w_p\equiv 0$, see (Silin and Patzek 2001). Function $p_*(t)$ defines a stabilizing value of the injection pressure. Theoretically, this function can be selected arbitrarily; however, practically it should be a rough estimate of the optimal injection pressure. Below, we discuss the ways in which $p_*(t)$ can be reasonably specified.

The optimization problem we just have formulated is a linear-quadratic optimal control problem. In the next section, we present the necessary and sufficient conditions of optimality in the form of a system of integral equations.

III.7 Optimal Injection Pressure

Here we analyze the necessary and sufficient optimality conditions for the minimum of criterion (42) subject to constraint (81). We briefly characterize optimal control in two different modes: the continuous mode and the piecewise-constant mode. In addition, we characterize the injection pressure function, which provides exact identity $Q(t)\equiv Q_*(t)$, where $\theta\leqq t\leqq T$. A more detailed exposition is presented in (Silin and Patzek 2001). In particular, in (Silin and Patzek 2001) we have deduced that the optimal injection pressure and the cumulative injection policy on time interval $[\theta,T]$ are obtained by solving the following system of integral equations $$Q_0(t) = wA(t) + 2\frac{kk_{rw}}{\mu_w\sqrt{\pi\alpha_w}}\int_0^{\theta}\frac{(p_{inj}(\tau)-p_i)A(\tau)}{\sqrt{t-\tau}}d\tau + 2\frac{kk_{rw}}{\mu_w\sqrt{\pi\alpha_w}}\int_{\theta}^{t}\frac{(p_0(\tau)-p_i)A(\tau)}{\sqrt{t-\tau}}d\tau \tag{105}$$

$$p_0(t) = p_*(t) - 2\frac{kk_w}{\mu\sqrt{\pi\alpha}\,w_p(t)}A(t)\int_i^T\frac{w_q(\tau)}{\sqrt{\tau-t}}(Q_0(\tau)-Q_*(\tau))d\tau \tag{106}$$

The importance of a non-zero weight function $w_p(t)$ is now obvious. If this function vanishes, the injection pressure cannot be calculated from Eq. (49) and the controller output is not defined. The properties of the system of integral equations (48)–(49) are further discussed in (Silin and Patzek 2001).

Equation (49), in particular, implies that the optimal injection pressure satisfies the condition $p_0(T)=p_*(T)$. The trivial function $p_*(t)\equiv 0$ is not a good choice of the reference pressure in Eq. (42) because it enforces zero injection pressure by the end of the current subinterval. Another possibility $p_*(t)\equiv p_{init}$ has the same drawback: it equalizes the injection pressure and the pressure outside the fracture by the end of the current interval. Apparently $p_*(t)$ should exceed $p_i$ for all t. At the same time, too high a value of $p_*(t)$ is not desirable because it may cause a catastrophic extension of the fracture. A rather simple and reasonable choice of $p_*(t)$ is provided by $p_*(t)\equiv P_*$, where $P_*$ is the optimal constant pressure on the interval. The equation characterizing $P_*$ is obtained in (Silin and Patzek 2001) As soon as we have selected the target stabilizing function, $p_*(t)$, the optimal injection pressure is provided by solving Eqs. (48)–(49).

Note that the optimal injection pressure depends on effective fracture area, A(t), and on the deviation of the cumulative injection, $Q_0(t)$, from the target injection, $Q_*(t)$, measured on the entire interval [0,T], rather than on the current instantaneous values. Thus, Eq. (49) excludes genuine feedback control mode.

There are several ways to circumvent this difficulty. First, we can organize the process of control as a systematic procedure. We split the whole time interval into reasonably small parts, so that on each part one can make reasonable estimates of the required parameters. Then we compute the optimal injection pressure for this interval and apply it by adjusting the control valve. As soon as either the measured cumulative injection or the effective fracture area begins to deviate from the estimates used to determine the optimal injection pressure, the control interval [θ,T] is refreshed. We must also revise our estimate of the fracture area, A(t), for the refreshed interval and the expected optimal cumulative injection. In summary, the control is designed on a sliding time interval [θ,T]. The control interval should be refreshed before the current interval ends even if the measured and computed parameters are in good agreement. Computer simulations show, FIG. 31–FIG. 34, that an overlap of control intervals results in an appropriate reaction of the controller to the changing injection conditions.

Another possibility to resolve the difficulty in obtaining the optimal control from Eq. (49) is to change the model of fracture growth. So far, we have treated the fracture as a continuously growing object. On the other hand, it is clear that the rock surrounding the fracture is not perfect, and the area of the fracture grows in steps. This observation leads to the piecewise-constant fracture growth model. We may assume that the fracture area is constant on the current interval [θ,T]. If observation tells us that the fracture area has changed, the interval [θ,T] must be adjusted, and control refreshed. Equations (48) and (49) are simpler for piecewise constant fracture area, see (Silin and Patzek 2001).

III.8 Control Model for a Layered Reservoir

Now let us consider a control problem in the situation where there is a water breakthrough in one or more layers of higher permeability. From Eq. (86) the total injection into the transient layers is given by $$Q_T(t) = wA_T(t) + 2\frac{K_T}{\mu_w\sqrt{\pi}}\int_0^t\frac{(p_{inj}(\tau)-p_{init})A(\tau)}{\sqrt{t-\tau}}d\tau, \tag{107}$$

where $$A_T(t) = \frac{1}{H}\sum_{i\in I}h_iA(t) \text{ and } K_T = \frac{1}{h_t}\sum_{i\in I}h_i\frac{a_ik_ik_{rw_i}}{\sqrt{\alpha_{wi}}} \tag{108}$$

To estimate the largest possible injection on interval [θ,T] under constraint (93), let us substitute Eq. (93) into Eq. (107):

$$Q_T^{\max}(t) = wA_T(t) + 2\frac{K_T}{\mu\sqrt{\pi}}\left(\int_0^{\theta}\frac{(p_{inj}(\tau)-p_{init})A(\tau)}{\sqrt{t-\tau}}d\tau + \int_{\theta}^{T}\frac{(p_{adm}(\tau)-p_{init})A(\tau)}{\sqrt{t-\tau}}d\tau\right) \tag{109}$$

From Eq. (94), one obtains $$Q_T^{\max}(t) = wA_T(t) + 2\frac{K_T}{\mu\sqrt{\pi}}\int_0^{\theta}\frac{(p_{inj}(\tau)-p_{init})A(\tau)}{\sqrt{t-\tau}}d\tau + 2\frac{K_T}{\mu_w\sqrt{\pi}}\int_{\theta}^{t}\frac{(p_{pump}(\tau)-p_{init})A(\tau)}{\sqrt{t-\tau}}d\tau + 4\frac{\sum_{i\in I}\frac{k_ik_{rw_i}a_ih_i}{\sqrt{\alpha_{wi}}}}{\sum_{j\in J}\frac{k_jk_{rw_j}a_jh_j}{L_j}}q_{adm}\sqrt{t-\theta}. \tag{110}$$

Now let us analyze the right-hand side of Eq. (110). The first term expresses the fraction of the fracture volume that intersects the transient layers. Since the total volume of the fracture is small, this term is also small. The second term decays as $\sqrt{\theta/t}$, so if steady-state flow has been established by time θ, the impact of this term is small as t>>θ. The main part of cumulative injection over a long time interval comes from the last two terms. Since production is possible only if $$p_{pump}(\tau)<p_{init} \tag{111}$$

the third term is negative. Therefore, successful injection is possible without exceeding the admissible rate of injection into steady-state layers only if $$2\frac{K_T}{\sum_{j\in J}\frac{k_j k_{rw_j} a_j h_j}{h_t L_j}} q_{adm}\sqrt{t-\theta} > \frac{K_T}{\mu_w\sqrt{\pi}}\int_\theta^t \frac{(p_{init}-p_{pump}(\tau))A(\tau)}{\sqrt{t-\tau}}d\tau \tag{112}$$

After linkage has occurred, it is natural to assume that the fracture stops growing, since an increase of pressure will lead to circulating more water to the producers rather than to a fracture extension. In addition, we may assume that producers are pumped off at constant pressure, so that $\Delta p_{pump}=p_{init}-p_{pump}(t)$ does not depend on t. Then condition (112) transforms into $$q_{adm}h_t > \sum_{j\in J}\frac{k_j k_{rw_j} a_j h_j}{\mu_w L_j}\Delta p_{pump}A_\theta \tag{113}$$

The latter inequality means that the area of the hydrofracture may not exceed the fatal threshold $$A_\theta < \frac{q_{adm}h_t}{\sum_{j\in J}\frac{k_j k_{rw_j} h_j}{\mu_w L_j}\Delta p_{pump}} \tag{114}$$

This conclusion can also be formulated in the following way. In the long run, the rate of injection into the steady-state layers, $q_{chnl}$, will be at least $$q_{chnl} > \frac{1}{h}\sum_{j\in J}\frac{k_j k_{rw_j} a_j h_j}{\mu_w L_j}\Delta p_{pump}A_\theta \tag{115}$$

Therefore, smaller hydrofractures are better. Additionally, a close injector-producer well spacing may increase the amount of channeled water. Indeed, if in Eq. (114) we had $L_i=L$ for all $j\in J$, then the threshold fracture area would be proportional to L, the distance to the neighboring producer.

III.9 Conclusions

In this section, we have implemented a model of water injection from an initially growing vertical hydrofracture into a layered low-permeability rock. Initially, water injection is transient in each layer. The cumulative injection is then expressed by a sum of convolution integrals, which are proportional to the current and past area of the hydrofracture and the history of injection pressure. In transient flow, therefore, one might conclude that a bigger hydrofracture and higher injection pressure result in more water injection and a faster waterflood. When injected water breaks through in one or more of the rock layers, the situation changes dramatically. Now a larger hydrofracture causes more water recirculation.

We have proposed an optimal controller for transient and transient/steady-state water injection from a vertical hydrofracture into layered rock. We have presented three different modes of controller operation: the continuous mode, piecewise constant mode, and exactly optimal mode. The controller adjusts injection pressure to keep injection rate on target while the hydrofracture is growing. The controller can react to the sudden hydrofracture extensions and prevent the catastrophic ones. After water breakthrough occurs in some of the layers, we arrive at a condition for the maximum feasible hydrofracture area, beyond which waterflood may be uneconomic because of excessive waterflood fluid recirculation.

In summary, we have coupled early transient behavior of water injectors with their subsequent behavior after water breakthrough. We have shown that early water injection policy and the resulting hydrofracture growth may very unfavorably impact the later performance of the waterflood.

TABLE 2

| | $Y_1$ | $Y_2$ | $Y_3$ | $Y_4$ | $Z_1$ | $Z_2$ | $Z_3$ | $Z_4$ |
|---|---|---|---|---|---|---|---|---|
| Well A: | 438.5 | 220.8 | 438.2 | 298.7 | −507.3 | 1209.1 | 1468.4 | 1462.9 |
| Well B: | 139.5 | 116.0 | 51.2 | −22.7 | 2229.6 | 4381.2 | 5615.7 | 9073.2 |
| Well C: | 259.7 | 3.1 | 15.7 | 480.3 | −29.8 | 1116.8 | 3383.2 | 2204.5 |

TABLE 3

| | $T_1$ [days] | $T_2$ [days] | $T_3$ [days] | $T_4$ [days] |
|---|---|---|---|---|
| Well A: | 1.3384 | 29.9865 | 11.2291 | 23.9861 |
| Well B: | 255.4 | 1426.5 | 12030.1 | 159760.4 |
| Well C: | 0.013 | 129785.9 | 46436.1 | 21.07 |

IV Injection Control in a Layered Reservoir

Let us consider optimal control of fluid injection into a layered rock formation, or reservoir. The mode of control considered here uses piecewise constant injection pressure. More specifically, we assume that the historic data with information about the injection pressures and the injection rates as well as the estimate of the "effective fracture area" are available. By "effective fracture area", we mean the existing estimates for the fractions of the effective fracture area in both the transient and steady state flow layers. These estimates have been obtained by numerically fitting the injection pressure and rate data on previous time intervals.

Here we concentrate on the design of the optimal injection pressure for the next time interval. Let $\theta_i$, $0=\theta_0<\theta_1<\ldots<\theta_N$, denote the time instants where the effective fracture area sustained a step-wise change in the past, i.e., the current time $t>\theta_N$. A change of flow properties associated with each step-wise change could occur either in all layers simultaneously or only in some layers. Following (Silin and Patzek 2001), we obtain that the cumulative injection volume can be expressed as the sum $$Q(t)=Q_S(t)+Q_T(t) \tag{116}$$

where $Q_S(t)$ and $Q_T(t)$ are the cumulative injection volumes into steady-state and transient flow layers, respectively. From (Silin and Patzek 2001) we infer that $$Q_S(t) = \sum_{i=1}^{N} Y_i \int_{\theta_{i-1}}^{\theta_i} [p_{inj}(\tau) - p_{pump}]d\tau + Y_N \int_{\theta_N}^{t} [p_{inj}(\tau) - p_{pump}]d\tau \text{ and} \tag{117}$$

$$Q_T(t) = \sum_{i=1}^{N} Z_i \int_{\theta_{i-1}}^{\theta_i} \frac{p_{inj}(\tau) - P_i}{\sqrt{t-\tau}} d\tau = Z_N \int_{\theta_N}^{t} \frac{p_{inj}(\tau) - p_i}{\sqrt{t-\tau}} d\tau \tag{118}$$

Here $$Y(t) = \sum_{j \in J} \frac{k_j k_{rw_j} a_j h_j}{\mu_w L_j h_t} A(t) \text{ and } Z(t) = \sum_{i \in I} \frac{k_i k_{rw_i} a_i h_i}{\mu_w \sqrt{\alpha_{wi} h_t}} A(t) \tag{119}$$

are lumped parameters characterizing the distribution of the fracture between the layers. The indices in set I count steady state flow layers, whereas indices in set J count the transient flow layers. The ratio $(Z/Y)^2$, previously seen above in Eq. (100), has the dimension of time and is an important parameter characterizing the limiting time interval beyond which the injection becomes mostly circulation of water through these layers in which steady state flow has been established. In equations (117) and (118), the summed terms include the known injection pressure measured on past intervals, whereas the last term includes the injection pressure to be determined.

Let us select a time interval $[\theta_N, T]$ upon which we are going to design the control. The length of this interval has to be determined on case-by-case basis, but from field data analysis, a one-day interval appears to be a reasonable starting point. The parameters Y and Z change only when the formation properties are modified due to a fracture extension, formation collapse caused by subsidence, or other reservoir rock damage. These reservoir property changes only infrequently occur, so first let us assume that both Y and Z remain constant over the time interval $[\theta_N, T]$. This assumption causes the control procedure under consideration to have a single time-interval delay in reacting to the changes of the reservoir rock formation properties near the wellbore. This one-interval time delay can be decreased or increased as needed by respectively shortening or lengthening the planning time interval $[\theta_{N-1}, \theta_N]$.

We design the optimal injection pressure by minimization of the performance criterion $$J = \frac{1}{2} \int_{\theta_N}^{t} [Q_N(t) - Q_*(t)]^2 d\tau \tag{120}$$

where $Q_*(t)$ and $Q_N(t)$ are, respectively, the target cumulative injection on the time interval $[\theta_N, T]$, and the cumulative injection on the time interval $[\theta_{N-1}, \theta_N]$. Equation (120) can be easily reduced to a dimensionless form by introduction of a characteristic cumulative injection volume over the control interval. Passing to dimensionless variables does not affect the minimum of the functional (120), so we consider this functional in the dimensional form (120) to simplify of the calculations.

From equations (116)–(118) we obtain $$Q(t) = Y_N \int_{\theta_N}^{t} [p_{inj}(\tau) - p_{pump}]d\tau + \sum_{i=1}^{N} Z_i \int_{\theta_{i-1}}^{\theta_i} (p_{inj}(\tau) - p_i)\left(\frac{1}{\sqrt{t-\tau}} - \frac{1}{\sqrt{\theta_N - \tau}}\right)d\tau + Z_N \int_{\theta_N}^{t} \frac{p_{inj}(\tau) - p_i}{\sqrt{t-\tau}} d\tau \tag{121}$$

We are looking for a constant pressure set point on the time interval, therefore we put $$p_{inj}(t) = P_N, \theta_N < t < T \tag{122}$$

and $$J = \frac{1}{2} \int_{\theta_N}^{T} \left[Y_N (P_N - p_{pump})(t - \theta_N) + 2Z_N (P_N - p_i)\sqrt{t - \theta_N} - \varphi(t)\right]^2 d\tau \tag{123}$$

where $$\varphi(t) = Q_*(t) - \sum_{i=1}^{N} Z_i \int_{\theta_{i-1}}^{\theta_i} (p_{inj}(\tau) - p_i)\left(\frac{1}{\sqrt{t-\tau}} - \frac{1}{\sqrt{\theta_N - \tau}}\right)d\tau \tag{124}$$

Minimization of the criterion (123) with respect to $P_N$ yields the following result:

$$P_N = \frac{\int_{\theta_N}^{T} \left(Y_N (t - \theta_N) + 2Z_N \sqrt{t - \theta_N}\right)\left[Y_N p_{pump}(t - \theta_N) + 2Z_N p_i \sqrt{t - \theta_N} - \varphi(t)\right]d\tau}{\int_{\theta_N}^{T} \left[Y_N p_{pump}(t - \theta_N) + 2Z_N p_i \sqrt{t - \theta_N} - \varphi(t)\right]^2 d\tau} \tag{125}$$

The optimal injection pressures on the past time intervals $[\theta_{i-1}\theta_i]$ were designed to be constant. Therefore, in Eq. (124), the respective actual pressures are also close to constant or can be replaced by their average values. The terms generated by older historical terms are less important than the terms corresponding to more recent time intervals. From Eqs. (118), (121) and (124), the contribution of the term corresponding to the time interval $[\theta_{i-1}, \theta_i]$ to the cumulative injection evaluated between $t=\theta_N$ and $t=\theta_{N+1}$ is proportional to the integral $$\int_{\theta_{i-1}}^{\theta_i} \left(\frac{1}{\sqrt{t-\tau}} - \frac{1}{\sqrt{\theta_N - \tau}}\right)d\tau,$$

which can be estimated using the following inequality:

$$\int_{\theta_{i-1}}^{\theta_i}\left(\frac{1}{\sqrt{t-\tau}}-\frac{1}{\sqrt{\theta_N-\tau}}\right)d\tau \le \sqrt{\delta\theta}\left(\frac{\delta\theta}{\theta_N-\theta_i}\right)^{3/2} \tag{126}$$

In Eq. (126), $\delta\theta$ is the maximal length of the time intervals. Therefore, in particular, we obtain $$\int_{\theta_{i-1}}^{\theta_i}\left(\frac{1}{\sqrt{t-\tau}}-\frac{1}{\sqrt{\theta_N-\tau}}\right)d\tau \le \sqrt{\delta\theta}\left(\frac{1}{N-i}\right)^{3/2} \tag{127}$$

Inasmuch as the duration of each individual control time interval is either constant or can be estimated by a constant, the expression on the right-hand of inequality (127) decays as the difference N−i increases.

IV.1 Piecewise-Constant Injection Control: Initial Injection Startup Parameters

In this section we discuss how the initial values of parameters Y and Z can be determined. The estimation of Y and Z will be discussed later.

Assume that initially the injection is performed at a constant pressure with stable behavior of the injection rate. The stable injection rate confirms that no dramatic fracture extensions or formation damage propagation event occur during a chosen period of observations. Therefore, the parameters Y and Z are constant and Eqs. (116)–(118) imply that the cumulative injection during the time period $[\theta_0,\theta_0+T]$ can be expressed as $$Q(t) = Z_1(p_{inj,1}-p_i)\left(\int_0^t \frac{1}{\sqrt{t-\tau}}d\tau - \int_0^{\theta_0}\frac{1}{\sqrt{\theta_0-\tau}}d\tau\right) + Y_1(p_{inj,1}-p_{pump})(t-\theta_0) \tag{128}$$

Here $p_{inj,1}$ is the injection pressure on the first data interval. Our goal in this section is to estimate $Y_1$, $Z_1$ and $O_0$ using measured data. The time $\theta_0$ can be called the effective setup time. Clearly, $t-\theta_0$ is the elapsed time from the beginning of the data interval. Simple calculations result in $$Q(t)=2Z_1(p_{inj,1}-p_i)(\sqrt{\theta_0+(t-\theta_0)}-\sqrt{\theta_0})+Y_1(p_{inj,1}-p_{pump})(t-\theta_0) \tag{129}$$

If $Q_{obs}(t)$ is the cumulative injection calculated on the time interval $[\theta_0,\theta_0+T]$ using the measured injection rates, then it is natural to estimate $Y_1$,$Z_1$ and $\theta_0$ by minimization of the fitting criterion $$J_Q = \frac{1}{2}\int_{\theta_0}^{T}(Q(t)-Q_{obs}(t))^2 dt \tag{130}$$

To describe the best fitting procedure, it is convenient to introduce the following short-cut notations:

$$a_1=2Z_1(p_{inj,1}-p_i) \text{ and } b_1=Y_1(p_{inj,1}-p_{pump}) \tag{131}$$

Equations (131) are easily inverted to obtain:

$$Z_1 = \frac{a_1}{(p_{inj,1}-p_i)} \text{ and } Y_1 = \frac{b_1}{(p_{inj,1}-p_{pump})} \tag{132}$$

Within these notations, the criterion (130) is a function of three variables: $a_1$, $b_1$ and $\theta_0$. The following simple minimization procedure is implemented. Note that $J_Q$ is linear with respect to $a_1$ and $b_1$. Therefore, at a given $\theta_0$, the values of $a_1$ and $b_1$ providing the least value to the criterion (130) can be obtained by solving a system of two linear equations with two unknowns:

$$\begin{cases} M_{11}a_1 + M_{12}b_1 = B_1 \\ M_{12}a_1 + M_{22}b_1 = B_2 \end{cases} \tag{133}$$

where $$M_{11} = 2\theta_0(T-\theta_0) + \frac{(T-\theta_0)^2}{2} + \frac{4}{3}\theta_0^2 - \frac{4}{3}\theta_0^{1/2}T^{3/2} \tag{134}$$

$$M_{12} = \frac{2}{5}(T^{5/2}-\theta_0^{5/2}) + \frac{2}{3}\theta_0(T^{3/2}-\theta_0^{3/2}) - \theta_0^{1/2}(T-\theta_0)^2 \tag{135}$$

$$M_{22} = \frac{1}{3}T^3 \tag{136}$$

$$B_1 = \int_{\theta_0}^{T}(\sqrt{t}-\sqrt{\theta_0})Q_{obs}(t)dt \tag{137}$$

$$B_2 = \int_{\theta_0}^{T}(t-\theta_0)Q_{obs}(t)dt \tag{138}$$

Equations (133) are obtained by setting to zero the gradient of the functional (130) with respect to variables $a_1$ and $b_1$. The solution to system (133) is explicitly given by $$a_1 = \frac{M_{22}B_1 - M_{12}B_2}{M_{11}M_{22}-M_{12}^2} \quad b_1 = \frac{M_{11}B_2 - M_{12}B_1}{M_{11}M_{22}-M_{12}^2} \tag{139}$$

Therefore, substituting solution (139) into the criterion (130) we reduce the latter criterion to a function of one variable $\theta_0$.

There are numerous standard procedures for numerically minimizing functions such as Eq. (130) published in the literature, see, e.g., (Forsythe, Malcolm et al. 1976). By using numerical minimization techniques, we obtain $\theta_0$. Using the obtained value of $\theta_0$ with Eqs. (131) and (139), we can calculate values for $Y_1$ and $Z_1$.

IV.2 Piecewise-Constant Injection Control: The Fracture Diagnostics Module

In this section we describe how the injection flow rate and pressure data, together with estimates of the coefficients Y and Z obtained on the past time intervals are used to obtain an estimate of the current values of these parameters. These ideas are derived from the previous section.

Assume parameters Y and Z for a certain sequence of contiguous time intervals $[\theta_{i-1},\theta_i]$ for i=1,2, . . . ,N. Denote those values by $Y_i$ and $Z_i$ respectively. Now, we need to determine $Y_{N+1}$ and $Z_{N+1}$ for the next interval $[\theta_N,\theta_{N+1}]$. During this analysis, the pressure set point is calculated by using Eq. (125). Estimate (127) provides a time scale for deciding how far into the past the sequence of intervals should extend. After a sufficiently long time, the contribution of "very old" transient flow components becomes negligibly small in comparison with the steady-state flow component characterized by the coefficient Y and by the recent flow paths available for transient flow mode. The time scale of the transient flow decay depends on the formation rock properties, particularly how fractured the rock is.

We recall here that all parameters involved in the equations above are lumped parameters depending on several independently unknown physical properties: the permeabilities of the rock in different layers, the thickness of individual layers and the entire rock formation, and finally the damage and development of fingers and break-through in some high-permeability layers.

To estimate the parameters $Y_N$ and $Z_N$, we apply equation (121) on the latest control time interval $[\theta_{N-1},\theta_N]$ and perform a best fit similar to the one described in the previous section. Namely, if $Q_{obsN}(t)$ is the cumulative injection on the time interval $[\theta_{N-1},\theta_N]$ calculated from the measured rates, then we are looking for coefficients $Y_N$ and $Z_N$ corresponding to the least value of the fitting criterion $$J_{QN} = \frac{1}{2}\int_{\theta_{N-1}}^{\theta_N} (Q_N(t) - Q_{obsN}(y))^2\, dt \tag{140}$$

Here, by virtue of Eq. (121), $$Q_N(t) = Y_N \int_{\theta_{N-1}}^{t} [p_{inj}(\tau) - p_{pump}]\, d\tau + \sum_{i=1}^{N-1} Z_i \int_{\theta_{i-1}}^{\theta_i} (p_{inj}(\tau) - p_i)\left(\frac{1}{\sqrt{t-\tau}} - \frac{1}{\sqrt{\theta_N - \tau}}\right) d\tau + Z_N \int_{\theta_{N-1}}^{t} \frac{p_{inj}(\tau) - p_i}{\sqrt{t-\tau}}\, dt \tag{141}$$

Note that the only unknown parameters in Eq. (141) are $Y_N$ and $Z_N$. We substitute the actually measured injection pressures in Eq. (141). Although the set-point pressure is constant on each planning interval, the actual injection pressure can be different from that constant. In such a case, the evaluation of all the integrals has to be performed numerically using standard quadrature formulae, see e.g., (Press, Flannery et al. 1993). The only term needing a nonstandard approach is the last integral in Eq. (141), because the denominator is equal to zero at the upper limit of integration and the integrand becomes unbounded. For numerical evaluation of such an integral we use a modified trapezoidal rule as described in the Appendix.

By denoting $$\varphi_{N-1}(t) = \sum_{i=1}^{N-1} Z_i \int_{\theta_{i-1}}^{\theta_i} (p_{inj}(\zeta) - p_i)\left(\frac{1}{\sqrt{t-\zeta}} - \frac{1}{\sqrt{\theta_N - \xi}}\right) d\zeta \tag{142}$$

the estimation problem reduces to the minimization of the functional $$J_{QN} = \frac{1}{2}\int_{\theta_{N-1}}^{\theta_N} \left[ Y_N \int_{\theta_{N-1}}^{t} (p_{inj}(\tau) - p_{pump})\, d\tau + Z_N \int_{\theta_{N-1}}^{t} \frac{p_{inj}(\tau) - p_i}{\sqrt{t-\tau}}\, d\tau - (Q_{obsN}(t) - \varphi_{N-1}(t)) \right]^2 dt \tag{143}$$

with respect to $Y_N$ and $Z_N$. Analogous to the previous section, the minimum of the quadratic functional (143) can be found analytically by solving the system of two linear equations:

$$\begin{cases} M_{11}^N Y_N + M_{12}^N Z_N = B_1^N \\ M_{12}^N Y_N + M_{22}^N Z_N = B_2^N \end{cases} \text{ where} \tag{144}$$

$$M_{11}^N = \int_{\theta_{N-1}}^{\theta_N} \left[ \int_{\theta_{N-1}}^{t} (p_{inj}(\tau) - p_{pump})\, d\tau \right]^2 dt \tag{145}$$

$$M_{12}^N = \int_{\theta_{N-1}}^{\theta_N} \left[ \int_{\theta_{N-1}}^{t} (p_{inj}(\tau) - p_{pump})\, d\tau \int_{\theta_{N-1}}^{t} \frac{p_{inj}(\tau) - p_i}{\sqrt{t-\tau}}\, d\tau \right] dt \tag{146}$$

$$M_{22}^N = \int_{\theta_{N-1}}^{\theta_N} \left[ \int_{\theta_{N-1}}^{t} \frac{p_{inj}(\tau) - p_i}{\sqrt{t-\tau}}\, d\tau \right]^2 dt \tag{147}$$

$$B_1^N = \int_{\theta_{N-1}}^{\theta_N} \left[ \int_{\theta_{N-1}}^{t} (p_{inj}(\tau) - p_{pump})\, d\tau (Q_{obsN}(t) - \varphi_{N-1}(t)) \right] dt \tag{148}$$

$$B_2^N = \int_{\theta_{N-1}}^{\theta_N} \left[ \int_{\theta_{N-1}}^{t} \frac{p_{inj}(\tau) - p_i}{\sqrt{t-\tau}}\, d\tau (Q_{obsN}(t) - \varphi_{N-1}(t)) \right] dt \tag{149}$$

The solution to the system of equations (144) is provided by $$Y_N = \frac{M_{22}^N B_1^N - M_{12}^N B_2^N}{M_{11}^N M_{22}^N - (M_{12}^N)^2} \quad Z_N = \frac{M_{11}^N B_2^N - M_{12}^N B_1^N}{M_{11}^N M_{22}^N - (M_{12}^N)^2} \tag{150}$$

As $Y_N$ and $Z_N$ are estimated, the pressure set point is determined from Eq. (125).

It is important to recognize that substitution of the parameters $Y_N$ and $Z_N$ back into Eqs. (117) and (118) yields estimates of the cumulative flow volumes injected into steady-state flow and transient-flow layers. Comparison of historical data of $Y_N$ and $Z_N$ provides an evaluation of the efficiency of the waterflood, as well as yielding significant insight into the operation of the waterflood. With such data displayed, it becomes possible to detect jumps in the hydrofracture area, relating to changes in the reservoir geology. This data history also provides information that can be extrapolated to future economic analyses of the operation of the waterflood.

IV.3 The Overall Controller Schematic

The following injection control scheme is proposed. Initially, injection is started based on the well tests and other rock formation properties estimates. After at least one data sample of time, injection pressure, and cumulative injection volume is acquired, the initial values of parameters $Y_1$ and $Z_1$ are calculated using Eqs. (134)–(139) and (131). Then a pressure set point for interval $[\theta_1,\theta_2]$ is calculated using Eqs. (124) and (125). At the end of time interval $[\theta_1,\theta_2]$, $Y_1$ and $Z_1$ are estimated using Eqs. (145)–(150). The calculation of the next pressure data point is now possible using Eqs.

(145)–(150). Then the process is repeated in time over and over again. As the data history ages, the relative contribution of each individual data sample decreases as estimated in (127). Ultimately, the relative estimate (127) approaches zero, say less than 1%, thus the earlier data points can be discarded and the number of time intervals used to calculate the pressure set points remains bounded.

V Practical Implementation of the Waterflood Control System

In a working oil field using waterflood injection, logs are typically maintained to record the time and pressures of injection wells, as well as of producing wells. The pressures can be measured manually using traditional gauges, automatically using data logging pressure recorders. These gauges or recorders can variously function with analog, digital, or dual analog and digital outputs. All of these outputs can be represented as either analog or digital electrical signals into suitable electronic recording devices. A non-electric pressure gauge with a needle indicator movement is a form of analog gauge, however necessitates manual visual reading. The total volume of fluid injected into an injector well can similarly be recorded. Time bases for data recording can vary from wristwatches to atomic clocks. Generally, based on the extremely long time scales present in waterflooding, hourly or daily measurement accuracy is all that is required.

Based on analyses external to this invention, an injection goal is generated.

After a period of recording time, pressures, and cumulative injection volume, preferably more or less uniformly spaced in time as well as preferably measured simultaneously, an historical data set of injection well is available for use as background for determining future optimal injection pressures.

At this point, it becomes possible to calculate the optimal injection pressures using the mathematical methods described above. With the advent of cellular communications, internet communications, and distributed sensor/computation equipment, the optimal injection pressure could be computed in a number of ways, including but not limited to: 1) locally at the injector well using an integrated data collection and controller system so that all data is locally collected, processed, injection pressure determined, and injection pressure set, with or without telemetry of the data and settings to a central office; 2) the historical data set collected at the injector, telemetering the data to a location remote to the injector, remotely processing the data to calculate an optimal injection pressure, and communicating the optimal injection pressure back to the injector, where the pressure setting is adjusted; 3) data collected at the injector, telemetered to a remote site accumulating the data into an historical data set, followed by either local or remote or distributed computation of the optimal injection pressure, followed by communication to the injector well to set the optimal injection pressure; and 4) a full client-server approach using the injector well as the client for data sensing and pressure setting, with the server calculating and communicating the optimal pressure setting back to the injector well.

In all of the methods of calculating optimal injection pressure, the cumulative injection volume is simultaneously fitted to relationships both linear and the square root of time. The curve fit coefficients relate to the steady state and transient hydrofracture state of the waterflood as described above. These coefficients are important in waterflood diagnostics to indicate the occurrence of step-function increases in the hydrofracture area, indicating that the optimal injection pressure should be reset to a lower value to minimize the potential for catastrophic waterflood damage. By archiving the data collected of time, pressure, and cumulative injection, in addition to the steady state and transient waterflood coefficients, the data can be analyzed to comprehend the progress of waterflood hydrofracturing. The transient waterflood coefficient, in particular, indicates hydrofracture extension.

The setting of the optimal injector pressure is typically difficult given the erratic behavior of the hydrofractures influencing the resistance to injector flow. Nominally, setting the pressure as read on the pressure indicator of the particular injector to the prescribed injector pressure is to be preferably within ten percent (10%), more preferably within five percent (5%), and most preferably within one percent (1%) of the average steady state value.

VI Appendix. Numerical Integration of a Convolution Integral

Consider the following generic problem: approximate the integral $$\int_a^b \frac{f(\xi)}{\sqrt{\tau-\xi}}\,d\xi$$

by a quadrature formula $$\int_a^b \frac{f(\xi)}{\sqrt{\tau-\xi}}\,d\xi \approx I(f;a,b) = A_1 f(a) + A_2 f(b) \tag{151}$$

Let us design a formula, which provides exact result when $f(t)$ is an arbitrary linear function $\phi(t)=\alpha+\beta t$. By a simple change of notations $u=\alpha-\beta\tau$ and $v=-\beta$ one can represent $\phi(t)$ in the form $$\phi(t)=u+v(t-\xi) \tag{152}$$

Substitution of (152) into (151) and the requirement of exactness for linear functions produce the following equation $$\int_a^b \frac{u+v(\tau-\xi)}{\sqrt{\tau-\xi}}\,d\xi = A_1(u+v(\tau-a)) + A_2(u+v(\tau-b))$$

which has to be true for an arbitrary pair of u and v. Putting (u, v) sequentially equal to (1, 0) and (0, 1) one obtains the following system of linear equations $$\begin{cases} A_1 + A_2 = 2\left(\sqrt{\tau-a} - \sqrt{\tau-b}\right) \\ A_1(\tau-a) + A_2(\tau-b) = \frac{2}{3}\left(\sqrt{(\tau-a)^3} - \sqrt{(\tau-b)^3}\right) \end{cases} \tag{153}$$

The solution to this system is provided by $$\begin{cases} A_1 = \dfrac{\frac{2}{3}(\tau-a)-\frac{4}{3}(\tau-b)+\frac{2}{3}\sqrt{(\tau-a)(\tau-b)}}{\sqrt{(\tau-a)}+\sqrt{(\tau-b)}} \\ A_2 = \dfrac{\frac{4}{3}(\tau-a)-\frac{2}{3}(\tau-b)-\frac{2}{3}\sqrt{(\tau-a)(\tau-b)}}{\sqrt{(\tau-a)}+\sqrt{(\tau-b)}} \end{cases} \tag{154}$$

The following statement furnishes estimate of error of the quadrature formula (151) when the coefficients $A_1$ and $A_2$ are calculated from (154).

Proposition. If a function $f(t)$ is twice continuously differentiable on [a,b] then $$\left|\int_a^b \frac{f(\xi)}{\sqrt{\tau-\xi}}\,d\xi-(A_1f(a)+A_2f(b))\right| \le \frac{1}{4}\max_{a\le\xi\le b}|f''(\xi)|(b-a)^{\frac{5}{2}} \tag{155}$$

Proof. Pick an arbitrary function $f(t)$ satisfying the assumptions of the proposition. It is known that the first-order Newton interpolation polynomial $$\omega(t) = f(a)+\frac{f(b)-f(a)}{b-a}(t-a) \tag{156}$$

satisfies the estimate $$\max_{a\le\xi\le b}|\omega(\xi)-f(\xi)| \le \max_{a\le\xi\le b}\frac{1}{8}|f''(\xi)|(b-a)^2$$

The polynomial (156) is linear, hence the quadrature formula (151) is precise for it. Notice also that $\omega(a)=f(a)$, $\omega(b)=f(b)$, and for a<b $$\sqrt{\tau-a}-\sqrt{\tau-b} = \frac{b-a}{\sqrt{\tau-a}+\sqrt{\tau-b}} \le \sqrt{b-a} \tag{157}$$

Therefore, one finally obtains $$\begin{aligned}\left|\int_a^b \frac{f(\xi)}{\sqrt{\tau-\xi}}\,d\xi-(A_1f(a)+A_2f(b))\right| &\le \\ \left|\int_a^b \frac{\omega(\xi)}{\sqrt{\tau-\xi}}\,d\xi-(A_1\omega(a)+A_2\omega(b))\right| &+ \\ \left|\int_a^b \frac{|f(\xi)-\omega(\xi)|}{\sqrt{\tau-\xi}}\,d\xi\right| &\le \frac{1}{4}\max_{a\le\xi\le b}|f''(\xi)|(b-a)^{\frac{5}{2}}\end{aligned} \tag{158}$$

All publications, patents, and patent applications mentioned in this specification are herein incorporated by reference to the same extent as if each individual publication or patent application were each specifically and individually indicated to be incorporated by reference.

The description given here, and best modes of operation of the invention, are not intended to limit the scope of the invention. Many modifications, alternative constructions, and equivalents may be employed without departing from the scope and spirit of the invention.

REFERENCES

1 Ashour, A. A. and C. H. Yew (1996). *A study of the Fracture Impedance Method.* 47th Annual CIM Petroleum Society Technical Meeting, Calgary, Canada.

2 Barenblatt, G. I. (1959a). "Concerning Equilibrium Cracks Forming During Brittle Fracture. The Stability of Isolated Cracks. Relationnships with Energetic Theories." *Journal of Applied Mathematics and Mechanics* 23(5): 1273–1282.

3 Barenblatt, G. I. (1959b). "Equilibrium Cracks Formed During Brittle Fracture. Rectilinear Cracks in Plane Plates." *Journal of Applied Mathematics and Mechanics* 23(4): 1009–1029.

4 Barenblatt, G. I. (1959c). "The Formation of Equilibrium Cracks During Brittle Fracture. General Ideas and Hypotheses. Axially-Symmetric Cracks." *Journal of Applied Mathematics and Mechanics* 23(3): 622–636.

5 Barenblatt, G. I. (1961). "On the Finiteness of Stresses at the Leading Edge of an Arbitrary Crack." *Journal of Applied Mathematics and Mechanics* 25(4): 1112–1115.

6 Barkman, J. H. and D. H. Davidson (1972). "Measuring Water Quality and Predicting Well Impairment." *J. Pet. Tech.*(July): 865–873.

7 Biot, M. A. (1956). "Theory of deformation of a porous viscoplastic anisotropic solid." *J. Applied Physics* 27: 459–467.

8 Biot, M. A. (1972). "Mechanics of finite deformation of porous solids." *Indiana University Mathematical J.* 21: 597–620.

9 Carter, R. D. (1957). "Derivation of the General Equation for Estimating the Extent of the Fractured Area." *Drill. and Prod. Prac., API:* 267–268.

10 De, A. and T. W. Patzek (1999). Waterflood Analyzer, MatLab Software Package. Berkeley, Calif., Lawrence Berkley National Lab.

11 De, A., D. B. Silin, et al. (2000). *SPE 59295: Waterflood Surveillance and Supervisory Control.* 2000 SPE/DOE Improved Oil Recovery Symposium, Tulsa, Okla., SPE.

12 Forsythe, G. E., M. A. Malcolm, et al. (1976). *Computer Methods for Mathematical Computations.* Englewood Cliffs, N.J., Prentice-Hall.

13 Gordeyev, Y. N. and V. M. Entov (1997). "The Pressure Distribution Around a Growing Crack." *J. Appl. Maths. Mechs.* 51(6): 1025–1029.

14 Holzhausen, G. R. and R. P. Gooch (1985). *Impedance of Hydraulic Fractures: Its Measurement and Use for Estimating Fracture Closure Pressure and Dimensions.* SPE/DOE 1985 Conference on Low Permeability Gas Reservoirs, Denver, Colo., SPE.

15 Ilderton, D., T. E. Patzek, et al. (1996). "Microseismic Imaging of Hydrofractures in the Diatomite." *SPE Formation Evaluation*(March): 46–54.

16 Koning, E. J. L. (1985). Fractured Water Injection Wells—Analytical Modeling of Fracture Propagation. SPE14684: 1–27.

17 Kovscek, A. R., R. M. Johnston, et al. (1996a). "Interpretation of Hydrofracture Geometry During Steam Injection Using Temperature Transients, II. Asymmetric Hydrofractures." *In Situ* 20(3): 289–309.

18 Kovscek, A. R., R. M. Johnston, et al. (1996b). "Iterpretation of Hydrofracture Geometry During Steam Injection Using Temperature Transients, I. Asymmetric Hydrofractures." *In Situ* 20(3): 251–289.

19 Muskat, M. (1946). *The Flow of Homogeneous Fluids through Porous Media*. Ann Arbor, Mich., J.W.Edwards, Inc.

20 Ovens, J. E. V., F. P. Larsen, et al. (1998). "Making Sense of Water Injection Fractures in the Dan Field." *SPE Reservoir Evaluation and Engineering* 1(6): 556–566.

21 Patzek, T. W. (1992). *Paper SPE* 24040, *Surveillance of South Belridge Diatomite*. SPE Western Regional Meeting, Bakersfield, SPE.

22 Patzek, T. W. and A. De (1998). *Lossy Transmission Line Model of Hydrofactured Well Dynamics*. 1998 SPE Western Regional Meeting, Bakersfield, Calif., SPE.

23 Patzek, T. W. and D. B. Silin (1998). *Water Injection into a Low-Permeability Rock—1. Hydrofrature Growth, SPE* 39698. 11th Symposium on Improved Oil Recovery, Tulsa, Oklahoma, Society of Petroleum Engineering.

24 Press, W. H., B. P. Flannery, et al. (1993). *Numerical Recipes in C: The Art of Scientific Computing*. New York, Cambridge University Press.

25 Silin, D. B. and T. W. Patzek (2001). "Control model of water injection into a layered formation." *SPE Journal* 6(3): 253–261.

26 Tikhonov, A. N. and V. Y. Arsenin (1977). *Solutions of ill-posed problems*. New York, Halsted Press.

27 Tikhonov, A. N. and A. A. Samarskii (1963). *Equations of mathematical physics*. New York, Macmillan.

Valko, P. and M. J. Economides (1995). *Hydraulic Fracture Mechanics*. New York, John Wiley & Sons, Inc.

29 Vasil'ev, F. P. (1982). *Numerical Methods for Solving Extremal Problems* (*in Russian*). Moscow, Nauka.

30 Warpinski, N. R. (1996). "Hydraulic Fracture Diagnostics." *Journal of Petroleum Technology*(October).

31 Wright, C. A. and C. R. A. (1995). *SPE* 30484, *Hydraulic Fracture Reorientation in Primary and Secondary Recovery from Low-Permeability Reservoirs*. SPE Annual Technical Conference & Exhibition, Dallas, Tex.

32 Wright, C. A., E. J. Davis, et al. (1997). *SPE* 38324, *Horizontal Hydraulic Fractures: Oddball Occurrances or Practical Engineering*. SPE Western Regional Meeting, Long Beach, Calif.

33 Zheltov, Y. P. and S. A. Khristianovich (1955). "On Hydraulic Fracturing of an oil-bearing stratum." *Izv. Akad. Nauk SSSR. Otdel Tekhn. Nuk*(5): 3–41.

34 Zwahlen, E. D. and T. W. Patzek (1997). *SPE* 38290, *Linear Transient Flow Solution for Primary Oil Recovery with Infill and Conversion to Water Injection*. 1997 SPE Western Regional Meeting, Long Beach, SPE.

We claim:

1. A well injection pressure controller comprising:

a. an injection goal flow rate of fluid to be injected into an injector well, the injector well having an injection pressure;

b. a time measurement device, a pressure measurement device and a cumulative flow device, said pressure measurement device and said cumulative flow device monitoring the injector well;

c. an historical data set $\{t_i\ p_i\ q_i\}$ for $i\epsilon(1,2, \ldots n)$, $n \geqq 1$ of related prior samples over an $i^{th}$ interval for the injector well containing at least a sample time $t_i$, an average injection pressure $p_i$ on the interval, and a cumulative measure of the volume of fluid injected into the injector well $q_i$ as of the sample time $t_i$ on the interval, said historical data set accumulated through sampling of said time measurement device, said pressure measurement device and said cumulative flow device;

d. a computer that uses the historical data set and the injection goal flow rate, to calculate an optimal injection pressure $p_{inj}$ for a subsequent interval of fluid injection; and e. an output device that controls the injector well injection pressure to be substantially the optimal injection pressure $p_{inj}$.

2. The well injection pressure controller of claim 1 wherein the computer calculates the optimal injection pressure $p_{inj}$ via a computer program.

3. The well injection pressure controller of claim 2 further comprising:

a. a data collection source, whereby the historical data set is obtained by said data collection source, which is manual, digital automatic, or analog automatic.

4. The well injection pressure controller of claim 3 further comprising:

a. a computer for calculating the optimal injection pressure $p_{inj}$ for the subsequent interval of fluid injection.

5. The well injection pressure controller of claim 1 wherein said subsequent interval is iterated to continuously control the optimal injection pressure $p_{inj}$ over a plurality of subsequent intervals of fluid injection.

6. The well injection pressure controller of claim 5 wherein said computer program is stored in at least one computer-readable medium.

7. The well injection pressure controller of claim 6 wherein said computer program uses a piecewise constant mode for determination of the optimal injection pressure $p_{inj}$.

8. The well injection pressure controller of claim 6 said computer program uses a continuous mode for determination of the optimal injection pressure $p_{inj}$.

9. The well injection pressure controller of claim 6 wherein said computer program uses an exact mode for determination of the optimal injection pressure $p_{inj}$.

10. The well injection pressure controller of claim 2 wherein said computer program is stored in at least one computer-readable medium.

11. A well injection pressure controller computer program in a computer readable medium comprising the steps of:

a. acquiring an injection goal flow rate of fluid to be injected into an injector well;

b. acquiring an historical data set $\{t_i\ p_i\ q_i\}$ where $i\epsilon(1 \ldots n)$, $n \geqq 1$ of related prior samples over an $i^{th}$ measurement interval for the injector well containing at least a sample time $t_i$, an average injection pressure $p_i$ on the interval, and a cumulative measure of the volume of fluid injected into the injector well $q_i$ as of each sample time $t_i$ on the interval;

c. calculating an optimal injection pressure $p_{inj}$ for a subsequent interval of fluid injection, using the historical data set and injection goal flow rate, said calculating step incorporated into a computer program in at least one computer readable medium.

12. The well injection pressure controller method of claim 11 further wherein a. said optimal injection pressure $p_{inj}$ is constant over said subsequent interval.

13. The well injection pressure controller method of claim 12 further comprising the step of:

a. outputting an aggregated parameter data output, to a computer readable medium, $Y_j$ and $Z_j$ from at least one of said subsequent intervals where $j=i+1$, where $Y_j$ and $Z_j$ are respectively proportional to transient and steady-state waterflood flow.

14. The well injection pressure controller method of claim 13 further comprising:

a. said aggregated parameter data output $Y_j$ and $Z_j$ are stored in a computer-readable medium.

15. The well injection pressure controller method of claim 13 further comprising:

a. said aggregated parameter data output comprises $\{t_j\ p_j\ Q_j\ Y_j\ Z_j\}$, b. wherein said output data set is stored in a computer-readable medium.

16. A method of optimal well injection pressure control, comprising the steps of:

a. acquiring am injection goal flow rate of fluid to be injected into an injector well;

b. acquiring an historical data set $\{t_i\ p_i\ q_i\}$ where $i\epsilon(1 \ldots n)$, $n \geqq 1$ of related prior samples over an $i^{th}$ measurement interval for the injector well containing at least a sample time $t_i$, an average injection pressure $p_i$ on the interval, and a cumulative measure of the volume of fluid injected into the injector well $q_i$ as of each sample time $t_i$;

c. calculating an optimal injection pressure $p_{inj}$ for a subsequent interval of fluid injection, said calculating step incorporated into a computer program, using said historical data set and the injection goal, d. making available said optimal injection pressure $p_{inj}$ for control of said optimal injection pressure $p_{inj}$ for a subsequent interval of fluid injection.

17. The method of optimal well injection pressure control of claim 16 further comprising the step of:

a. calculating an aggregated parameter data output $Y_j$ and $Z_j$ from at least one of said subsequent intervals where $j=i+1$, where $Y_j$ and $Z_j$ are respectively proportional to transient and steady-state waterflood flow.

18. The method of optimal well injection pressure control of claim 17 further comprising the step of:

a. storing said aggregated parameter data output $Y_j$ and $Z_j$ are in a computer-readable medium.

19. The method of optimal well injection pressure control of claim 17 further comprising the step of:

a. storing an output data set comprising $\{t_j\ p_j\ Q_j\ Y_j\ Z_j\}$ in a computer-readable medium.

20. The method of optimal well injection pressure control of claim 19 wherein said subsequent interval is iterated to continuously control the optimal injection pressure $p_{inj}$ over a plurality of subsequent intervals of fluid injection.

21. The method of optimal well injection pressure control of claim 20 wherein said step of calculating is stored as a computer program in at least one computer-readable medium.

22. The method of optimal well injection pressure control of claim 20 wherein said step of calculating uses a piecewise constant mode for determining the optimal injection pressure $p_{inj}$.

23. The method of optimal well injection pressure control of claim 20 wherein said step of calculating uses a continuous mode for determining the optimal injection pressure $p_{inj}$.

24. The method of optimal well injection pressure control of claim 20 wherein said step of calculating uses an exact mode for determining the optimal injection pressure $p_{inj}$.

25. The method of optimal well injection pressure control of claim 22 wherein said step of calculating is stored in at least one computer-readable medium.

* * * * *